US008898057B2

(12) United States Patent
Yamanashi

(10) Patent No.: US 8,898,057 B2
(45) Date of Patent: Nov. 25, 2014

(54) ENCODING APPARATUS, DECODING APPARATUS AND METHODS THEREOF

(75) Inventor: Tomofumi Yamanashi, Kanagawa (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 318 days.

(21) Appl. No.: 13/502,599

(22) PCT Filed: Oct. 22, 2010

(86) PCT No.: PCT/JP2010/006281
§ 371 (c)(1),
(2), (4) Date: Apr. 18, 2012

(87) PCT Pub. No.: WO2011/048820
PCT Pub. Date: Apr. 28, 2011

(65) Prior Publication Data

US 2012/0209597 A1 Aug. 16, 2012

(30) Foreign Application Priority Data

Oct. 23, 2009 (JP) ..... 2009-244838
Nov. 30, 2009 (JP) ..... 2009-272194

(51) Int. Cl.
*G10L 21/00* (2013.01)
*G10L 19/02* (2013.01)
*G10L 21/038* (2013.01)

(52) U.S. Cl.
CPC ..... *G10L 19/0204* (2013.01); *G10L 21/038* (2013.01)
USPC ..... 704/205; 704/500; 704/268; 704/267; 704/230; 704/229; 704/226; 704/219; 704/200.1; 381/92; 375/268

(58) Field of Classification Search
CPC ..... G10L 19/24; G10L 19/008
USPC ..... 704/205, 500, 268, 267, 230, 229, 226, 704/219, 200.1; 381/92
See application file for complete search history.

(56) References Cited

U.S. PATENT DOCUMENTS 6,324,505 B1 * 11/2001 Choy et al. ..... 704/230
6,456,963 B1 * 9/2002 Araki ..... 704/200.1
7,489,788 B2 * 2/2009 Leung et al. ..... 381/92
(Continued)

FOREIGN PATENT DOCUMENTS

CN 1407743 4/2003
CN 101223570 7/2008
(Continued)

*Primary Examiner* — Michael Colucci
(74) *Attorney, Agent, or Firm* — Greenblum & Bernstein, P.L.C.

(57) ABSTRACT

Disclosed is an encoding apparatus that can efficiently encode a signal that is a broad or extra-broad band signal or the like, thereby improving the quality of a decoded signal. This encoding apparatus includes a band establishing unit (301) that generate, based on the characteristic of the input signal, band establishment information to be used for dividing the band of the input signal to establish a first band part of lower frequency side and a second band part of higher frequency side; a lower frequency encoding unit (302) for encoding, based on the band establishment information, the input signal of the first band part to generate encoded lower frequency part information; and a higher frequency encoding unit (303) for encoding, based on the band establishment information, the input signal of the second band part to generate encoded higher frequency part information.

5 Claims, 33 Drawing Sheets

(56) References Cited

U.S. PATENT DOCUMENTS

| | | | | |
|---|---|---|---|---|
| 7,630,882 | B2 | 12/2009 | Mehrotra et al. | |
| 8,000,960 | B2 * | 8/2011 | Chen et al. | 704/219 |
| 8,005,678 | B2 * | 8/2011 | Zopf et al. | 704/267 |
| 8,024,192 | B2 * | 9/2011 | Zopf et al. | 704/267 |
| 8,423,371 | B2 * | 4/2013 | Yamanashi et al. | 704/500 |
| 8,543,389 | B2 * | 9/2013 | Ragot et al. | 704/219 |
| 8,560,328 | B2 * | 10/2013 | Yamanashi et al. | 704/500 |
| 2003/0039364 | A1 | 2/2003 | Fujita et al. | |
| 2006/0002488 | A1 * | 1/2006 | Asanuma | 375/268 |
| 2006/0122828 | A1 * | 6/2006 | Lee et al. | 704/219 |
| 2007/0016412 | A1 | 1/2007 | Mehrotra et al. | |
| 2007/0033023 | A1 * | 2/2007 | Sung et al. | 704/229 |
| 2007/0150269 | A1 * | 6/2007 | Nongpiur et al. | 704/226 |
| 2007/0208565 | A1 * | 9/2007 | Lakaniemi et al. | 704/268 |
| 2009/0271204 | A1 | 10/2009 | Tammi | |
| 2010/0017198 | A1 | 1/2010 | Yamanashi et al. | |
| 2010/0274558 | A1 | 10/2010 | Yamanashi et al. | |

FOREIGN PATENT DOCUMENTS

| | | |
|---|---|---|
| JP | 2003-140696 | 5/2003 |
| JP | 2003-255973 | 9/2003 |
| JP | 2006-133698 | 5/2006 |
| JP | 2009-501945 | 1/2009 |
| JP | 2010-085877 | 4/2010 |
| WO | 2007/052088 | 5/2007 |
| WO | 2008/072737 | 6/2008 |
| WO | 2009/081568 | 7/2009 |

* cited by examiner

ENCODING APPARATUS, DECODING APPARATUS AND METHODS THEREOF

TECHNICAL FIELD

The present invention relates to an encoding apparatus, decoding apparatus, and methods thereof, used in a communication system that encodes and transmits a signal.

BACKGROUND ART

When a speech or music signal is transmitted in a packet communication system typified by Internet communication, a mobile communication system, or the like, compression and encoding technologies are often used in order to increase the transmission efficiency of the speech or music signal. In recent years, while a speech or music signal is simply encoded at a low bit rate, there has been a growing need for a technology that encodes a wider-band speech or music signal.

In response to such a need, various technologies have been developed that encode a wideband speech or music signal without greatly increasing the amount of information after encoding. For example, Patent Literature 1 discloses a technology whereby a characteristic of a frequency high-band part among spectral data obtained by converting an input audio signal of a fixed time is generated as auxiliary information, and this is output together with low-band part coded information.

CITATION LIST

Patent Literature

PTL 1
Japanese Patent Application Laid-Open No. 2003-255973
PTL 2
WO 2007/052088

SUMMARY OF INVENTION

Technical Problem

However, with the band enhancement technology disclosed in above Patent Literature 1, a low-band part of an input signal and a high-band part generated using auxiliary information are decided beforehand in a fixed manner. Therefore, since the same coding method is used when high-band part spectral data of an input signal is minute, or conversely when high-band part spectral data has extremely high energy, or when high-band part spectral data has a complex waveform, for example, there is a problem of coding efficiency not being high. When auxiliary information is encoded at a low bit rate, in particular, the quality of decoded speech generated using calculated auxiliary information is inadequate, and in some cases there is a possibility of an allophone being generated.

It is an object of the present invention to provide an encoding apparatus, decoding apparatus, and methods thereof that enable coding of high-band part spectral data to be performed efficiently, based on low-band part spectral data, for a signal such as a wideband signal (7 kHz band) or ultrawideband signal (14 kHz band), and enable the quality of a decoded signal to be improved.

Solution to Problem

One aspect of an encoding apparatus according to the present invention performs band enhancement using a low-band side spectrum and generates a high-band side spectrum, and employs a configuration comprising: a band setting section that inputs an input signal of the frequency domain and uses a characteristic of the input signal of the frequency domain as a basis, or inputs an input signal of the frequency domain and a coding parameter and uses the coding parameter and/or a characteristic of the input signal of the frequency domain as a basis, for generating band setting information that decides a first band of a high-band side set by the band enhancement; and a high-band coding section that encodes the input signal of the first band decided based on the band setting information and generates high-band part coded information.

One aspect of a decoding apparatus according to the present invention receives and decodes coded information generated by an encoding apparatus that performs band enhancement using a low-band side spectrum of an input signal of a frequency domain and generates a high-band side spectrum, and employs a configuration comprising: a reception section that receives coded information including high-band part coded information generated by encoding an input signal of a first band that is a high-band side of the frequency domain, low-band part coded information generated by encoding the input signal of a second band of a low-band side of the frequency domain, and band setting information of the first band set based on a characteristic of an input signal of the frequency domain and/or a coding parameter included in the coded information; a low-band decoding section that generates a low-band decoded signal for the second band using the low-band part coded information; and a high-band decoding section that generates a high-band decoded signal for the first band using the high-band part coded information and the band setting information, and generates a decoded signal of the frequency domain using the low-band decoded signal and the high-band decoded signal.

One aspect of a coding method according to the present invention performs band enhancement using a low-band side spectrum and generates a high-band side spectrum, and comprises: a band setting step of inputting an input signal of the frequency domain and using a characteristic of the input signal of the frequency domain as a basis, or inputting an input signal of the frequency domain and a coding parameter and using the coding parameter and/or a characteristic of the input signal of the frequency domain as a basis, for generating band setting information that decides a first band of a high-band side set by the band enhancement; and a high-band encoding step of encoding the input signal of the first band decided based on the band setting information and generating high-band part coded information.

One aspect of a decoding method according to the present invention receives and decodes coded information generated by an encoding apparatus that performs band enhancement using a low-band side spectrum of an input signal of the frequency domain and generates a high-band side spectrum, and comprises: a receiving step of receiving coded information including high-band part coded information generated by encoding an input signal of a first band that is a high-band side of the frequency domain, low-band part coded information generated by encoding the input signal of a second band of a low-band side of the frequency domain, and band setting information of the first band set based on a characteristic of an input signal of the frequency domain and/or a coding parameter included in the coded information; a low-band decoding step of generating a low-band decoded signal for the second band using the low-band part coded information; and a high-band decoding step of generating a high-band decoded signal for the first band using the high-band part coded information and the band setting information, and generating a decoded signal of the frequency domain using the low-band decoded signal and the high-band decoded signal.

Advantageous Effects of Invention

The present invention enables coding of high-band part spectral data such as a wideband signal or an ultrawideband signal to be performed efficiently, and enables the quality of a decoded signal to be improved.

DESCRIPTION OF EMBODIMENTS

Now, embodiments of the present invention will be described in detail with reference to the accompanying drawings. In the following descriptions, a speech encoding apparatus and speech decoding apparatus are taken as examples of an encoding apparatus and decoding apparatus according to the present invention.

Embodiment 1

Figure 1:
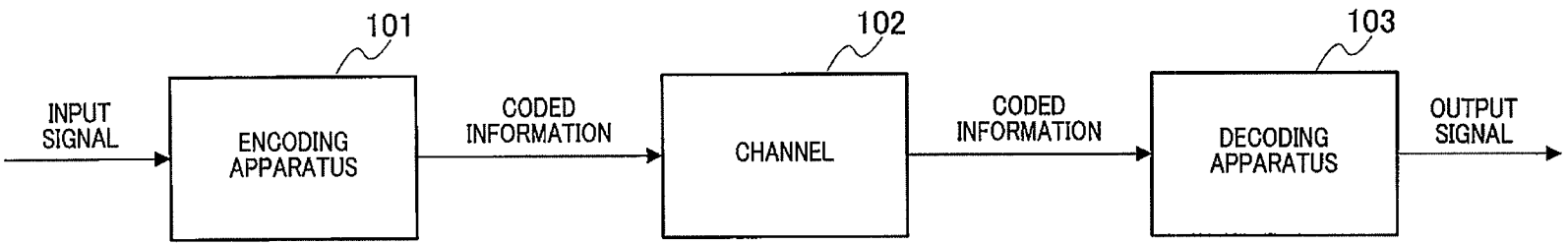
FIG. 1 is a block diagram showing the configuration of a communication system having an encoding apparatus and decoding apparatus according to Embodiment 1 of the present invention.

FIG. 1 is a block diagram showing the configuration of a communication system having an encoding apparatus and decoding apparatus according to Embodiment 1 of the present invention. In FIG. 1, the communication system is provided with encoding apparatus 101 and decoding apparatus 103, which are able to communicate via channel 102. Both encoding apparatus 101 and channel 102 are normally used and installed in a base station apparatus, communication terminal apparatus, or the like.

Encoding apparatus 101 divides an input signal into N samples at a time (where N is a natural number), takes N samples as one frame, and performs coding on a frame-by-frame basis. Here, an input signal subject to coding will be expressed as $x_n$ (n=0, . . . , N−1). Here, n indicates the (n+1)th signal element in a signal divided into N samples at a time. Encoding apparatus 101 transmits encoded input information (hereinafter referred to as "coded information") to decoding apparatus 103 via channel 102.

Decoding apparatus 103 receives coded information transmitted from encoding apparatus 101 via channel 102, decodes this coded information, and obtains an output signal.

Figure 2:
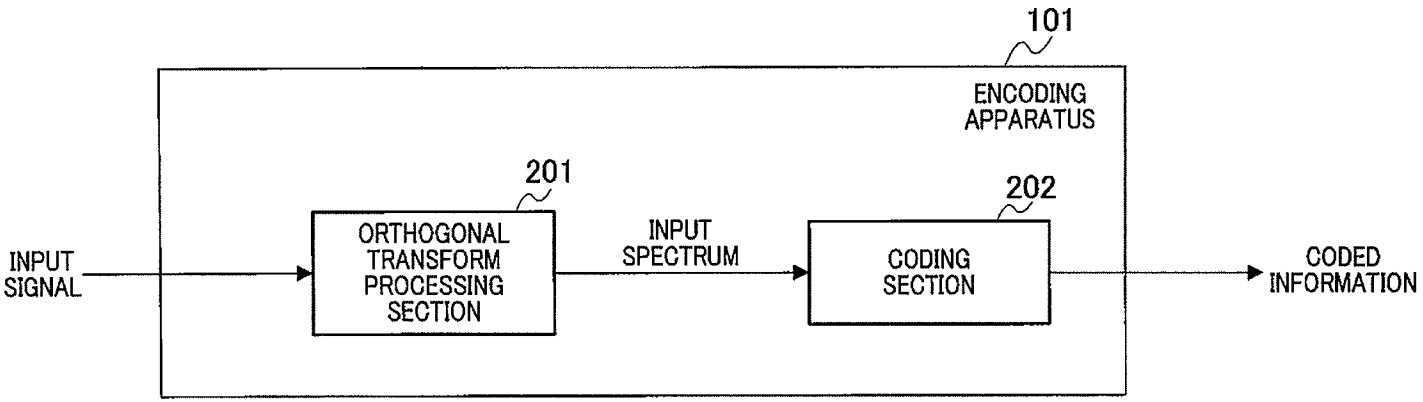
FIG. 2 is a block diagram showing the internal principal-part configuration of the encoding apparatus shown in FIG. 1.

FIG. 2 is a block diagram showing the internal principal-part configuration of encoding apparatus 101 shown in FIG. 1. Encoding apparatus 101 mainly comprises orthogonal transform processing section 201 and coding section 202.

Orthogonal transform processing section 201 has internal buffers $buf1_n$ (n=0, . . . , N−1), and performs a Modified Discrete Cosine Transform (MDCT) on input signal $x_n$.

Next, orthogonal transform processing by orthogonal transform processing section 201 will be described in relation to its computational procedure and data output to an internal buffer.

First, orthogonal transform processing section 201 initializes buffer $buf1_n$ with "0" as an initial value by means of equation 1 below.

[1]

$$buf1_n=0(n=0, \ldots N-1) \quad \text{(Equation 1)}$$

Then, orthogonal transform processing section 201 performs a modified discrete cosine transform (MDCT) on input signal $x_n$, and finds input signal MDCT coefficient (hereinafter referred to as input spectrum) X(k), in accordance with equation 2 below.

(Equation 2)

$$X(k) = \frac{2}{N}\sum_{n=0}^{2N-1} x'_n \cos\left[\frac{(2n+1+N)(2k+1)\pi}{4N}\right] \quad [2]$$

$$(k = 0, \ldots, N-1)$$

Here, k indicates an index of each sample in one frame. Orthogonal transform processing section 201 finds vector $x_n'$ linking input signal $x_n$ and buffer $buf1_n$ by means of equation 3 below.

(Equation 3)

$$x'_n \begin{cases} buf1_n & (n = 0, \ldots N-1) \\ x_{n-N} & (n = N, \ldots 2N-1) \end{cases} \quad [3]$$

Orthogonal transform processing section 201 then updates buffer $buf1_n$ by means of equation 4.

[4]

$$buf1_n=x_n(n=0, \ldots N-1) \quad \text{(Equation 4)}$$

Then orthogonal transform processing section 201 outputs input spectrum X(k) to coding section 202.

Input spectrum X(k) is input to coding section 202 from orthogonal transform processing section 201. Coding section 202 encodes input spectrum X(k), and generates coded information. Then coding section 202 transmits the generated coded information to decoding apparatus 103 via channel 102.

Figure 3:
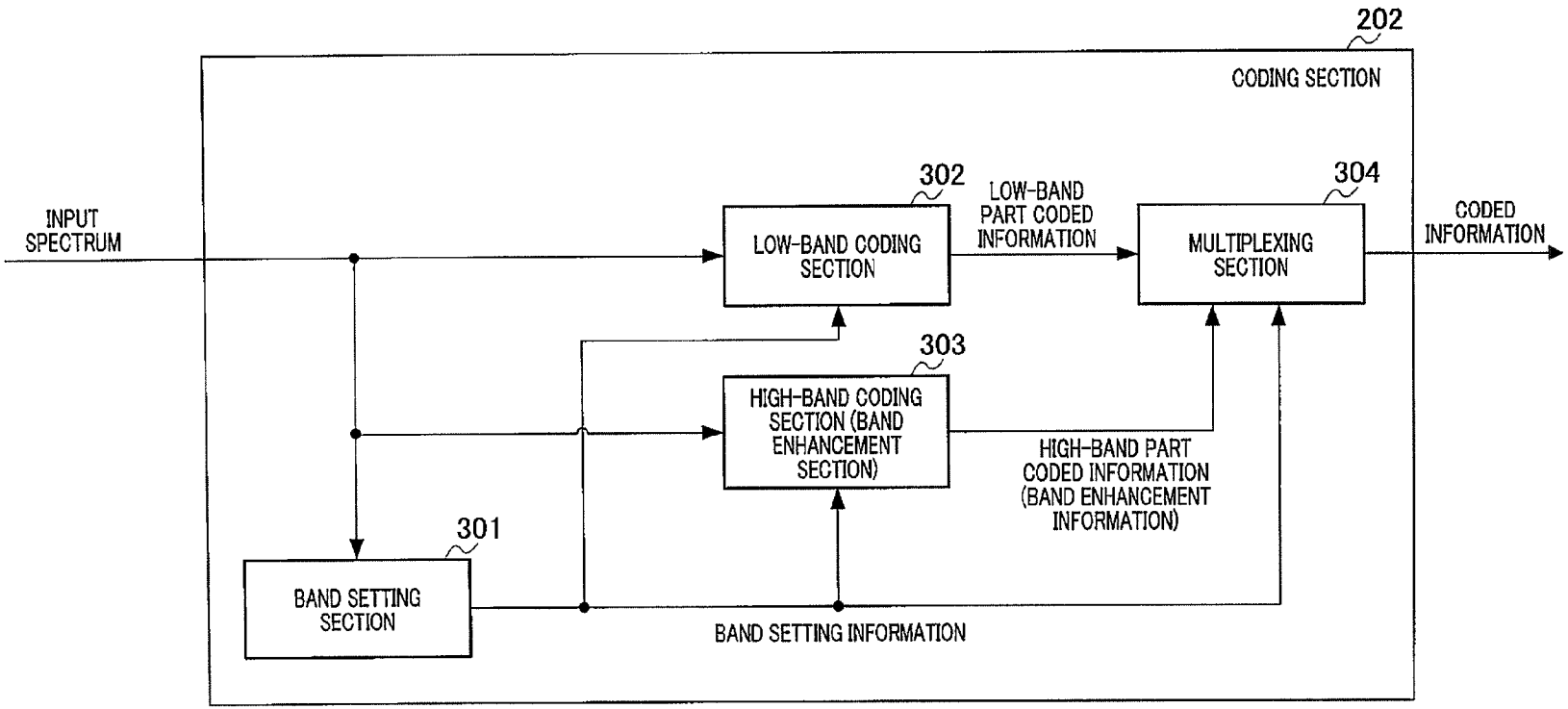
FIG. 3 is a block diagram showing the internal principal-part configuration of the coding section shown in FIG. 2.

FIG. 3 is a block diagram showing the internal principal-part configuration of coding section 202 shown in FIG. 2. Details of the processing performed by coding section 202 will now be described with reference to FIG. 3. Coding section 202 mainly comprises band setting section 301, low-band coding section 302, high-band coding section (band enhancement section) 303, and multiplexing section 304. These sections perform the following operations.

Input spectrum X(k) is input to band setting section 301 from orthogonal transform processing section 201. Band setting section 301 analyzes the spectral characteristics of input spectrum X(k), and sets bands subject to coding by low-band coding section 302 and high-band coding section (band enhancement section) 303 respectively according to the analysis results. Then, band setting section 301 outputs band setting information indicating the set bands to low-band coding section 302, high-band coding section 303, and multiplexing section 304.

The band setting information calculation method used by band setting section 301 will now be described.

Band setting section 301 first calculates, for input spectrum X(k), energy (low-band energy) $E_{Low}$ of a part for which the band is less than or equal to $TH_{Low}$ in accordance with equation 5-1, and energy (high-band energy) $E_{High}$ of a part for which the band is greater than or equal to $TH_{High}$ in accordance with equation 5-2, where $TH_{Low}$ and $TH_{High}$ are predetermined threshold values, and $TH_{Low}<TH_{High}$. In equation 5-2, $F_{max}$ is the maximum band value (maximum frequency value).

(Equation 5-1)

$$E_{Low} = \sum_{k=0}^{TH_{Low}} X(k)^2 \quad [5]$$

(Equation 5-2)

$$E_{High} = \sum_{k=TH_{High}}^{Fmax} X(k)^2$$

Next, band setting section 301 compares the magnitude of low-band energy $E_{Low}$ calculated by means of equation 5-1 with the magnitude of high-band energy $E_{High}$ calculated by means of equation 5-2, and decides band setting information Band_Setting in accordance with equation 6 below. That is to say, based on input spectrum energy characteristics, band setting section 301 generates band setting information for dividing the input spectrum band and setting a band on the low-band side (low-band part) and the high-band side (high-band part). Here, γ in equation 6 is a predetermined constant.

(Equation 6)

$$\text{Band_setting} = \begin{cases} 0 & (\text{if } E_{Low} \geq \gamma \cdot E_{High}) \\ 1 & (\text{else}) \end{cases} \quad [6]$$

That is to say, band setting section 301 sets the band setting information Band_Setting value to 0 if low-band energy $E_{Low}$ is somewhat greater than high-band energy $E_{High}$, and sets the band setting information Band_Setting value to 1 otherwise. Band setting section 301 outputs decided band setting information Band_Setting to low-band coding section 302, high-band coding section 303, and multiplexing section 304.

Input spectrum X(k) is input to low-band coding section 302 from orthogonal transform processing section 201. Also, band setting information Band_Setting is input to low-band coding section 302 from band setting section 301. Based on band setting information Band_Setting, low-band coding section 302 encodes input spectrum X(k) and generates low-band part coded information. Then low-band coding section 302 outputs the low-band part coded information to multiplexing section 304. Details of the processing performed by low-band coding section 302 will be given later herein.

Input spectrum X(k) is input to high-band coding section 303 from orthogonal transform processing section 201. Also, band setting information Band_Setting is input to high-band coding section 303 from band setting section 301. Based on band setting information Band_Setting, high-band coding section 303 encodes input spectrum X(k) and generates high-band part coded information (band enhancement information). Then high-band coding section 303 outputs the high-band part coded information to multiplexing section 304. Details of the processing performed by high-band coding section 303 will be given later herein.

Multiplexing section 304 multiplexes band setting information, low-band part coded information, and high-band part coded information input from band setting section 301, low-band coding section 302, and high-band coding section 303 respectively, and outputs the multiplexed information to channel 102 as coded information.

Figure 4:
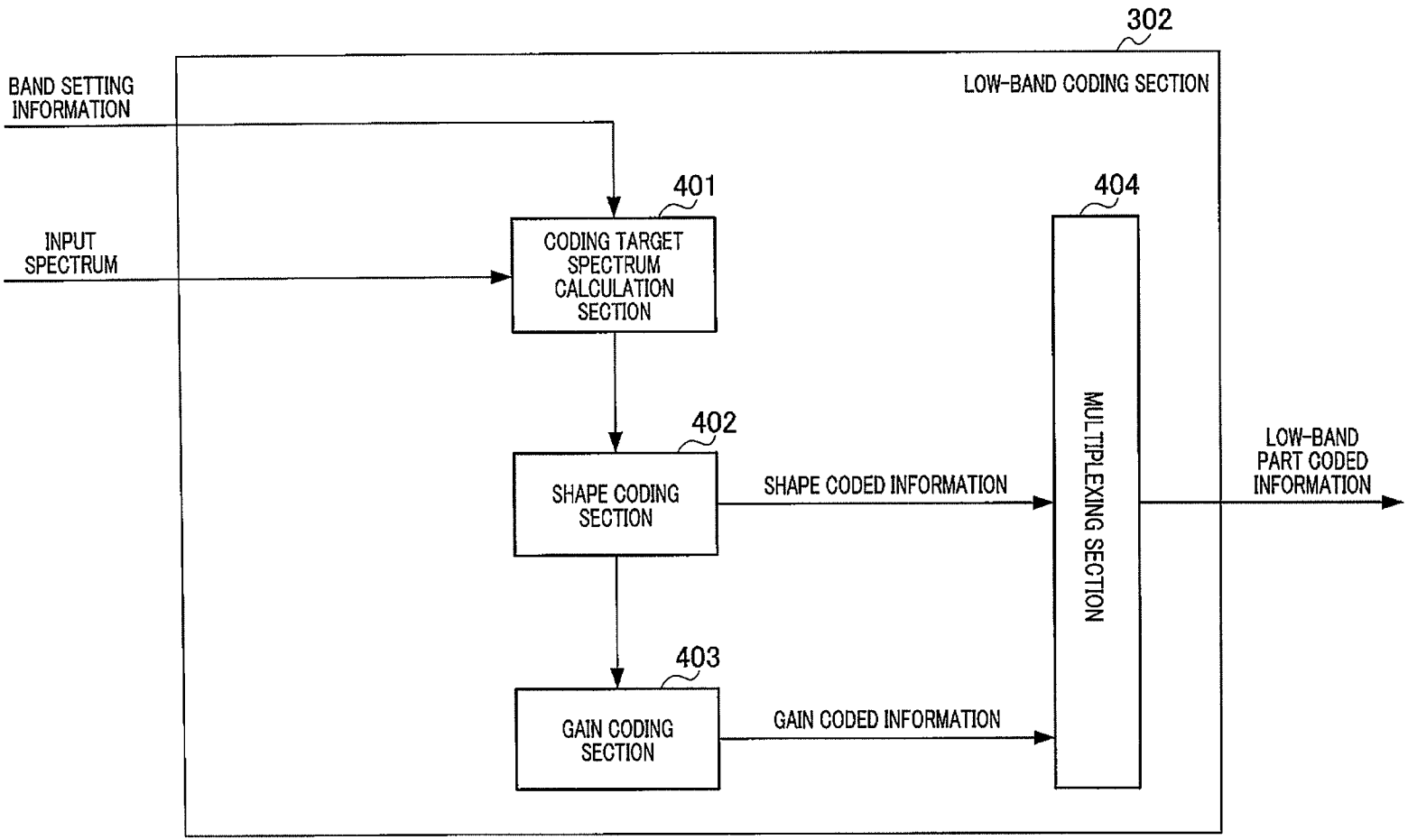
FIG. 4 is a block diagram showing the internal principal-part configuration of the low-band coding section shown in FIG. 3.

FIG. 4 is a block diagram showing the internal configuration of low-band coding section 302. Low-band coding section 302 mainly comprises coding target spectrum calculation section 401, shape coding section 402, gain coding section 403, and multiplexing section 404. These sections perform the following operations.

Band setting information Band_Setting is input to coding target spectrum calculation section 401 from band setting section 301. Also, input spectrum X(k) is input to coding target spectrum calculation section 401 from orthogonal transform processing section 201. Based on the band setting information Band_Setting value, coding target spectrum calculation section 401 decides a band that is to be an coding target, and outputs only the spectrum of the corresponding band within input spectrum X(k) to shape coding section 402.

Specifically, if the band setting information Band_Setting value is 0, coding target spectrum calculation section 401 outputs a spectrum for which the band is less than or equal to Max1 (k≤Max1) within input spectrum X(k) to shape coding section 402 as coding target spectrum X'(k). Also, if the band setting information Band_Setting value is 1, coding target spectrum calculation section 401 outputs a spectrum for which the band is less than or equal to Max2 (k≤Max2) within input spectrum X(k) to shape coding section 402 as coding target spectrum X'(k).

Here, the relationship between Max1 and Max2 is assumed to be Max1<Max2. That is to say, if the band setting information Band_Setting value is 0, coding target spectrum calculation section 401 selects a spectrum on the lower-band side within input spectrum X(k) as coding target spectrum X'(k). On the other hand, if the band setting information Band_Setting value is 1, coding target spectrum calculation section 401 selects a spectrum of a part for which the bandwidth is greater than when the band setting information Band_ Setting value is 0 within input spectrum X(k) as coding target spectrum X'(k).

Shape coding section 402 performs shape quantization on a subband-by-subband basis on coding target spectrum X'(k) input from coding target spectrum calculation section 401. Specifically, shape coding section 402 first divides coding target spectrum X'(k) into L subbands. Then, for each of the L subbands, shape coding section 402 searches an internal shape codebook comprising SQ shape code vectors, and finds an index of a shape code vector for which evaluation measure Shape_q(i) in equation 7 below is maximal.

(Equation 7)

$$\text{Shape_q}(i) = \frac{\left\{\sum_{k=0}^{BW(j)} (X'(k+BS(j))\cdot SC_k^i)\right\}^2}{\sum_{k=0}^{BW(j)} SC_k^i \cdot SC_k^i} \quad [7]$$

$$(j = 0, \ldots, L-1,\ i = 0, \ldots, SQ-1)$$

In this equation, $SC^i_k$ indicates a shape code vector configuring a shape codebook, i indicates a shape code vector index, and k indicates a shape code vector element index. Also, BW(j) represents the bandwidth of a band for which the band index is j, and BS(j) represents the minimum index of a spectrum configuring a band for which the band index is j.

Shape coding section 402 outputs shape code vector index S_max for which evaluation measure Shape_q(i) in equation 7 above is maximal to multiplexing section 404 as shape coded information. Also, shape coding section 402 calculates ideal gain Gain_i(j) in accordance with equation 8 below, and outputs this to gain coding section 403.

(Equation 8)

$$\text{Gain_i}(j) = \frac{\sum_{k=0}^{BW(j)} \left(X'(k+BS(j))\cdot SC_k^{S_max}\right)}{\sum_{k=0}^{BW(j)} SC_k^{S_max} \cdot SC_k^{S_max}} \quad [8]$$

$$(j = 0, \ldots, L-1)$$

Gain coding section 403 directly quantizes ideal gain Gain_i(j) input from shape coding section 402 in accordance with equation 9 below. Here too, gain coding section 403 treats an ideal gain as an L-dimensional vector, searches an internal gain codebook comprising GQ gain code vectors, and performs vector quantization.

(Equation 9)

$$\text{Gain_q}(i) = \left\{\sum_{j=0}^{L-1} \{\text{Gain_i}(j) - GC_j^i\}\right\}^2 \quad [9]$$

$$(i = 0, \ldots, GQ-1)$$

Gain coding section 403 finds gain code vector index G_min that minimizes square error Gain_q(i) in equation 9 above. Gain coding section 403 outputs G_min to multiplexing section 404 as gain coded information.

Multiplexing section 404 multiplexes shape coded information S_max input from shape coding section 402 and gain coded information G_min input from gain coding section 403, and outputs the multiplexed information to multiplexing section 304 as low-band part coded information. Shape coded information and gain coded information may also be directly input to multiplexing section 304, and multiplexed with high-band part coded information by multiplexing section 304.

This concludes a description of the configuration of low-band coding section 302.

Figure 5:
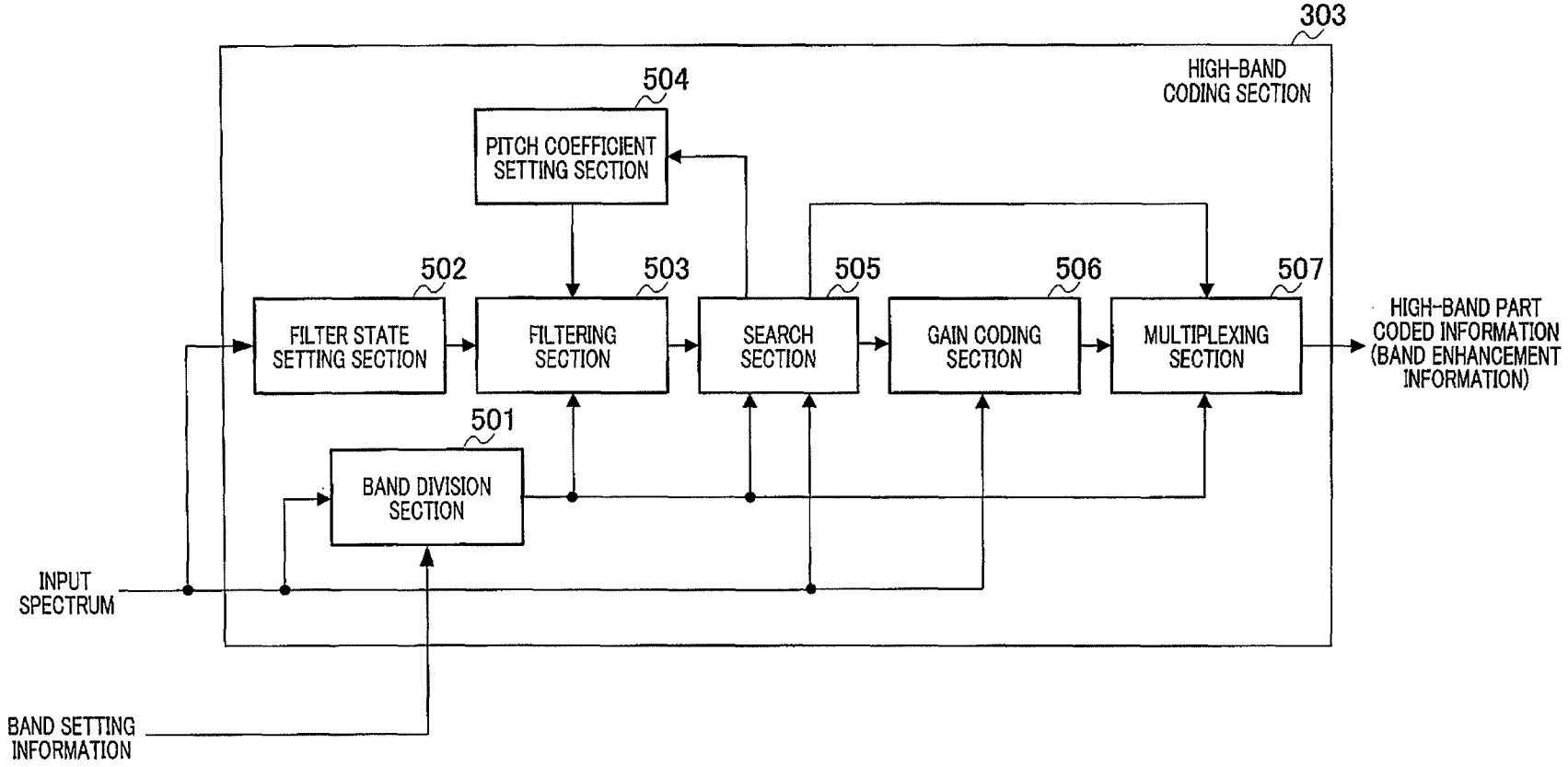
FIG. 5 is a block diagram showing the internal principal-part configuration of the high-band coding section shown in FIG. 3.

FIG. 5 is a block diagram showing the internal configuration of high-band coding section 303. High-band coding section 303 is provided with band division section 501, filter state setting section 502, filtering section 503, search section 505, pitch coefficient setting section 504, gain coding section 506, and multiplexing section 507. These sections perform the following operations.

Input spectrum X(k) is input to band division section 501 from orthogonal transform processing section 201. Also, band setting information Band_Setting is input to band division section 501 from band setting section 301. Band division section 501 divides a high-band part of input spectrum X(k) into P subbands $SB_p$ (p=0, 1, . . . , P−1) according to the band setting information Band_Setting value. Then, band division section 501 outputs bandwidth $BW_p$ (p=0, 1, . . . , P−1) and initial index $BS_p$ (p=0, 1, . . . , P−1) of each subband to filtering section 503, search section 505, and multiplexing section 507 as band division information.

Specifically, if the band setting information Band_Setting value is 0, band division section 501 divides a part for which the band is greater than or equal to Max1 (Max1≤k<Fmax) within input spectrum X(k) into P subbands $SB_p$ (p=0, 1, . . . , P−1). Also, if the band setting information Band_Setting value is 1, band division section 501 divides a part for which the band is greater than or equal to Max2 (Max2≤k<Fmax) within input spectrum X(k) into P subbands $SB_p$ (p=0, 1, . . . , P−1). Here, Fmax is the maximum band value. Also, below, a part in subband $SB_p$ within input spectrum X(k) is denoted as subband spectrum $X_p(k)$ ($BS_p \le k < BS_p + BW_p$).

Filter state setting section 502 sets input spectrum X(k) input from orthogonal transform processing section 201 as a filter state used by filtering section 503. Input spectrum X(k) is stored as a filter internal state (filter state) in an entire frequency band 0≤k<Fmax spectrum S(k) (0≤k<Max1) or (0≤k<Max2) band in filtering section 503. Filter state setting section 502 outputs the set filter state to filtering section 503.

Filtering section 503 is provided with a multi-tap pitch filter (that is, the number of taps is greater than 1). Filtering section 503 calculates input spectrum estimated value S'(k) (FL≤k≤FH) (hereinafter referred to as estimated spectrum) by filtering input spectrum X(k) based on the filter state set by filter state setting section 502 and pitch coefficient T input from pitch coefficient setting section 504. Filtering section 503 outputs estimated spectrum S'(k) to search section 505. Details of the filtering processing performed by filtering section 503 will be given later herein.

Search section 505 calculates similarity of a high-band part ((Max1≤k<Fmax) or (Max2≤k<Fmax)) divided by band division section 501 for input spectrum X(k) input from orthogonal transform processing section 201 and estimated spectrum S'(k) input from filtering section 503. This similarity calculation is performed by means of a correlation computation or the like, for example.

The processing of filtering section 503, search section 505, and pitch coefficient setting section 504 forms a closed loop. In this closed loop, search section 505 calculates similarity corresponding to each pitch coefficient by variously changing pitch coefficient T input to filtering section 503 from pitch coefficient setting section 504. Then, of the calculated similarities, search section 505 outputs the pitch coefficient for which similarity is maximal to multiplexing section 507 as optimum pitch coefficient T'. Also, search section 505 outputs estimated spectrum S'(k) to gain coding section 506.

Under the control of search section 505, pitch coefficient setting section 504 gradually changes pitch coefficient T within the search range (Tmin≤T≤Tmax), and successively outputs post-change pitch coefficient T to filtering section 503.

Gain coding section 506 calculates gain information of a high-band part ((Max1≤k<Fmax) or (Max2≤k<Fmax)) divided by band division section 501 for input spectrum X(k) input from orthogonal transform processing section 201. Specifically, gain coding section 506 divides a high-band part frequency band ((Max1≤k<Fmax) or (Max2≤k<Fmax)) into J samples, and finds the spectral power of each subband of input spectrum X(k). In this case, spectral power B(j) of the j'th subband is expressed by equation 10 below.

(Equation 10)

$$B(j) = \sum_{k=BL_j}^{BH_j} X(k)^2 \quad (j = 0, \ldots, J-1) \qquad [10]$$

In equation 10, $BL_j$ represents the minimum frequency of the j'th subband, and $BM_j$ represents the maximum frequency of the j'th subband. Also, gain coding section 506 similarly calculates spectral power B'(j) of each subband of estimated spectrum S'(k) input from search section 505 in accordance with equation 11 below.

(Equation 11)

$$B'(j) = \sum_{k=BL_j}^{BH_j} S'(k)^2 \quad (j = 0, \ldots, J-1) \qquad [11]$$

Gain coding section 506 then calculates variation V(j) of each subband for input spectrum X(k) in accordance with equation 12 below.

(Equation 12)

$$V(j) = \sqrt{\frac{B(j)}{B'(j)}} \quad (j = 0, \ldots, J-1) \qquad [12]$$

Then, using an internal gain encoding codebook, gain coding section 506 encodes variation V(j), and outputs an index corresponding to post-coding variation $V_q(j)$ to multiplexing section 507.

Multiplexing section 507 multiplexes optimum pitch coefficient T' input from search section 505 and an index of variation V(j) input from gain coding section 506 as high-band part coded information, and outputs the multiplexed information to multiplexing section 304. Optimum pitch coefficient T' and a variation V(j) index may also be directly input to multiplexing section 304, and multiplexed with low-band part coded information by multiplexing section 304.

Figure 6:
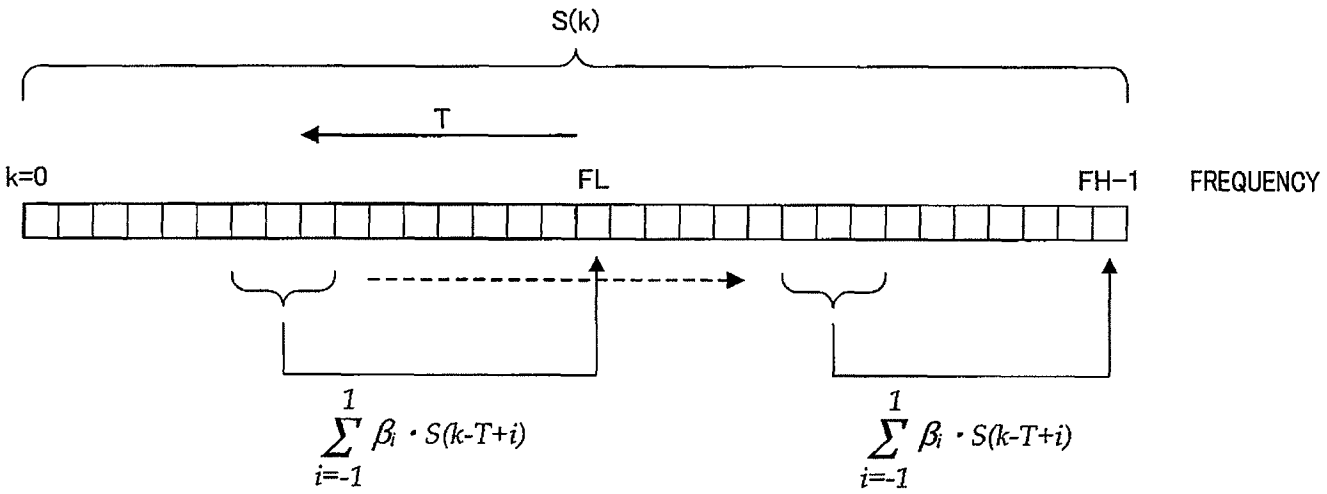
FIG. 6 is a drawing for explaining details of filtering processing by the filtering section shown in FIG. 5.

Details of the filtering processing performed by filtering section 503 will now be described with reference to FIG. 6.

Filtering section 503 generates spectrum S(k) of a ((Max1≤k<Fmax) or (Max2≤k<Fmax)) band using pitch coefficient T input from pitch coefficient setting section 504 according to band division by band division section 501. Filtering section 503 transfer function F(z) is expressed by equation 13 below.

(Equation 13)

$$F(z) = \frac{1}{1 - \sum_{i=-M}^{M} \beta_i z^{-T+i}} \quad [13]$$

In equation 13, T represents a pitch coefficient provided by pitch coefficient setting section 504, and $\beta_i$ represents a filter coefficient stored internally beforehand. Also, in equation 13, M is an indicator relating to the number of taps, with M=1 being set, for example, when the number of taps is 3. When the number of taps is 3, $(\beta_{-1}, \beta_0, \beta_1)=(0.1, 0.8, 0.1)$ may be given as an example of filter coefficient candidates. Other values, such as $(\beta_{-1}, \beta_0, \beta_1)=(0.2, 0.6, 0.2)$, $(0.3, 0.4, 0.3)$, are also applicable.

First, input spectrum X(k) is stored as a filter internal state (filter state) in a (0≤k<Max1) or (0≤k<Max2) band of spectrum S(k) of the entire frequency band in filtering section 503.

Also, estimated spectrum S'(k) is stored in a spectrum S(k) high-band part ((Max1≤k<Fmax) or (Max2≤k<Fmax)) by means of the following filtering processing procedure. In estimated spectrum S'(k), spectrum S(k−T) of a frequency that is T lower than this k is basically assigned to estimated spectrum S'(k). Actually, however, in order to increase spectrum smoothness, spectrum $\beta_i \cdot S(k-T+i)$ obtained by multiplying nearby spectrum S(k−T+i) demultiplexed by i from spectrum S(k−T) by predetermined filter coefficient $\beta_i$ is added for all i's and the obtained spectrum is assigned to S'(k). This processing is expressed by equation 14 below.

(Equation 14)

$$S'(k) \sum_{i=-1}^{1} \beta_i \cdot S(k - T + i)^2 \quad [14]$$

Filtering section 503 calculates estimated spectrum S'(k) in a high-band part frequency band ((Max1≤k<Fmax) or (Max2≤k<Fmax)) by performing the above computation while changing k in the band Max1≤k<Fmax or band Max2≤k<Fmax range in order from low-frequency k=Max1 or k=Max2.

The above filtering processing is performed after zeroizing spectrum S(k) in the high-band part frequency band ((Max1≤k<Fmax) or (Max2≤k<Fmax)) range each time pitch coefficient T is provided from pitch coefficient setting section 504. That is to say, each time pitch coefficient T changes, spectrum S(k) is calculated and is output to search section 505.

Figure 7:
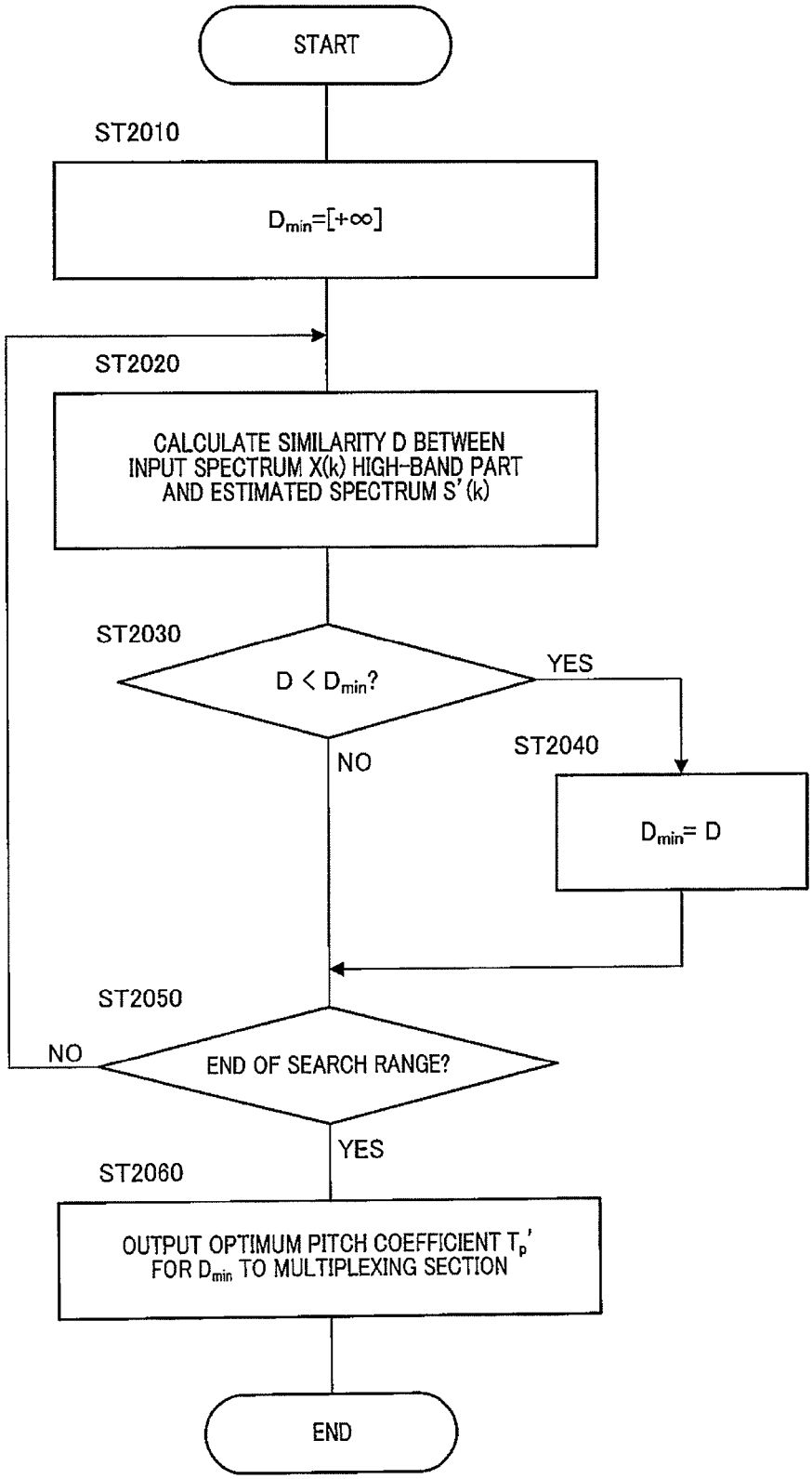
FIG. 7 is a flowchart showing the processing procedure for finding optimal pitch coefficient $T_p'$ for subband $SB_p$ in the search section shown in FIG. 5.

FIG. 7 is a flowchart showing the processing procedure for finding optimal pitch coefficient $T_p'$ for subband $SB_p$ in search section 505. By repeating the procedure shown in FIG. 7, search section 505 finds optimal pitch coefficient $T_p'$ (p=0, 1, . . . , P−1) corresponding to each subband $SB_p$ (p=0, 1, . . . , P−1).

First, search section 505 initializes minimum similarity $D_{min}$, which is a variable for saving a minimum similarity value, to "+∞" (ST2010). Then search section 505 calculates similarity D between an input spectrum X(k) high-band part ((Max1≤k<Fmax) or (Max2≤k<Fmax)) and estimated spectrum S'(k) for a certain pitch coefficient in accordance with equation 15 below (ST2020).

(Equation 15)

$$D = \sum_{k=0}^{M'} X(BS_p + k) \cdot X(BS_p + k) - \frac{\left(\sum_{k=0}^{M'} X(BS_p + k) \cdot S'(BS_p + k)\right)^2}{\sum_{k=0}^{M'} S'(BS_p + k) \cdot S'(BS_p + k)} (0 < M' \le BW_p) \quad [15]$$

In equation 15, M' indicates the number of samples when calculating similarity D, and may be any value less than or equal to the bandwidth of each subband.

Next, search section 505 determines whether or not calculated similarity D is smaller than minimum similarity $D_{min}$, (ST2030). If similarity D calculated in ST2020 is smaller than minimum similarity $D_{min}$ (ST2030: "YES"), search section 505 assigns similarity D to minimum similarity $D_{min}$ (ST2040). On the other hand, if similarity D calculated in ST2020 is greater than or equal to minimum similarity (ST2030: "NO"), search section 505 determines whether or not the search range has ended (ST2050). That is to say, search section 505 determines whether or not similarity D has been calculated in accordance with equation 15 above in ST2020 for all pitch coefficients within the search range. If the search range has not ended (ST2050: "NO"), search section 505 returns to ST2020 again. Then search section 505 calculates similarity D in accordance with equation 15 for a different pitch coefficient from that when similarity D was calculated in accordance with equation 15 in the previous ST2020 procedure. On the other hand, if the search range has ended (ST2050: "YES"), search section 505 outputs pitch coefficient T corresponding to minimum similarity $D_{min}$ to multiplexing section 507 as optimum pitch coefficient $T_p'$ (ST2060).

This concludes a description of the processing performed by high-band coding section 303.

This concludes a description of the configuration of encoding apparatus 101.

Decoding apparatus 103 shown in FIG. 1 will now be described.

Figure 8:
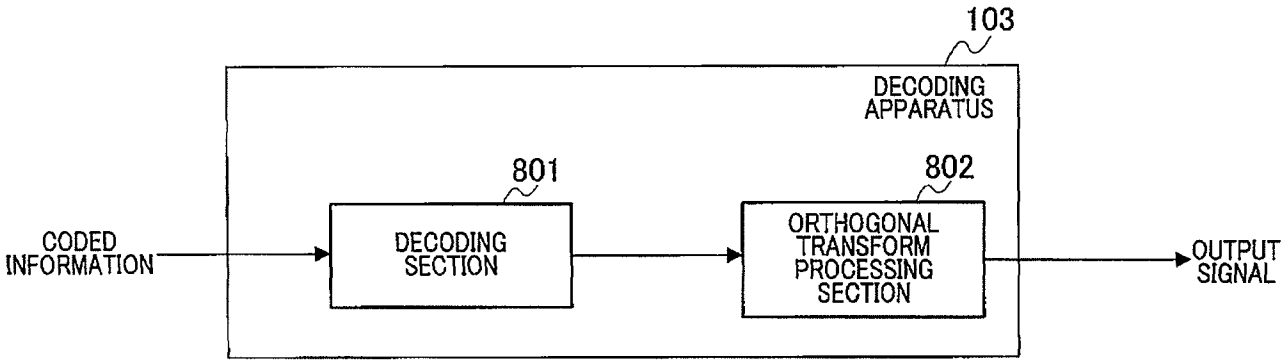
FIG. 8 is a block diagram showing the internal principal-part configuration of the decoding apparatus shown in FIG. 1.

FIG. 8 is a block diagram showing the internal principal-part configuration of decoding apparatus 103. Decoding apparatus 103 mainly comprises decoding section 801 and orthogonal transform processing section 802. These sections perform the following operations.

Coded information transmitted from encoding apparatus 101 via channel 102 is input to decoding section 801. Decoding section 801 decodes the input coded information, and outputs spectral data obtained by decoding (a decoded spectrum) to orthogonal transform processing section 802. Details of the processing performed by decoding section 801 will be given later herein.

The spectral data (decoded spectrum) is input to orthogonal transform processing section 802 from decoding section 801. Orthogonal transform processing section 802 executes an orthogonal transform on the spectral data (decoded spectrum), and converts it to a time-domain signal. Orthogonal transform processing section 802 outputs the obtained signal as an output signal. Details of the processing performed by orthogonal transform processing section 802 will be given later herein.

Figure 9:
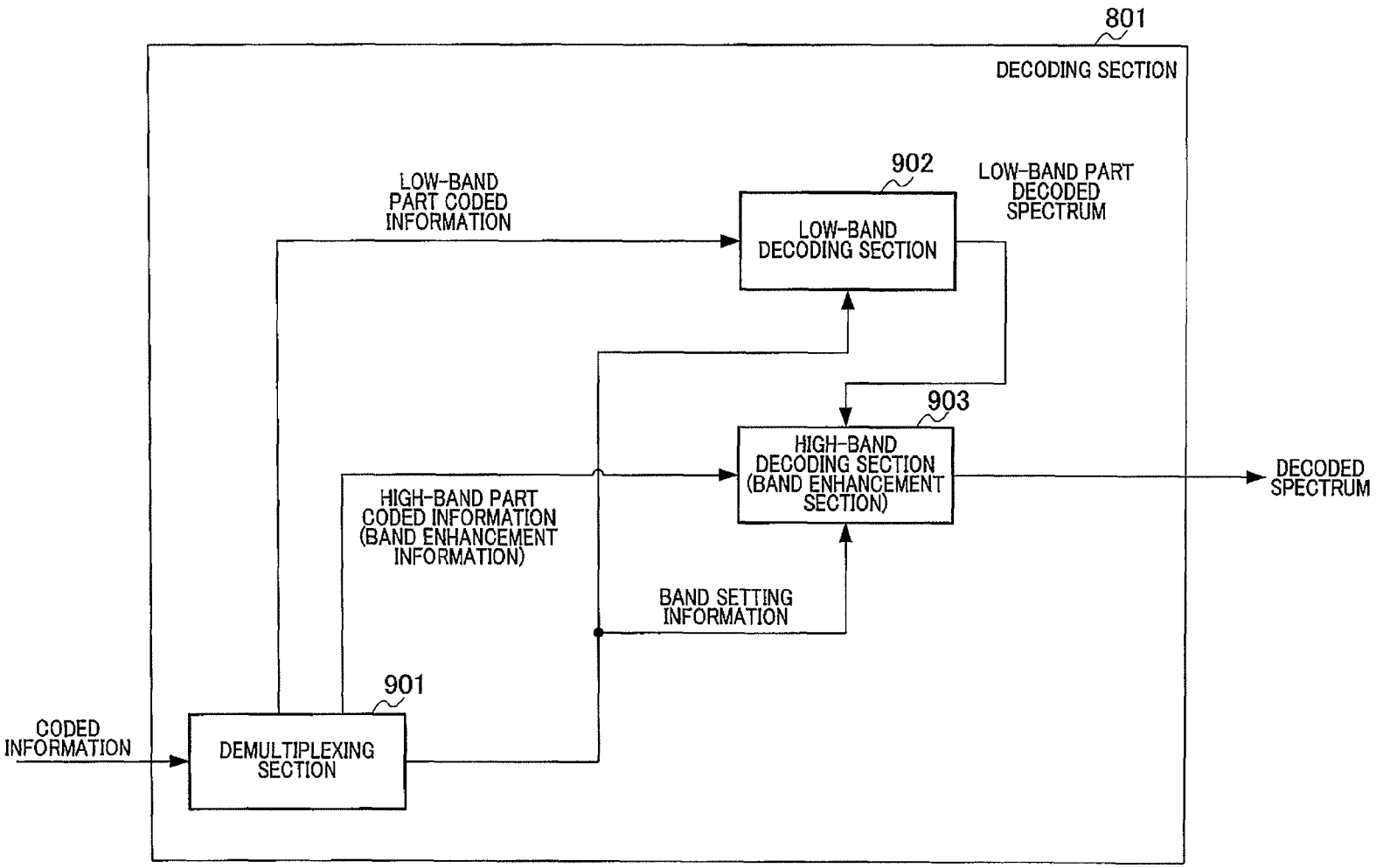
FIG. 9 is a block diagram showing the internal principal-part configuration of the decoding section shown in FIG. 8.

FIG. 9 is a block diagram showing the internal configuration of decoding section 801 shown in FIG. 8. Decoding section 801 mainly comprises demultiplexing section 901, low-band decoding section 902, and high-band decoding section (band enhancement section) 903.

Coded information transmitted from encoding apparatus 101 via channel 102 is input to demultiplexing section 901. Demultiplexing section 901 demultiplexes the coded information into low-band part coded information, high-band part coded information, and band setting information. Then demultiplexing section 901 outputs the low-band part coded information to low-band decoding section 902, outputs the high-band part coded information (band enhancement information) to high-band decoding section 903, and outputs the band setting information to low-band decoding section 902 and high-band decoding section 903.

Low-band part coded information and band setting information are input to low-band decoding section 902 from demultiplexing section 901. Low-band decoding section 902 generates a low-band part decoded spectrum from the input low-band part coded information and band setting information, and outputs the generated low-band part decoded spectrum to high-band decoding section 903. Details of the processing performed by low-band decoding section 902 will be given later herein.

High-band part coded information and band setting information are input to high-band decoding section 903 from demultiplexing section 901. Also, a low-band part decoded spectrum is input to high-band decoding section 903 from low-band decoding section 902. High-band decoding section 903 generates a decoded spectrum from the input low-band part decoded spectrum, high-band part coded information, and band setting information, and outputs the generated decoded spectrum to orthogonal transform processing section 802. Details of the processing performed by high-band decoding section 903 will be given later herein.

Figure 10:
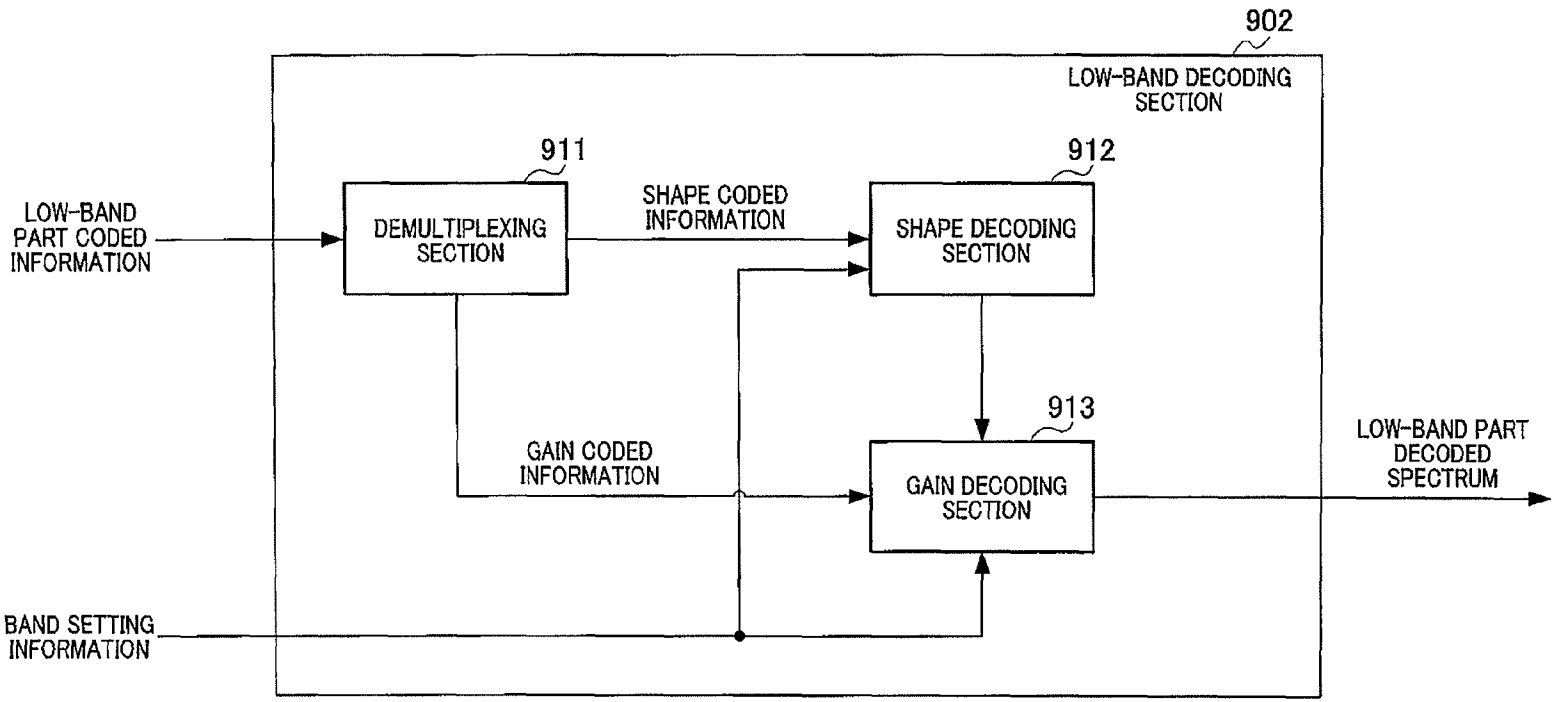
FIG. 10 is a block diagram showing the internal principal-part configuration of the low-band decoding section shown in FIG. 9.

FIG. 10 is a block diagram showing the internal configuration of low-band decoding section 902. Low-band decoding section 902 mainly comprises demultiplexing section 911, shape decoding section 912, and gain decoding section 913. These sections perform the following operations.

Demultiplexing section 911 demultiplexes low-band part coded information input from demultiplexing section 901 into shape coded information S_max and gain coded information G_min, and outputs post-demultiplexing shape coded information S_max to shape decoding section 912, and outputs gain coded information G_min to gain decoding section 913. Provision may also be made for shape coded information and gain coded information to be demultiplexed from coded information directly by demultiplexing section 901.

Shape decoding section 912 incorporates a shape codebook of the same kind as the shape codebook with which shape coding section 402 of low-band coding section 302 is provided, and searches the shape codebook with shape coded information S_max input from demultiplexing section 911 as an index. Shape decoding section 912 outputs a found shape code vector to gain decoding section 913 as a shape value of an coding target band spectrum indicated by band setting information Band_Setting input from demultiplexing section 901. Here, a shape code vector found as a shape value is denoted as Shape_q'(k).

Gain decoding section 913 incorporates a gain codebook of the same kind as the gain codebook with which gain coding section 403 of low-band coding section 302 is provided, and uses this gain codebook to perform inverse quantization of a gain value from gain coded information in accordance with equation 16 below. Here too, a gain value is treated as an L-dimensional vector, and vector inverse quantization is performed. That is to say, gain code vector $GC_j^{G_min}$ corresponding to gain coded information G_min is taken directly as gain value Gain_q'(j).

[16]

$$\text{Gain_}q'(j)=GC_j^{G_min}(j=0,\ldots,L-1) \quad \text{(Equation 16)}$$

Then, using a gain value obtained by inverse quantization and a shape value input from shape decoding section 912, gain decoding section 913 calculates low-band part decoded spectrum S1(*k*) in accordance with equation 17 below, and outputs calculated low-band part decoded spectrum S1(*k*) to high-band decoding section 903. In spectrum (MDCT coefficient) inverse quantization, if k is present in B(j") through B(j"+1)−1, gain value Gain_q'(j) has the value of Gain_q'(j").

(Equation 17)

$$S1(k)=\text{Gain_q}'(j)\cdot\text{Shape_q}'(k)\begin{pmatrix} k=BL_j,\ \ldots\ ,BH_j \\ j=0,\ \ldots\ ,L-1 \end{pmatrix} \quad [17]$$

Figure 11:
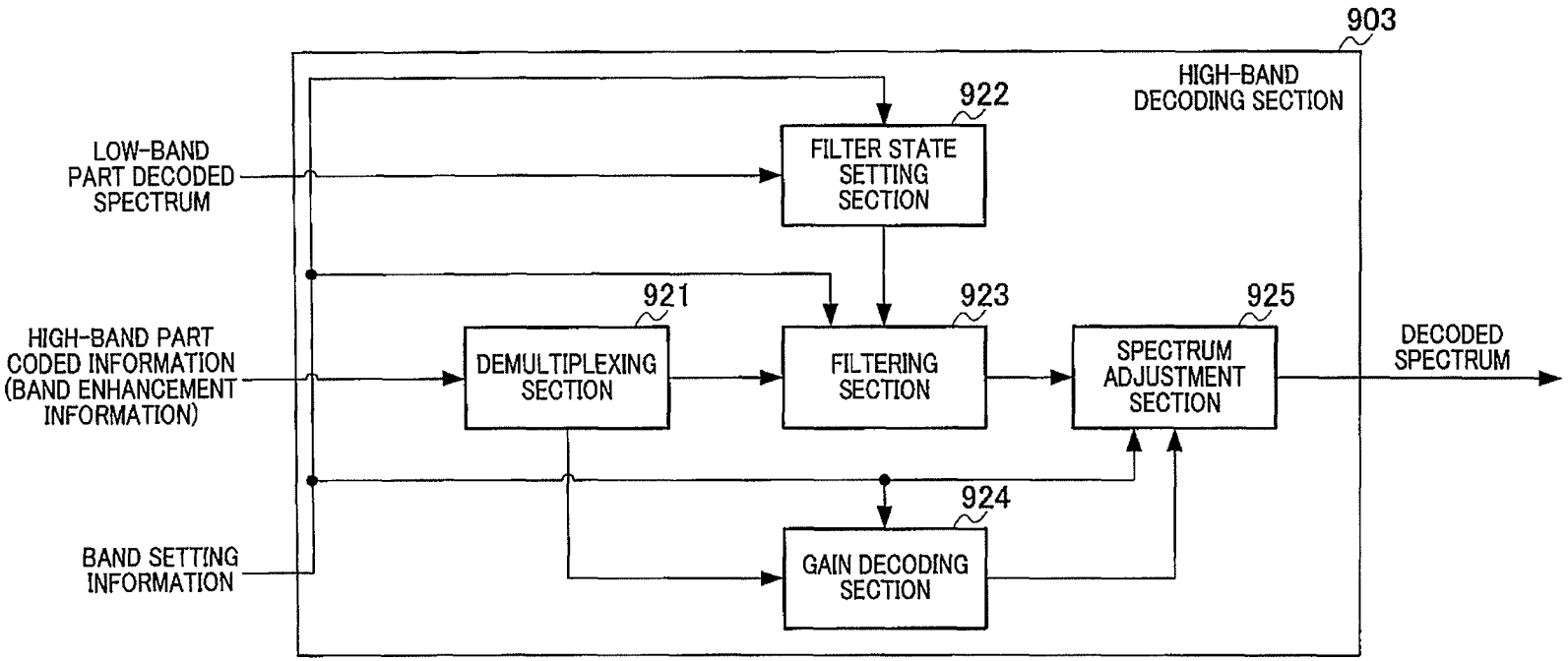
FIG. 11 is a block diagram showing the internal principal-part configuration of the high-band decoding section shown in FIG. 9.

FIG. 11 is a block diagram showing the internal configuration of high-band decoding section 903. High-band decoding section 903 mainly comprises demultiplexing section 921, filter state setting section 922, filtering section 923, gain decoding section 924, and spectrum adjustment section 925. These sections perform the following operations.

Demultiplexing section 921 demultiplexes high-band part coded information input from demultiplexing section 901 into optimum pitch coefficient T', which is filtering related information, and a post-coding variation $V_q$(j) index, which is gain related information. Then demultiplexing section 921 outputs optimum pitch coefficient T' to filtering section 923, and outputs the post-coding variation $V_q$(j) index to gain decoding section 924. If demultiplexing into optimum pitch coefficient T' and a post-coding variation $V_q$(j) index has been performed in demultiplexing section 901, demultiplexing section 921 need not be provided.

Based on band setting information Band_Setting input from demultiplexing section 901, filter state setting section 922 sets low-band part decoded spectrum S1(*k*) input from low-band decoding section 902 as a filter state used by filtering section 923. Here, if an entire frequency band 0≤k<Fmax spectrum in filtering section 923 is called S(k) for convenience, of spectrum S(k), low-band part decoded spectrum S1(*k*) is stored in a low-band part ((0≤k<Max1) or (0≤k<Max2)) band indicated by band setting information Band_Setting as a filter internal state (filter state). The configuration and operation of filter state setting section 922 are similar to those of filter state setting section 502 shown in FIG. 5, and therefore a detailed description thereof is omitted here.

Filtering section 923 is provided with a multi-tap pitch filter (that is, the number of taps is greater than 1). Filtering section 923 filters low-band part decoded spectrum S1(*k*) based on a filter state set by filter state setting section 922, pitch coefficient T' input from demultiplexing section 921, a filter coefficient stored internally beforehand, and band setting information Band_Setting input from demultiplexing section 901. Then filtering section 923 calculates estimated spectrum S'(k) of input spectrum S(k) as shown in equation 18 below.

(Equation 18)

$$S'(k) = \sum_{i=-1}^{1} \beta_i \cdot S1(k - T + i)^2 \quad [18]$$

The transfer function shown in equation 13 above is also used by filtering section 923. Filtering section 923 outputs estimated spectrum S'(k) obtained by filtering to spectrum adjustment section 925.

Gain decoding section 924 decodes a post-coding variation $V_q(j)$ index input from demultiplexing section 921 based on band setting information Band_Setting input from demultiplexing section 901, and finds post-coding variation $V_q(j)$, which is a variation V(j) quantization value. Here, the gain codebook used for post-coding variation $V_q(j)$ index decoding is incorporated in gain decoding section 924, and is similar to the gain codebook used by gain coding section 506 shown in FIG. 5. Gain decoding section 924 outputs post-coding variation $V_q(j)$ obtained by decoding to spectrum adjustment section 925.

Spectrum adjustment section 925 multiplies estimated spectrum S'(k) input from filtering section 923 by post-coding variation $V_q(j)$ of each subband input from gain decoding section 924 for a high-band part specified by band setting information Band_Setting input from demultiplexing section 901 in accordance with equation 19 below. By this means, spectrum adjustment section 925 adjusts the spectrum shape in a high-band part ((Max1≤k<Fmax) or (Max2≤k<Fmax)) of estimated spectrum S'(k), generates decoded spectrum S2(*k*), and outputs this to orthogonal transform processing section 802.

(Equation 19)

$$S2(k) = S'(k) \cdot V_q(j) \quad [19]$$
$$\left( \begin{array}{l} \mathrm{Max1} \le k < F\mathrm{max} \quad \text{or } \mathrm{Max2} \le k < F\mathrm{max} \\ j = 0, \ldots, J-1 \end{array} \right)$$

In equation 19, j indicates a subband index when gain is encoded, and is set according to spectrum index k. That is to say, for spectrum index k included in a subband for which the subband index is j", estimated spectrum S'(k) is multiplied by $V_q(j")$.

Here, a low-band part ((0≤k<Max1) or (0≤k<Max2)) of decoded spectrum S2(*k*) comprises first layer decoded spectrum S1(*k*), and a high-band part ((Max1≤k<Fmax) or (Max2≤k<Fmax)) of decoded spectrum S2(*k*) comprises post-spectrum-shape-adjustment estimated spectrum S'(k).

The actual processing performed by orthogonal transform processing section 802 will now be described.

Orthogonal transform processing section 802 has internal buffers buf2(*k*), which are initialized as shown in equation 20 below.

[20]

$$\mathrm{buf2}(k)=0(k=0,\ldots,N-1) \quad \text{(Equation 20)}$$

Also, orthogonal transform processing section 802 finds decoded signal $y_n$ in accordance with equation 21 below using decoded spectrum S2(*k*) input from spectrum adjustment section 925, and outputs decoded signal $y_n$.

(Equation 21)

$$y_n = \frac{2}{N} \sum_{n=0}^{2N-1} Z(k) \cos\left[\frac{(2n+1+N)(2k+1)\pi}{4N}\right] \quad [21]$$
$$(n = 0, \ldots, N-1)$$

In equation 21, Z(k) is a vector that links decoded spectrum S2(*k*) and buffer buf2(*k*) as shown in equation 22 below.

(Equation 22)

$$Z(k) = \begin{cases} buf2(k) & (k = 0, \ldots N-1) \\ S2(k) & (k = N, \ldots 2N-1) \end{cases} \quad [22]$$

Next, orthogonal transform processing section 802 updates buffer buf2(*k*) in accordance with equation 23 below.

[23]

$$\mathrm{buf2}(k)=S2(k)(k=0,\ldots,N-1) \quad \text{(Equation 23)}$$

Orthogonal transform processing section 802 then outputs decoded signal $y_n$ as an output signal.

This concludes a description of the internal configuration of decoding apparatus 103.

Thus, according to this embodiment, in a coding/decoding method that performs band enhancement using a low-band part spectrum and generates/estimates a high-band part spectrum, an encoding apparatus/decoding apparatus decides band setting—that is, which bands a low-band part and high-band part are—adaptively according to an input signal characteristic. By this means, high-band part spectral data such as a wideband signal or an ultrawideband signal can be encoded efficiently, and the quality of a decoded signal can be improved.

Specifically, band setting section 301 compares low-band part energy and high-band part energy of input signal spectral data, and if the low-band part energy is significantly greater than the high-band part energy, sets a narrower low-band part and a wider high-band part. By this means, low-band part spectral data that greatly influences the quality of a decoded signal when an input signal is speech can be encoded intensively by means of a shape-gain coding method, and the quality of a decoded signal can be increased. On the other hand, if low-band part energy is not that much greater than high-band part energy, band setting section 301 sets a wider low-band part and a narrower high-band part. By this means, encoding distortion can be reduced with a shape-gain coding method up to a higher band part, and bandwidth limitation that greatly influences the quality of a decoded signal when an input signal is audio can be improved.

In this embodiment, a configuration has been described whereby division into different subband configurations is performed by band division section 501 and gain coding section 506 in high-band coding section 303, but the present invention is not limited to this, and can also be applied in a similar way to a configuration whereby division is performed into identical subband configurations.

In this embodiment, a configuration has been described whereby a high-band part spectrum is divided into P parts by band division section 501 in high-band coding section 303 irrespective of the value of band setting information Band_Setting. However, the present invention is not limited to this, and can also be applied in a similar way to a configuration whereby a subband is divided into different numbers according to the value of band setting information Band_Setting. For example, when band setting information Band_Setting is 0, a high-band part spectrum bandwidth is wider than when band setting information Band_Setting is 1, and therefore in this case division is performed into a number greater than P. By this means, it is possible to prevent degradation of coding performance due to a subband width being too great.

Also, in this embodiment, a configuration has been described whereby an input spectrum low-band part is set as a filter state in high-band coding section 303, and a search is performed for a spectrum position that is similar to an input spectrum high-band part. However, the present invention is not limited to this, and can also be applied in a similar way to a configuration whereby a search is performed for a spectrum position that is similar to an input spectrum high-band part for a low-band part decoded spectrum obtained by decoding low-band part coded information output from a low-band coding section. When the above configuration is employed, a low-band part decoded spectrum obtained on the decoding apparatus side can also be used, enabling operation on the decoding apparatus side to be ensured.

Also, when the above configuration is employed, it is necessary for a low-band part decoding section that performs local decoding for calculating a low-band part decoded spectrum to be newly provided in coding section 202, and for a low-band part decoded spectrum to be output from the low-band decoding section to high-band coding section 303.

Embodiment 2

Embodiment 2 describes a configuration in which a first layer coding section that encodes a low-band part of spectral data is newly provided, and the coding method described in Embodiment 1 is applied to difference data between input signal spectral data and a first layer coding section coding result. Below, a coding layer in which the coding method described in Embodiment 1 is applied is described as a second layer coding section.

A communication system according to Embodiment 2 (not shown) is basically similar to the communication system shown in FIG. 1, and differs from encoding apparatus 101 and decoding apparatus 103 of the communication system in FIG. 1 only in parts of the configuration and operation of the encoding apparatus and decoding apparatus. In the following description, reference codes "111" and "113" are assigned respectively to an encoding apparatus and decoding apparatus of a communication system according to this embodiment.

Figure 12:
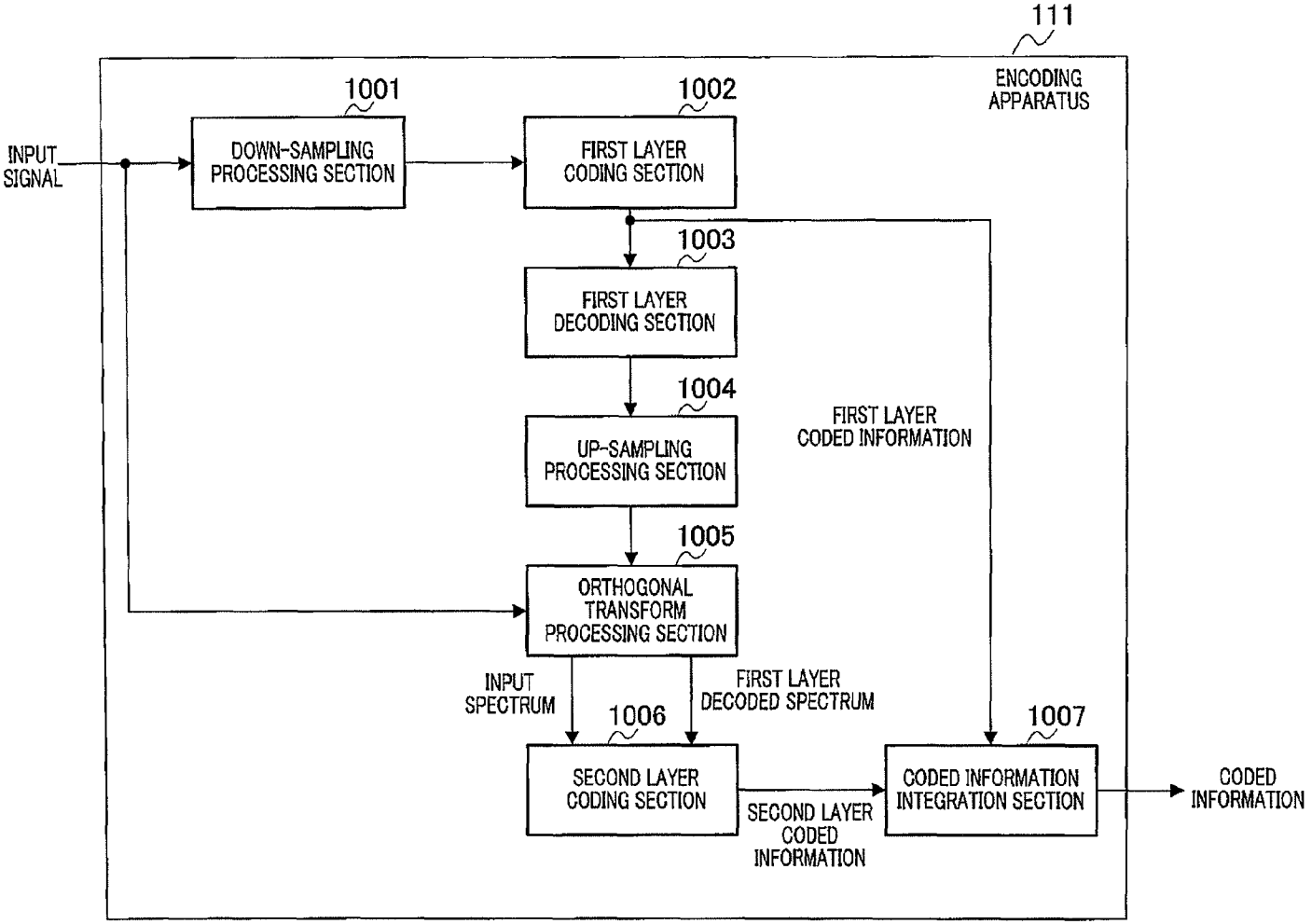
FIG. 12 is a block diagram showing the internal principal-part configuration of an encoding apparatus according to Embodiment 2 of the present invention.

FIG. 12 is a block diagram showing the internal principal-part configuration of encoding apparatus 111 according to this embodiment. Encoding apparatus 111 according to this embodiment mainly comprises down-sampling processing section 1001, first layer coding section 1002, first layer decoding section 1003, up-sampling processing section 1004, orthogonal transform processing section 1005, second layer coding section 1006, and coded information integration section 1007. These sections perform the following operations.

If the sampling frequency of input signal $x_n$ is designated $SR_{input}$, down-sampling processing section 1001 performs down-sampling of input signal sampling frequency from $SR_{Input}$ to $SR_{base}$ (where $SR_{base}<SR_{input}$), and outputs a down-sampled input signal to first layer coding section 1002 as a post-down-sampling input signal.

First layer coding section 1002 performs encoding on a post-down-sampling input signal input from down-sampling processing section 1001 using, for example, a CELP (Code Excited Linear Prediction) type speech coding method, and generates first layer coded information. Then first layer coding section 1002 outputs the generated first layer coded information to first layer decoding section 1003 and coded information integration section 1007.

First layer decoding section 1003 performs decoding on first layer coded information input from first layer coding section 1002 using, for example, a CELP speech decoding method, and generates a first layer decoded signal. Then first layer decoding section 1003 outputs the generated first layer decoded signal to up-sampling processing section 1004.

Up-sampling processing section 1004 performs up-sampling of the sampling frequency of a first layer decoded signal input from first layer decoding section 1003 from $SR_{base}$ to $SR_{input}$. Then up-sampling processing section 1004 outputs an up-sampled first layer decoded signal to orthogonal transform processing section 1005 as post-up-sampling first layer decoded signal $\mathbf{c1}_n$.

Orthogonal transform processing section 1005 has internal buffers $\mathrm{buf}\mathbf{1}_n$ and $\mathrm{buf}\mathbf{2}_n$ (n=0, . . . , N−1). Orthogonal transform processing section 1005 performs a Modified Discrete Cosine Transform (MDCT) on input signal $x_n$ and post-up-sampling first layer decoded signal $\mathbf{c1}_n$ input from up-sampling processing section 1004. Orthogonal transform processing section 1005 performs orthogonal transform processing of input signal $x_n$ and post-up-sampling first layer decoded signal $\mathbf{c1}_n$, and calculates input spectrum X(k) and first layer decoded spectrum C(k). The processing performed by orthogonal transform processing section 1005 is similar to the processing described in Embodiment 1, and therefore a description thereof is omitted here. Orthogonal transform processing section 1005 outputs obtained input spectrum X(k) and first layer decoded spectrum C(k) to second layer coding section 1006.

Second layer coding section 1006 generates second layer coded information using input spectrum X(k) and first layer decoded spectrum C(k) input from orthogonal transform processing section 1005, and outputs the generated second layer coded information to coded information integration section 1007. Details of second layer coding section 1006 will be given later herein.

Coded information integration section 1007 integrates first layer coded information input from first layer coding section 1002 and second layer coded information input from second layer coding section 1006. Then coded information integration section 1007 adds a transmission error code or the like to the integrated information source code if necessary, and then outputs this to channel 102 as coded information.

Figure 13:
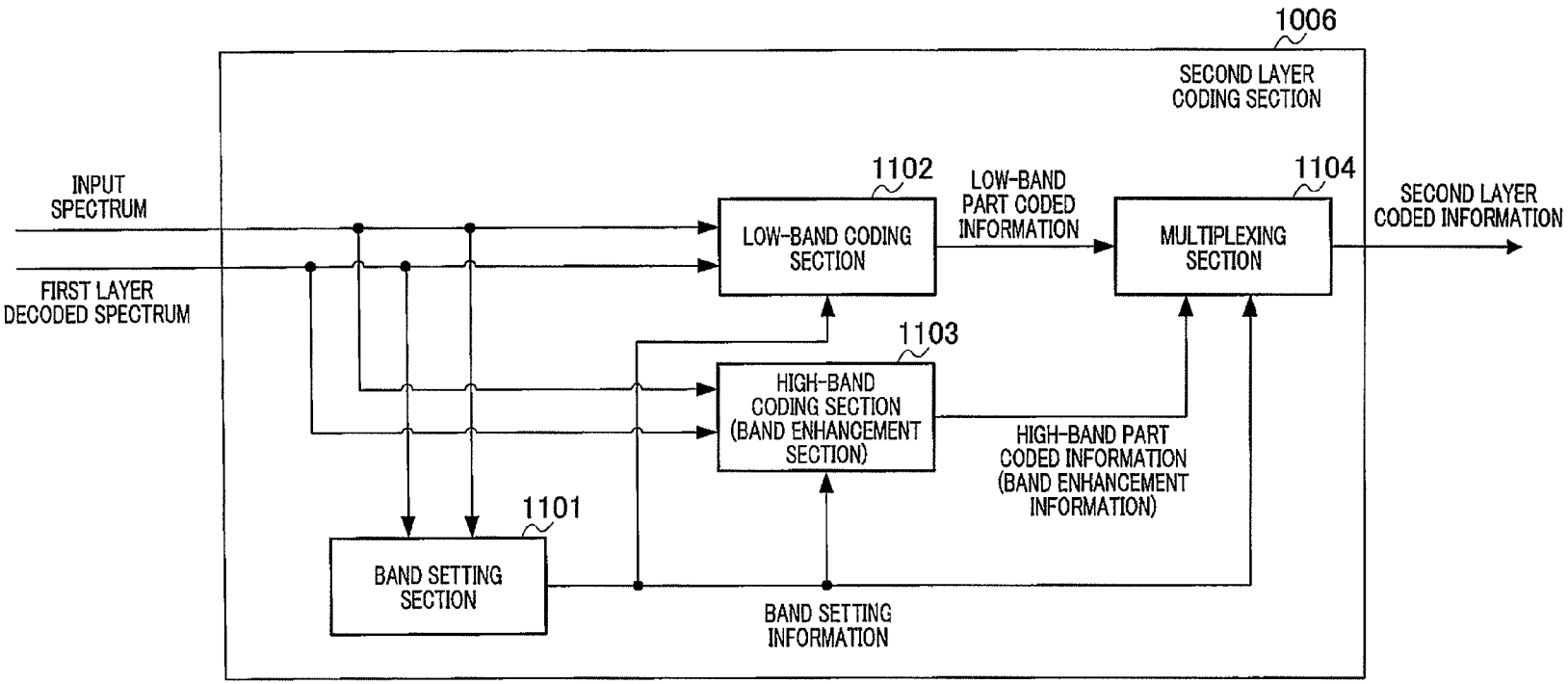
FIG. 13 is a block diagram showing the internal principal-part configuration of the second layer coding section shown in FIG. 12.

The internal principal-part configuration of second layer coding section 1006 shown in FIG. 12 will now be described with reference to FIG. 13.

Second layer coding section 1006 mainly comprises band setting section 1101, low-band coding section 1102, high-band coding section (band enhancement section) 1103, and multiplexing section 1104.

Input spectrum X(k) and first layer decoded spectrum C(k) are input to band setting section 1101 from orthogonal transform processing section 1005. Band setting section 1101 analyzes the spectral characteristics of input spectrum X(k) and first layer decoded spectrum C(k), and sets bands subject to coding by low-band coding section 1102 and high-band coding section (band enhancement section) 1103 respectively according to the analysis results. Then band setting section 1101 outputs this information as band setting information to low-band coding section 1102, high-band coding section 1103, and multiplexing section 1104.

The band setting information calculation method used by band setting section 1101 will now be described.

Band setting section 1101 first calculates difference spectrum $C_{sub}(k)$ between input spectrum X(k) and first layer decoded spectrum C(k) by means of equation 24. In equation 24, Fmax is the maximum band value (maximum frequency value).

[24]

$$C_{sub}(k)=X(k)-S1(k)(k=0,\ldots,Fmax) \quad \text{(Equation 24)}$$

Then band setting section 1101 calculates, for difference spectrum $C_{sub}(k)$, energy (low-band energy) $E_{Low}$ of a part for which the band is less than or equal to $TH_{Low}$ in accordance with equation 25-1, and energy (high-band energy) $E_{High}$ of a part for which the band is greater than or equal to $TH_{High}$ in accordance with equation 25-2, where $TH_{Low}$ and $TH_{High}$ are predetermined threshold values, and $TH_{Low}<TH_{High}$.

(Equation 25-1)

$$E_{Low}=\sum_{k=0}^{TH_{Low}} C_{sub}(k)^2 \quad [25]$$

(Equation 25-2)

$$E_{High}=\sum_{k=TH_{High}}^{Fmax} C_{sub}(k)^2$$

Next, band setting section 1101 compares the magnitude of low-band energy $E_{Low}$ and the magnitude of high-band energy $E_{High}$ calculated by means of equations 25, and decides band setting information Band_Setting in accordance with equation 26. Here, γ in equation 26 is a predetermined constant.

(Equation 26)

$$\text{Band_Setting}=\begin{cases}0 & (\text{if } E_{Low}\geq\gamma\cdot E_{High})\\ 1 & (\text{else})\end{cases} \quad [26]$$

That is to say, band setting section 1101 sets the band setting information Band_Setting value to 0 if low-band energy $E_{Low}$ is somewhat greater than high-band energy $E_{High}$, and sets the band setting information Band_Setting value to 1 otherwise. Band setting section 1101 outputs decided band setting information Band_Setting to low-band coding section 1102, high-band coding section 1103, and multiplexing section 1104.

Input spectrum X(k) and first layer decoded spectrum C(k) are input to low-band coding section 1102 from orthogonal transform processing section 1005. Also, band setting information Band_Setting is input to low-band coding section 1102 from band setting section 1101. Based on band setting information Band_Setting, low-band coding section 1102 encodes difference spectrum $C_{sub}(k)$ between input spectrum X(k) and first layer decoded spectrum C(k), and generates low-band part coded information. Then low-band coding section 1102 outputs the low-band part coded information to multiplexing section 1104. Details of the processing performed by low-band coding section 1102 will be given later herein.

Input spectrum X(k) and first layer decoded spectrum C(k) are input to high-band coding section 1103 from orthogonal transform processing section 1005. Also, band setting information Band_Setting is input to high-band coding section 1103 from band setting section 1101. Based on band setting information Band_Setting, high-band coding section 1103 encodes input spectrum X(k) and generates high-band part coded information (band enhancement information). Then, high-band coding section 1103 outputs the high-band part coded information to multiplexing section 1104. Details of the processing performed by high-band coding section 1103 will be given later herein.

Multiplexing section 1104 multiplexes band setting information Band_Setting, low-band part coded information, and high-band part coded information input from band setting section 1101, low-band coding section 1102, and high-band coding section 1103 respectively, and generates second layer coded information. Then multiplexing section 1104 outputs the obtained second layer coded information to coded information integration section 1007. Band setting information, low-band part coded information, and high-band part coded information may also be input directly to coded information integration section 1007, and multiplexed by coded information integration section 1007.

Figure 14:
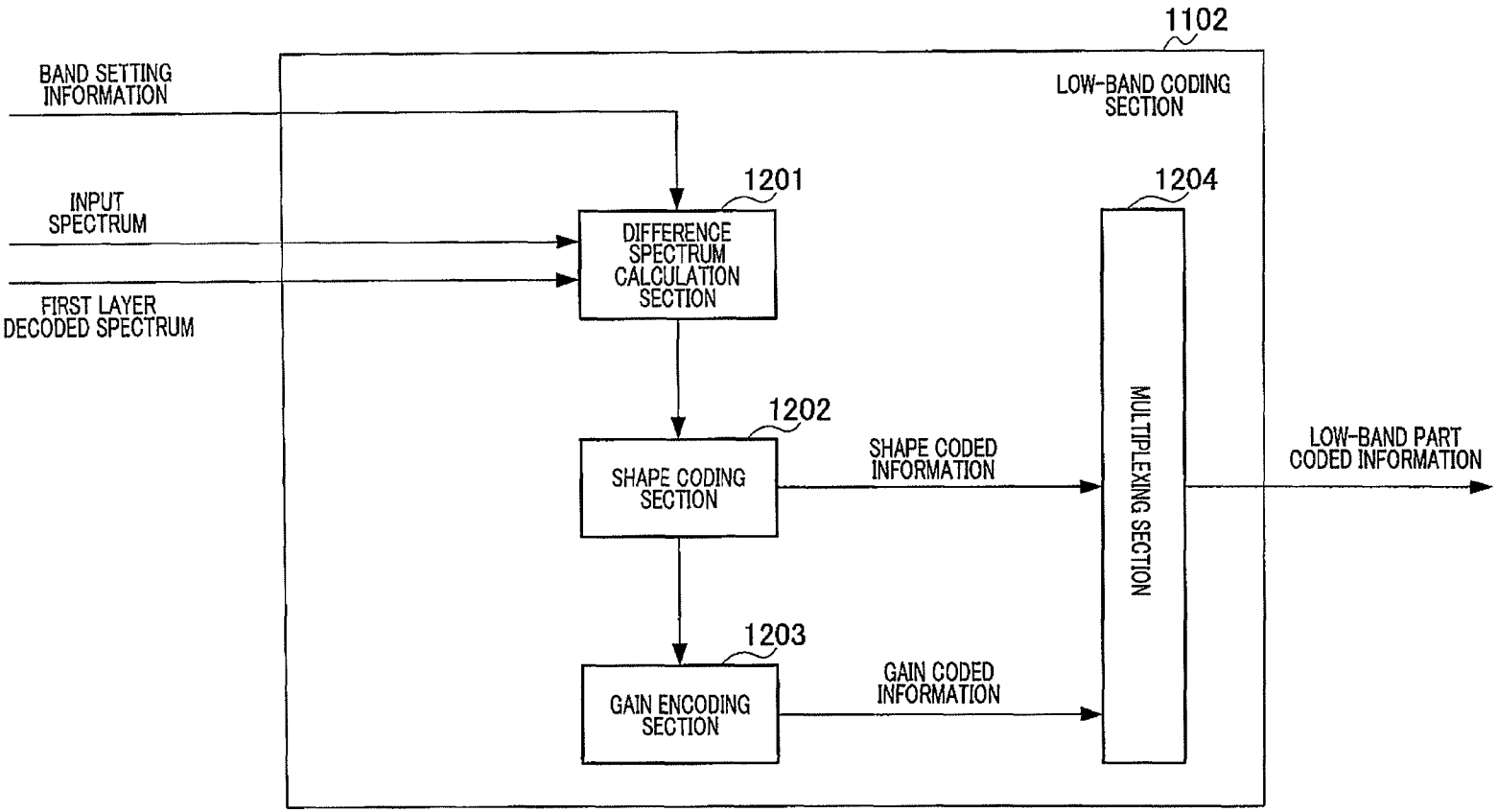
FIG. 14 is a block diagram showing the internal principal-part configuration of the low-band coding section shown in FIG. 13.

FIG. 14 is a block diagram showing the internal configuration of low-band coding section 1102. Low-band coding section 1102 mainly comprises difference spectrum calculation section 1201, shape coding section 1202, gain coding section 1203, and multiplexing section 1204. These sections perform the following operations.

Difference spectrum calculation section 1201 calculates difference spectrum $C_{sub}(k)$ between input spectrum X(k) and first layer decoded spectrum C(k), and outputs calculated difference spectrum $C_{sub}(k)$ to shape coding section 1202.

Difference spectrum $C_{sub}(k)$ is input to shape coding section 1202 from difference spectrum calculation section 1201. Shape coding section 1202 encodes difference spectrum $C_{sub}(k)$ shape information, and outputs this to multiplexing section 1204 as shape coded information. Also, shape coding section 1202 calculates an ideal gain at the time of shape information coding, and outputs the calculated ideal gain to gain coding section 1203. The processing performed by shape coding section 1202 is similar to that of shape coding section 402 shown in FIG. 4, and therefore a description thereof is omitted here.

Ideal gain is input to gain coding section 1203 from shape coding section 1202. Gain coding section 1203 encodes the ideal gain, and outputs this to multiplexing section 1204 as gain coded information. The processing performed by gain coding section 1203 is similar to that of gain coding section 403 shown in FIG. 4, and therefore a description thereof is omitted here.

Figure 15:
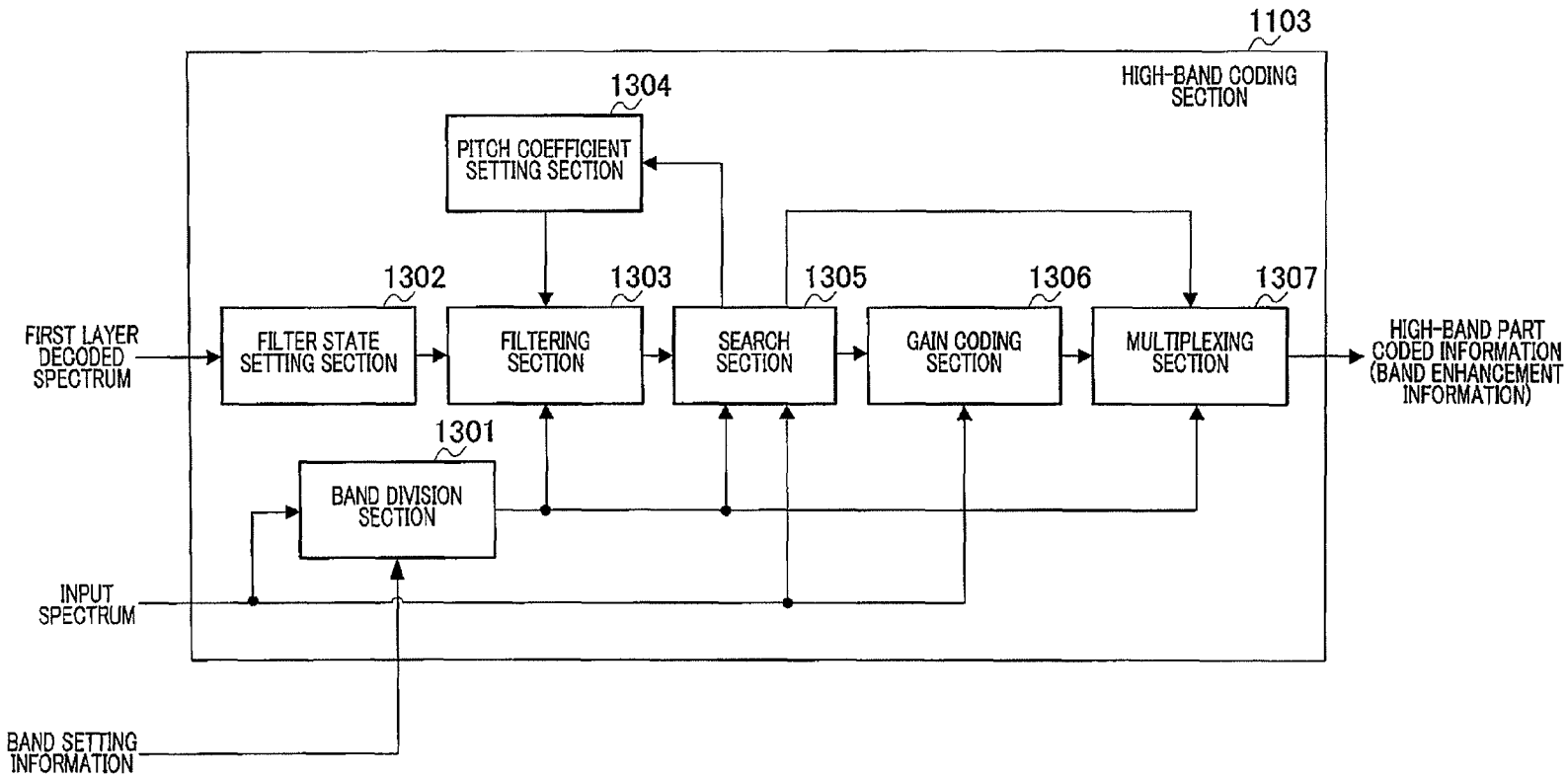
FIG. 15 is a block diagram showing the internal principal-part configuration of the high-band coding section shown in FIG. 13.

FIG. 15 is a block diagram showing the internal configuration of high-band coding section 1103. High-band coding section 1103 is provided with band division section 1301, filter state setting section 1302, filtering section 1303, search section 1305, pitch coefficient setting section 1304, gain coding section 1306, and multiplexing section 1307, which perform the operations described below. With the exception of filter state setting section 1302, the above configuration elements perform similar processing to that of identically named configuration elements shown in FIG. 5, and therefore descriptions thereof are omitted here.

Filter state setting section 1302 sets first layer decoded spectrum C(k) input from orthogonal transform processing section 1005 as a filter state used by filtering section 1303. First layer decoded spectrum C(k) is stored as a filter internal state (filter state) in an entire frequency band 0≤k<Fmax spectrum S(k) ((0≤k<Max1) or (0≤k<Max2)) band in filtering section 1303.

This concludes a description of the processing performed by high-band coding section 1103.

This concludes a description of the configuration of encoding apparatus 111.

Decoding apparatus 113 according to this embodiment will now be described.

Figure 16:
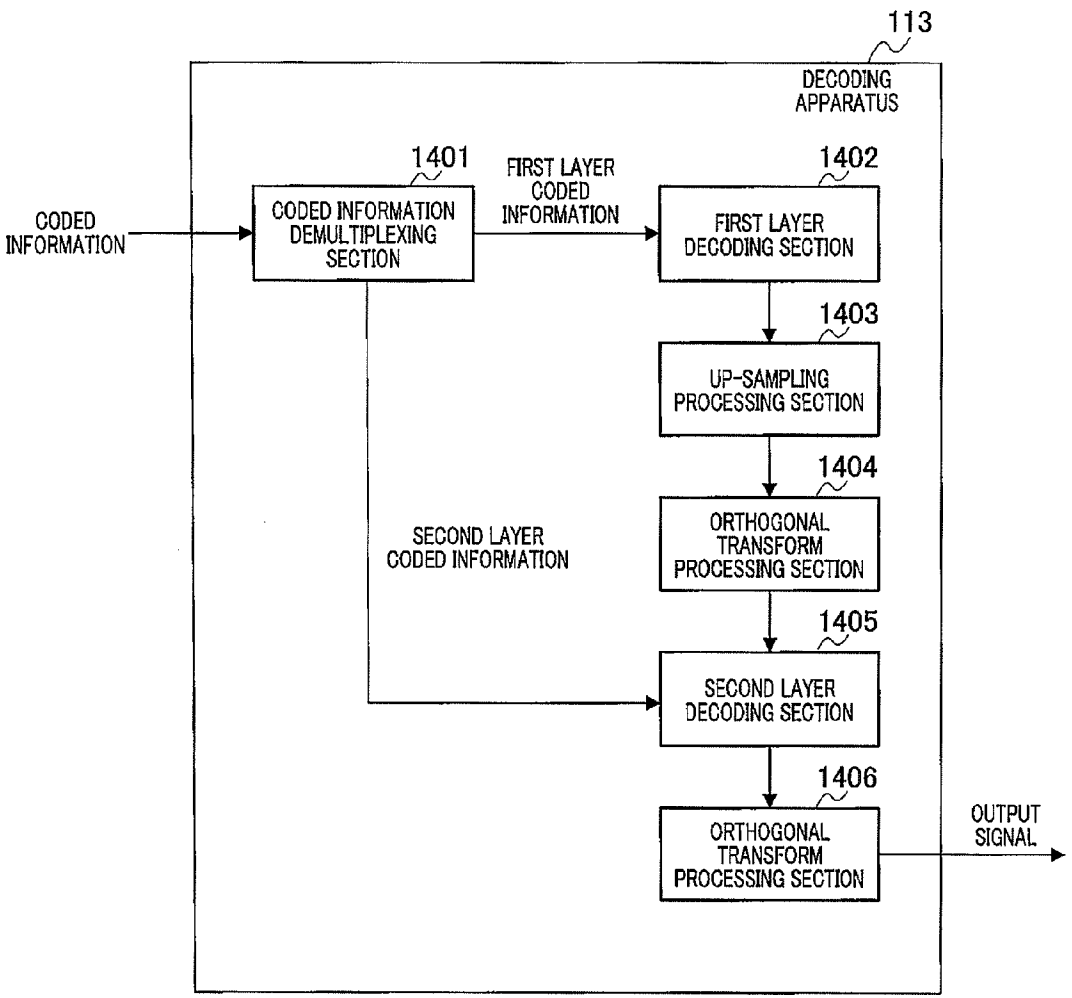
FIG. 16 is a block diagram showing the internal principal-part configuration of a decoding apparatus according to Embodiment 2 of the present invention.

FIG. 16 is a block diagram showing the internal principal-part configuration of decoding apparatus 113. Decoding apparatus 113 mainly comprises coded information demultiplexing section 1401, first layer decoding section 1402, up-sampling processing section 1403, orthogonal transform processing section 1404, second layer decoding section 1405, and orthogonal transform processing section 1406. These sections perform the following operations.

Coded information transmitted from encoding apparatus 111 via channel 102 is input to coded information demultiplexing section 1401. Coded information demultiplexing section 1401 demultiplexes the input coded information into first layer coded information and second layer coded information, outputs the first layer coded information to first layer decoding section 1402, and outputs the second layer coded information to second layer decoding section 1405.

First layer decoding section 1402 decodes the first layer coded information input from coded information demultiplexing section 1401 and generates a first layer decoded signal, and outputs the generated first layer decoded signal to up-sampling processing section 1403. The operation of first layer decoding section 1402 is similar to that of first layer decoding section 1003 shown in FIG. 12, and therefore a detailed description thereof is omitted here.

Up-sampling processing section 1403 performs up-sampling of the sampling frequency of a first layer decoded signal input from first layer decoding section 1402 from $SR_{base}$ to $SR_{input}$, and outputs an obtained post-up-sampling first layer decoded signal to orthogonal transform processing section 1404.

Orthogonal transform processing section 1404 performs orthogonal transform processing (MDCT) on a post-up-sampling first layer decoded signal input from up-sampling processing section 1403. Then orthogonal transform processing section 1404 outputs obtained post-up-sampling first layer decoded signal MDCT coefficient (hereinafter referred to as first layer decoded spectrum) C(k) to second layer decoding section 1405. The operation of orthogonal transform processing section 1404 is similar to the processing on a post-up-sampling first layer decoded signal by orthogonal transform processing section 1005 shown in FIG. 12, and therefore a detailed description thereof is omitted here.

Second layer decoding section 1405 generates second layer decoded spectrum S2(*k*) including a high-band component using first layer decoded spectrum C(k) input from orthogonal transform processing section 1404 and second layer coded information input from coded information demultiplexing section 1401. Then second layer decoding section 1405 outputs generated second layer decoded spectrum S2(*k*) to orthogonal transform processing section 1406. Details of the processing performed by second layer decoding section 1405 will be given later herein.

Orthogonal transform processing section 1406 executes an orthogonal transform on second layer decoded spectrum S2(*k*) input from second layer decoding section 1405, and converts it to a time-domain signal. Orthogonal transform processing section 1406 outputs the obtained signal as an output signal. The operation of orthogonal transform processing section 1406 is similar to the processing by orthogonal transform processing section 802 shown in FIG. 8, and therefore a detailed description thereof is omitted here.

Figure 17:
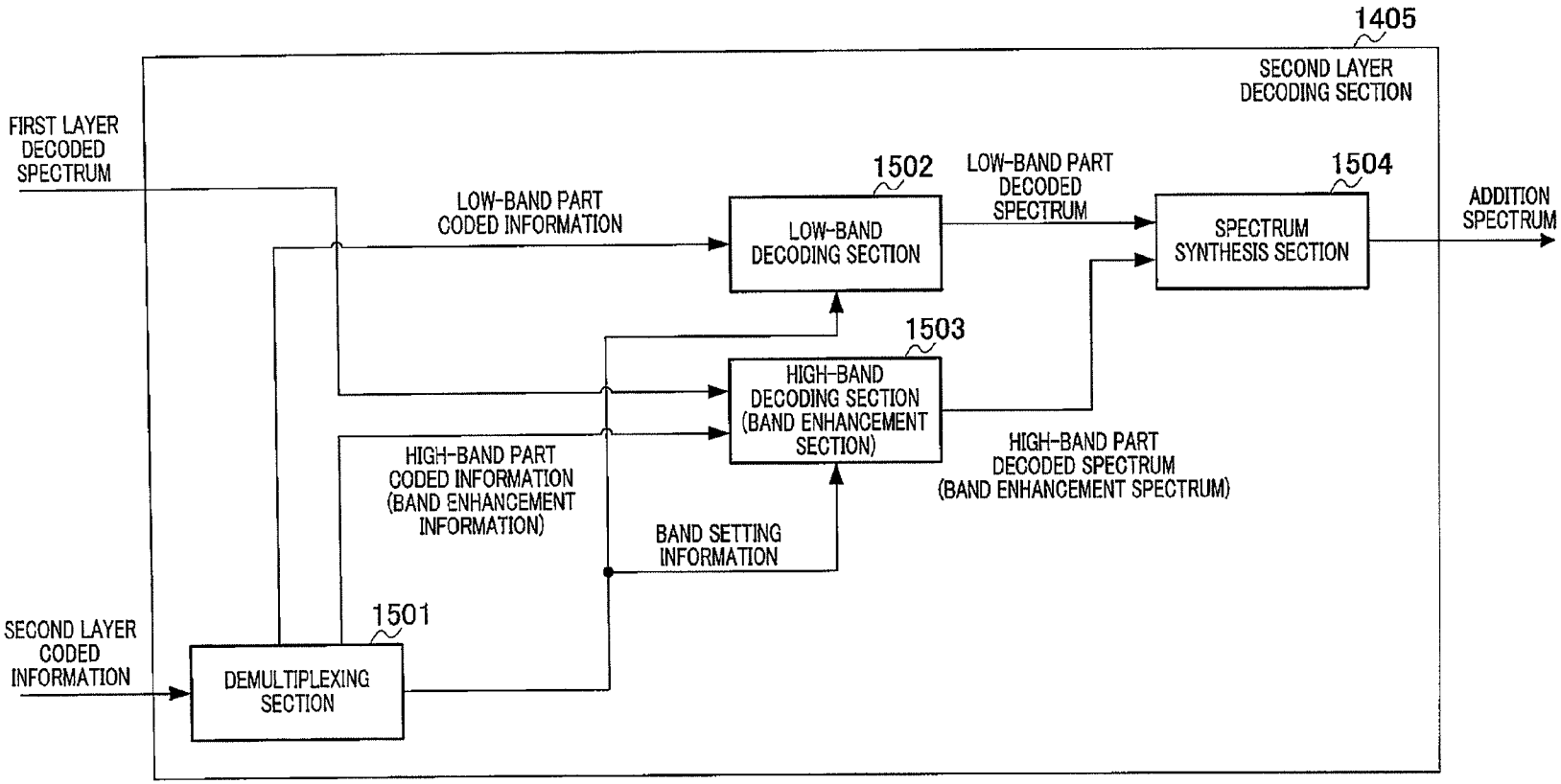
FIG. 17 is a block diagram showing the internal principal-part configuration of the second layer decoding section shown in FIG. 16.

FIG. 17 is a block diagram showing the internal configuration of second layer decoding section 1405 shown in FIG. 16. Second layer decoding section 1405 mainly comprises demultiplexing section 1501, low-band decoding section 1502, high-band decoding section (band enhancement section) 1503, and spectrum synthesis section 1504.

Second layer coded information is input to demultiplexing section 1501 from coded information demultiplexing section 1401. Demultiplexing section 1501 demultiplexer the coded information into low-band part coded information, high-band part coded information, and band setting information. Then demultiplexing section 1501 outputs the low-band part coded information to low-band decoding section 1502, outputs the high-band part coded information (band enhancement information) to high-band decoding section 1503, and outputs the band setting information to low-band decoding section 1502 and high-band decoding section 1503.

Low-band part coded information and band setting information are input to low-band decoding section 1502 from demultiplexing section 1501. Low-band decoding section 1502 generates a low-band part decoded spectrum from the input low-band part coded information and band setting information, and outputs the generated low-band part decoded spectrum to spectrum synthesis section 1504. The processing performed by low-band decoding section 1502 is similar to that of low-band decoding section 902 shown in FIG. 10, and therefore a description thereof is omitted here.

High-band part coded information and band setting information are input to high-band decoding section 1503 from demultiplexing section 1501. First layer decoded spectrum C(k) is input to high-band decoding section 1503 from orthogonal transform processing section 1404. High-band decoding section 1503 generates a high-band part decoded spectrum from input first layer decoded spectrum C(k) and high-band part coded information, and outputs the generated high-band part decoded spectrum to spectrum synthesis section 1504.

Figure 18:
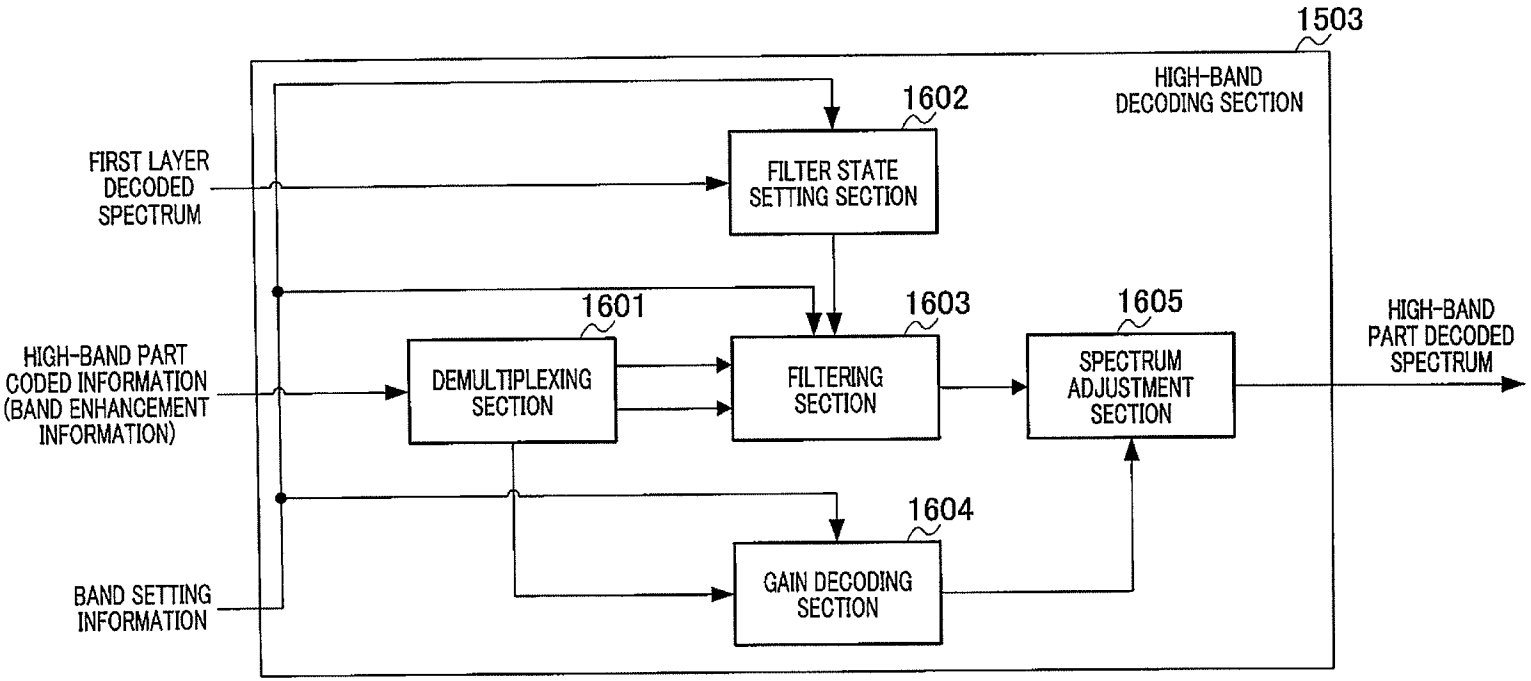
FIG. 18 is a block diagram showing the internal principal-part configuration of the high-band decoding section shown in FIG. 17.

FIG. 18 is a block diagram showing the internal configuration of high-band decoding section 1503. High-band decoding section 1503 mainly comprises demultiplexing section 1601, filter state setting section 1602, filtering section 1603, gain decoding section 1604, and spectrum adjustment section 1605, which perform the operations described below. With the exception of filter state setting section 1602, the above configuration elements perform similar processing to that of identically named configuration elements shown in FIG. 11, and therefore descriptions thereof are omitted here.

Based on band setting information Band_Setting input from demultiplexing section 1501, filter state setting section 1602 sets first layer decoded spectrum C(k) input from orthogonal transform processing section 1404 as a filter state used by filtering section 1603. Here, an entire frequency band 0≤k<Fmax spectrum in filtering section 1603 is called S(k) for convenience. In this case, of spectrum S(k), first layer decoded spectrum C(k) is stored in a low-band part ((0≤k<Max1) or (0≤k<Max2)) band indicated by band setting information Band_Setting as a filter internal state (filter state). The configuration and operation of filter state setting section 1602 are similar to those of filter state setting section 502 shown in FIG. 5, and therefore a detailed description thereof is omitted here.

This concludes a description of the processing performed by high-band decoding section 1503.

Low-band part decoded spectrum S1($k$) is input to spectrum synthesis section 1504 from low-band decoding section 1502. Also, high-band part decoded spectrum S2($k$) is input to spectrum synthesis section 1504 from high-band decoding section 1503. Spectrum synthesis section 1504 adds input low-band part decoded spectrum S1($k$) and high-band part decoded spectrum S2($k$) in the frequency domain by means of equation 27, and calculates addition spectrum $S_{add}$(k). Spectrum synthesis section 1504 outputs calculated addition spectrum $S_{add}$(k) to orthogonal transform processing section 1406.

[27]

$$S_{add}(k)=S1(k)+S2(k)(k=0, \ldots, F\max) \quad \text{(Equation 27)}$$

This concludes a description of the internal configuration of decoding apparatus 113.

Thus, according to this embodiment, even in a configuration using a coding/decoding method that performs band enhancement using a low-band part spectrum and generates/estimates a high-band part spectrum, and in which there is a coding layer (core layer) that encodes a low band, an encoding apparatus/decoding apparatus decides band setting—that is, which bands a low-band part and high-band part are—adaptively according to an input signal characteristic. By this means, high-band part spectral data such as a wideband signal or an ultrawideband signal can be encoded efficiently, and the quality of a decoded signal can be improved.

Specifically, band setting section 1101 compares low-band part energy and high-band part energy of difference data between input signal spectral data and spectral data encoded by the core layer. Then, if the low-band part energy is significantly greater than the high-band part energy, band setting section 1101 sets a narrower low-band part narrower and a wider high-band part. By this means, low-band part spectral data that greatly influences the quality of a decoded signal when an input signal is speech can be encoded intensively by means of a shape-gain coding method, and the quality of a decoded signal can be increased. Also, if low-band part energy is not that much greater than high-band part energy, band setting section 1101 sets a wider low-band part and a narrower high-band part. By this means, coding distortion can be reduced with a shape-gain coding method up to a higher band part, and bandwidth limitation that greatly influences the quality of a decoded signal when an input signal is audio can be improved.

In this embodiment, band setting section 1101 decides band setting information Band_Setting based on an energy ratio of a low-band part and high-band part of a difference spectrum between an input spectrum and first layer decoded spectrum. However, the present invention is not limited to this, and can also be applied in a similar way to a configuration whereby band setting section 1101 decides band setting information Band_Setting based on an energy ratio of a low-band part and high-band part of an input spectrum.

Also, a configuration has been described whereby a first layer decoded spectrum is set as a filter state in high-band decoding section 1503 in a decoding apparatus according to this embodiment. However, the present invention is not limited to this, and can also be applied in a similar way to a configuration whereby a low-band part of a spectrum obtained by adding a first layer decoded spectrum and low-band part decoded spectrum in the frequency domain is set as a filter state. By this means, a low-band part spectrum used in band enhancement is more similar to an input spectrum, so that the precision of a low-band part used in band enhancement is improved, and as a result, the quality of a decoded signal can be further improved. In the above configuration, it is necessary for a low-band part decoded spectrum to be output to high-band decoding section 1503 from low-band decoding section 1502.

Embodiment 3

In Embodiment 3 of the present invention, a configuration is described in which a first layer coding section that encodes a low-band part of spectral data is newly provided in the same way as in Embodiment 2, and the coding method described in Embodiment 1 is applied to difference data between input signal spectral data and a first layer coding section coding result. Below, a coding layer in which the coding method described in Embodiment 1 is applied is described as a second layer coding section. However, in this embodiment, a configuration is described whereby a band other than a band encoded by the first layer coding section is encoded by the second layer coding section. That is to say, a second layer coding section of Embodiment 2 has a configuration in which only a high-band coding section (band enhancement section) is present.

A communication system according to Embodiment 3 (not shown) is basically similar to the communication system shown in FIG. 1, and differs from encoding apparatus 101 and decoding apparatus 103 of the communication system in FIG. 1 only in parts of the configuration and operation of the encoding apparatus and decoding apparatus. In the following description, reference codes "121" and "123" are assigned respectively to an encoding apparatus and decoding apparatus of a communication system according to this embodiment.

Encoding Apparatus 121

Figure 19:
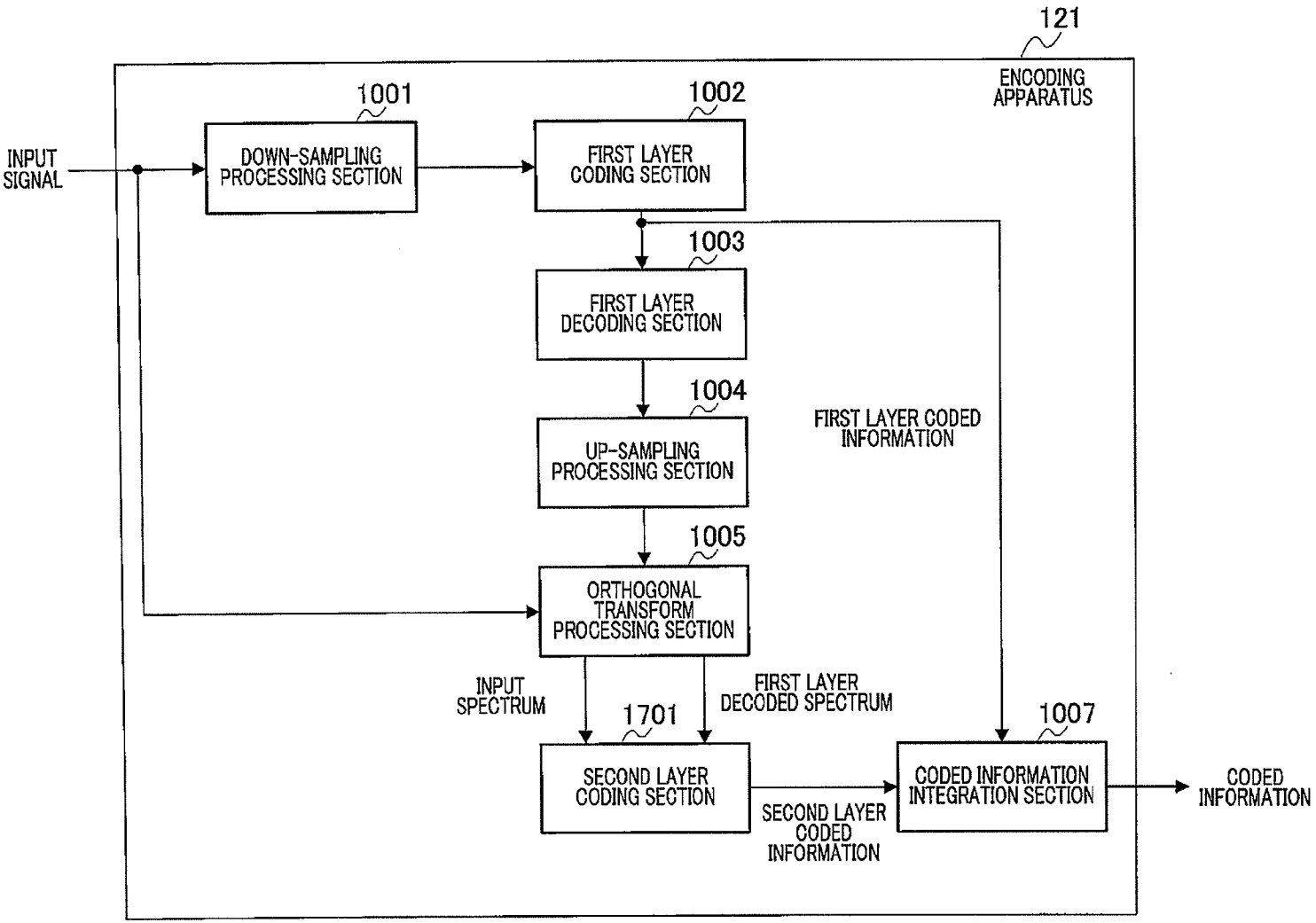
FIG. 19 is a block diagram showing the internal principal-part configuration of an encoding apparatus according to Embodiment 3 of the present invention.

FIG. 19 is a block diagram showing the internal principal-part configuration of encoding apparatus 121 according to this embodiment. Encoding apparatus 121 according to this embodiment mainly comprises down-sampling processing section 1001, first layer coding section 1002, first layer decoding section 1003, up-sampling processing section 1004, orthogonal transform processing section 1005, second layer coding section 1701, and coded information integration section 1007. These sections perform the following operations. With the exception of second layer coding section 1701, the above configuration elements perform the same processing as configuration elements in encoding apparatus 111 described in Embodiment 2, and are therefore assigned the same reference codes, and descriptions thereof are omitted here.

Second layer coding section 1701 generates second layer coded information using input spectrum X(k) and first layer decoded spectrum C(k) input from orthogonal transform processing section 1005, and outputs the generated second layer coded information to coded information integration section 1007.

Figure 20:
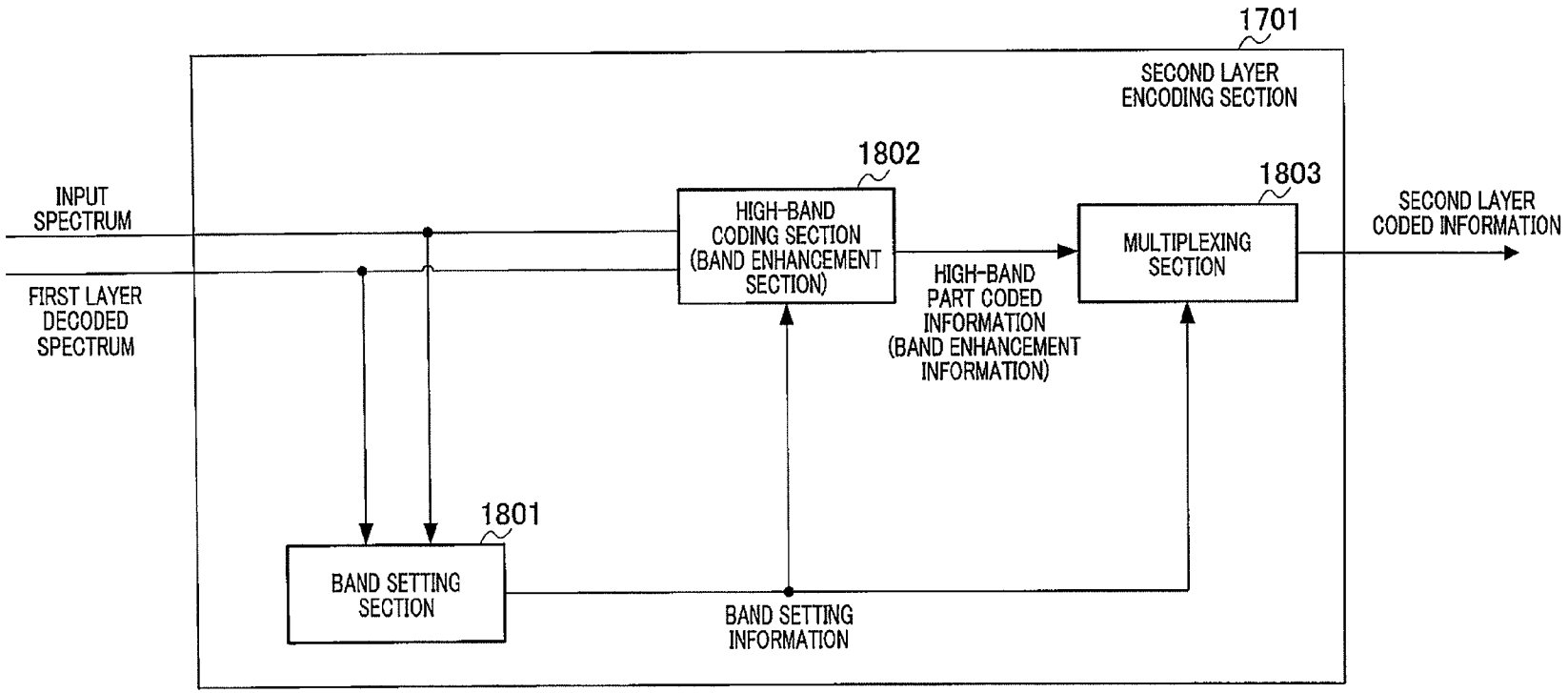
FIG. 20 is a block diagram showing the internal principal-part configuration of the second layer coding section shown in FIG. 19.

The internal principal-part configuration of second layer coding section 1701 shown in FIG. 19 will now be described with reference to FIG. 20.

Second layer coding section 1701 mainly comprises band setting section 1801, high-band coding section (band enhancement section) 1802, and multiplexing section 1803. These sections perform the following operations.

Input spectrum X(k) and first layer decoded spectrum C(k) are input to band setting section 1801 from orthogonal transform processing section 1005. Band setting section 1801 analyzes the spectral characteristics of input spectrum X(k) and first layer decoded spectrum C(k). Band setting section 1801 sets a band subject to coding by high-band coding section (band enhancement section) 1802 according to the analysis results, and outputs this as band setting information to high-band coding section 1802 and multiplexing section 1803.

The band setting information calculation method used by band setting section 1801 will now be described.

Band setting section 1801 first calculates difference spectrum $C_{sub}(k)$ between input spectrum X(k) and first layer decoded spectrum C(k) by means of equation 28. In equation 28, Fmax is the maximum band value (maximum frequency value).

$$C_{sub}(k)=X(k)-C(k)=0, \ldots Fmax) \quad \text{(Equation 28)}$$

Then band setting section 1801 calculates, for difference spectrum $C_{sub}(k)$, energy (first band energy) $E_1$ of a part for which the band is $TH1_{Low}$ to $TH1_{High}$ and energy (second band energy) $E_2$ of a part for which the band is $TH2_{Low}$ to $TH2_{High}$ in accordance with equations 29-1 and 29-2. Here, $TH1_{Low}$, $TH1_{High}$, $TH2_{Low}$, and $TH2_{High}$ are predetermined threshold values, $TH1_{Low}<TH2_{Low}$, and $TH1_{High}<TH2_{High}$.

(Equation 29-1)

$$E_1 = \sum_{k=TH1_{Low}}^{TH1_{High}} C_{sub}(k)^2 \quad [29]$$

(Equation 29-2)

$$E_2 = \sum_{k=TH2_{Low}}^{TH2_{High}} C_{sub}(k)^2$$

Next, band setting section 1801 compares the magnitude of first band energy $E_1$ calculated by means of equation 29-1 and the magnitude of second band energy $E_2$ calculated by means of equation 29-2, and decides band setting information Band_Setting in accordance with equation 30. Here, $\gamma 2$ in equation 30 is a predetermined constant.

(Equation 30)

$$\text{Band_Setting} = \begin{cases} 0 & (\text{if } E_1 \geq \gamma 2 \cdot E_2) \\ 1 & (\text{else}) \end{cases} \quad [30]$$

That is to say, band setting section 1801 sets the band setting information Band_Setting value to 0 if first band energy $E_1$ is somewhat greater than second band energy $E_2$, and sets the band setting information Band_Setting value to 1 otherwise. Band setting section 1801 outputs decided band setting information Band_Setting to high-band coding section 1802 and multiplexing section 1803.

Input spectrum X(k) and first layer decoded spectrum C(k) are input to high-band coding section 1802 from orthogonal transform processing section 1005. Also, band setting information Band_Setting is input to high-band coding section 1802 from band setting section 1801. Based on band setting information Band_Setting, high-band coding section 1802 encodes input spectrum X(k) and generates high-band part coded information (band enhancement information). Then high-band coding section 1802 outputs the high-band part coded information to multiplexing section 1803. Details of the processing performed by high-band coding section 1802 will be given later herein.

Multiplexing section 1803 multiplexes band setting information and high-band part coded information input from band setting section 1801 and high-band coding section 1802 respectively, and outputs the multiplexed information to coded information integration section 1007 as second layer coded information. Band setting information and high-band part coded information may also be input directly to coded information integration section 1007, and multiplexed by coded information integration section 1007.

Figure 21:
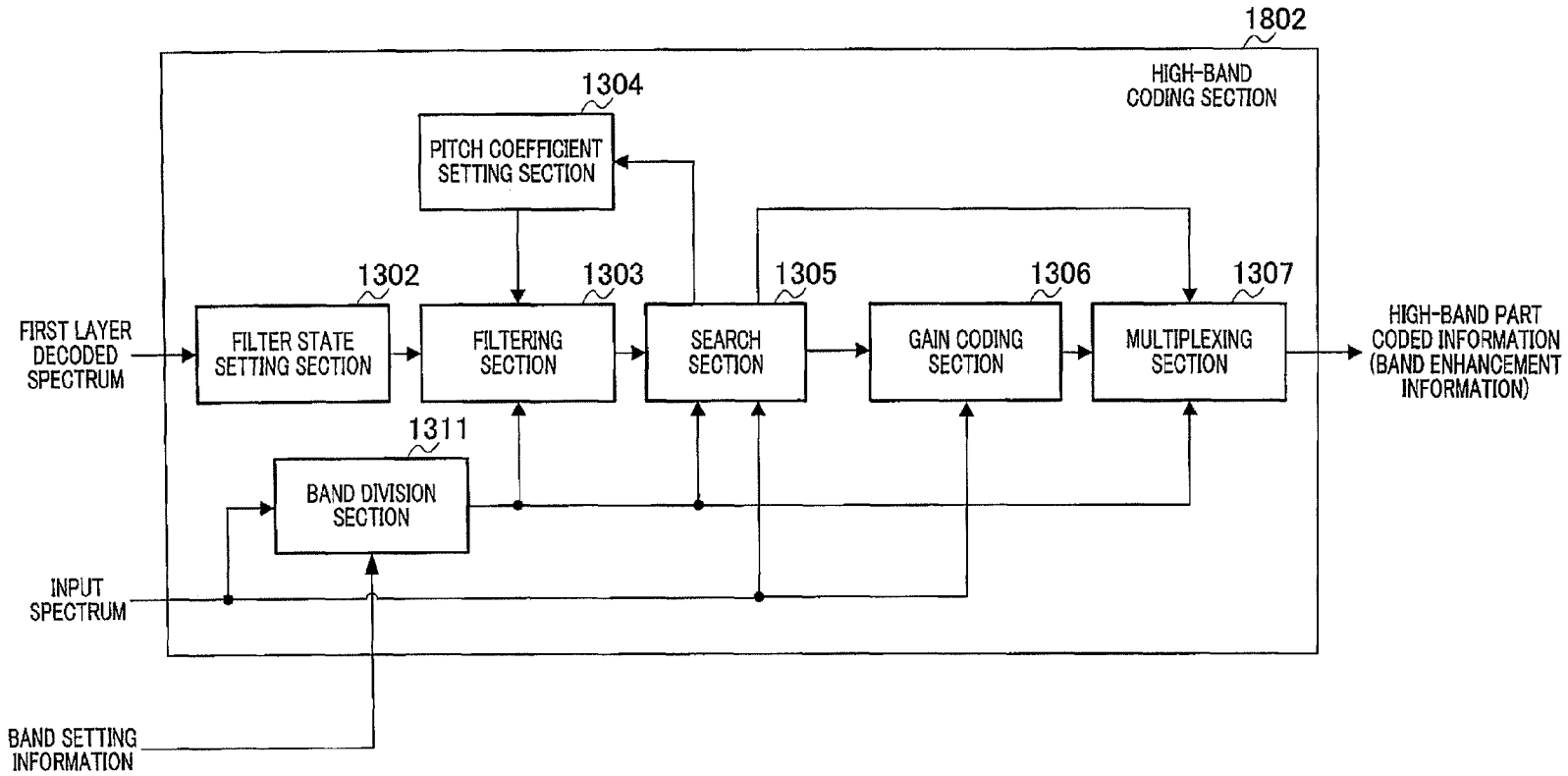
FIG. 21 is a block diagram showing the internal principal-part configuration of the high-band coding section shown in FIG. 20.

FIG. 21 is a block diagram showing the internal configuration of high-band coding section 1802. High-band coding section 1802 is provided with band division section 1311, filter state setting section 1302, filtering section 1303, search section 1305, pitch coefficient setting section 1304, gain coding section 1306, and multiplexing section 1307, which perform the operations described below. With the exception of band division section 1311, the above configuration elements perform the same processing as configuration elements shown in FIG. 15, and are therefore assigned the same reference codes, and descriptions thereof are omitted here.

Input spectrum X(k) is input to band division section 1311 from orthogonal transform processing section 1005. Also, band setting information Band_Setting is input to band division section 1311 from band setting section 1801. Band division section 1311 divides a high-band part of input spectrum X(k) into P subbands $SB_p$ (p=0, 1, . . . , P−1) according to the band setting information Band_Setting value. Band division section 1311 outputs bandwidth $BW_p$ (p=0, 1, . . . , P−1) and initial index $BS_p$ (p=0, 1, . . . , P−1) of each subband to filtering section 1303, search section 1305, and multiplexing section 1307 as band division information.

Specifically, if the band setting information Band_Setting value is 0, band division section 1311 divides a part for which the band is less than or equal to Max3 (Flow≤k<Max3) within input spectrum X(k) into P subbands $SB_p$ (p=0, 1, . . . , P−1). Also, if the band setting information Band_Setting value is 1, band division section 1311 divides a part for which the band is less than or equal to Max4 (Flow≤k<Max4) within input spectrum X(k) into P subbands $SB_p$ (p=0, 1, . . . , P−1). Here, Max3 and Max4 are predetermined constants, and Max3<Max4. Also, Flow is a maximum frequency band value corresponding to a sampling frequency of a signal down-sampled by down-sampling processing section 1001. That is to say, it is the maximum usable frequency index of a first layer decoded spectrum. Also, below, a part in subband $SB_p$ within input spectrum X(k) is denoted as subband spectrum $X_p(k)$ ($BS_p \leq k < BS_p + BW_p$).

The effect of the above-described kind of band division method will now be described. Band setting information Band_Setting is set by comparing energy (first band energy) $E_1$ of a part for which the band is $TH1_{Low}$ to $TH1_{High}$ and energy (second band energy) $E_2$ of a part for which the band is $TH2_{Low}$ to $TH2_{High}$. If this band setting information Band_Setting value is 0, this means that low-band side energy is greater than high-band side energy. In this case, a band encoded by high-band coding section 1802 is given a narrow setting (Flow≤k<Max3) by band division section 1311, and there is an effect of improving the quality of a decoded signal by focusing coding on a lower band with high energy. Also, if the band setting information Band_Setting value is 1, this means that high-band side energy is greater than low-band side energy. In this case, a band encoded by high-band coding section 1802 is given a wider and higher-band setting (Flow≤k<Max4) by band division section 1311, and there is an effect of improving the quality of a decoded signal by performing encoding up to a band on the high-band side with high energy.

This concludes a description of the processing performed by high-band coding section 1802.

This concludes a description of the configuration of encoding apparatus 121.

Decoding apparatus 123 according to this embodiment will now be described.

Figure 22:
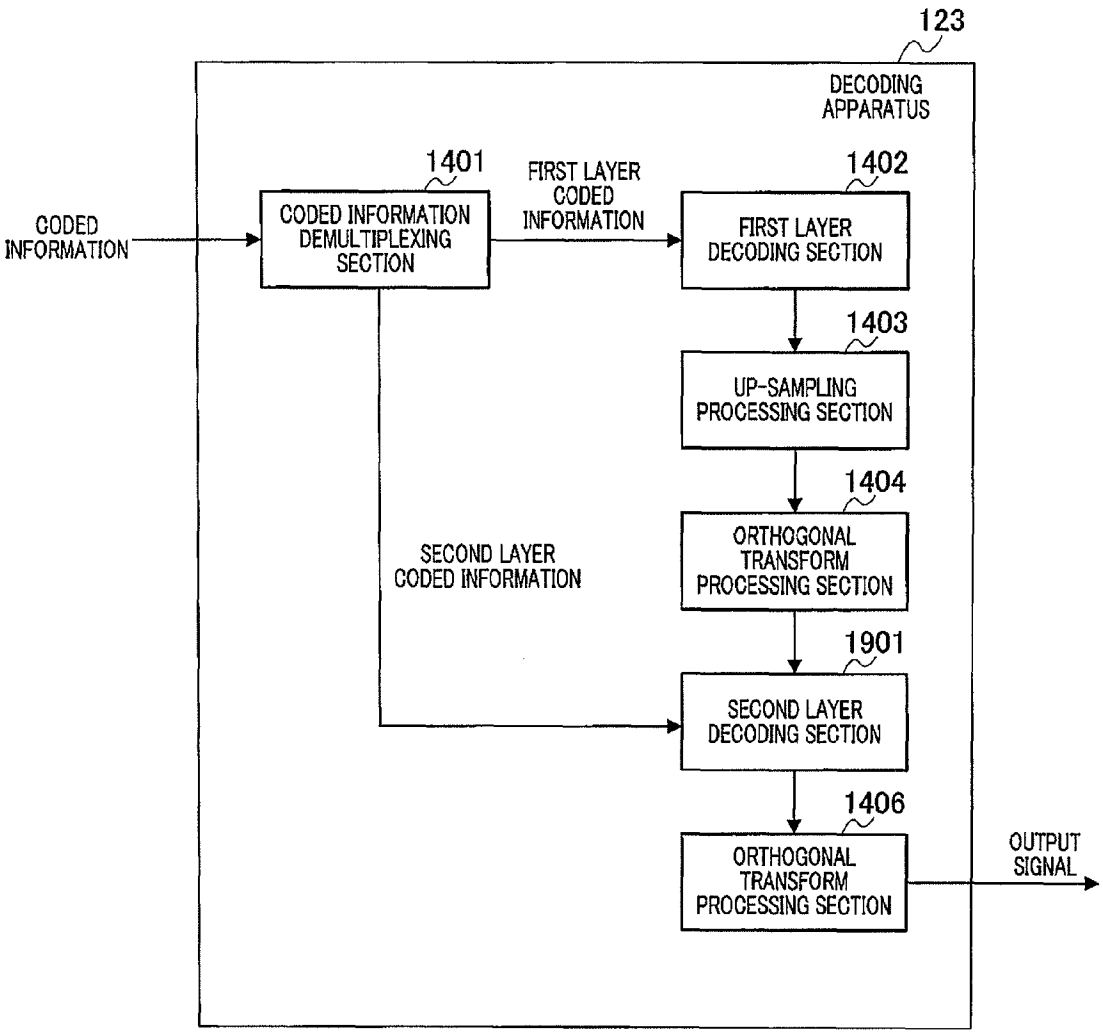
FIG. 22 is a block diagram showing the internal principal-part configuration of a decoding apparatus according to Embodiment 3 of the present invention.

FIG. 22 is a block diagram showing the internal principal-part configuration of decoding apparatus 123. Decoding apparatus 123 mainly comprises coded information demultiplexing section 1401, first layer decoding section 1402, up-sampling processing section 1403, orthogonal transform processing section 1404, second layer decoding section 1901, and orthogonal transform processing section 1406. With the exception of second layer decoding section 1901, the above configuration elements perform the same processing as configuration elements in decoding apparatus 113 of Embodiment 2, and are therefore assigned the same reference codes, and descriptions thereof are omitted here.

Second layer decoding section 1901 generates second layer decoded spectrum S2(*k*) including a high-band component using first layer decoded spectrum C(k) input from orthogonal transform processing section 1404 and second layer coded information input from coded information demultiplexing section 1401. Second layer decoding section 1901 outputs generated second layer decoded spectrum S2(*k*) to orthogonal transform processing section 1406.

Figure 23:
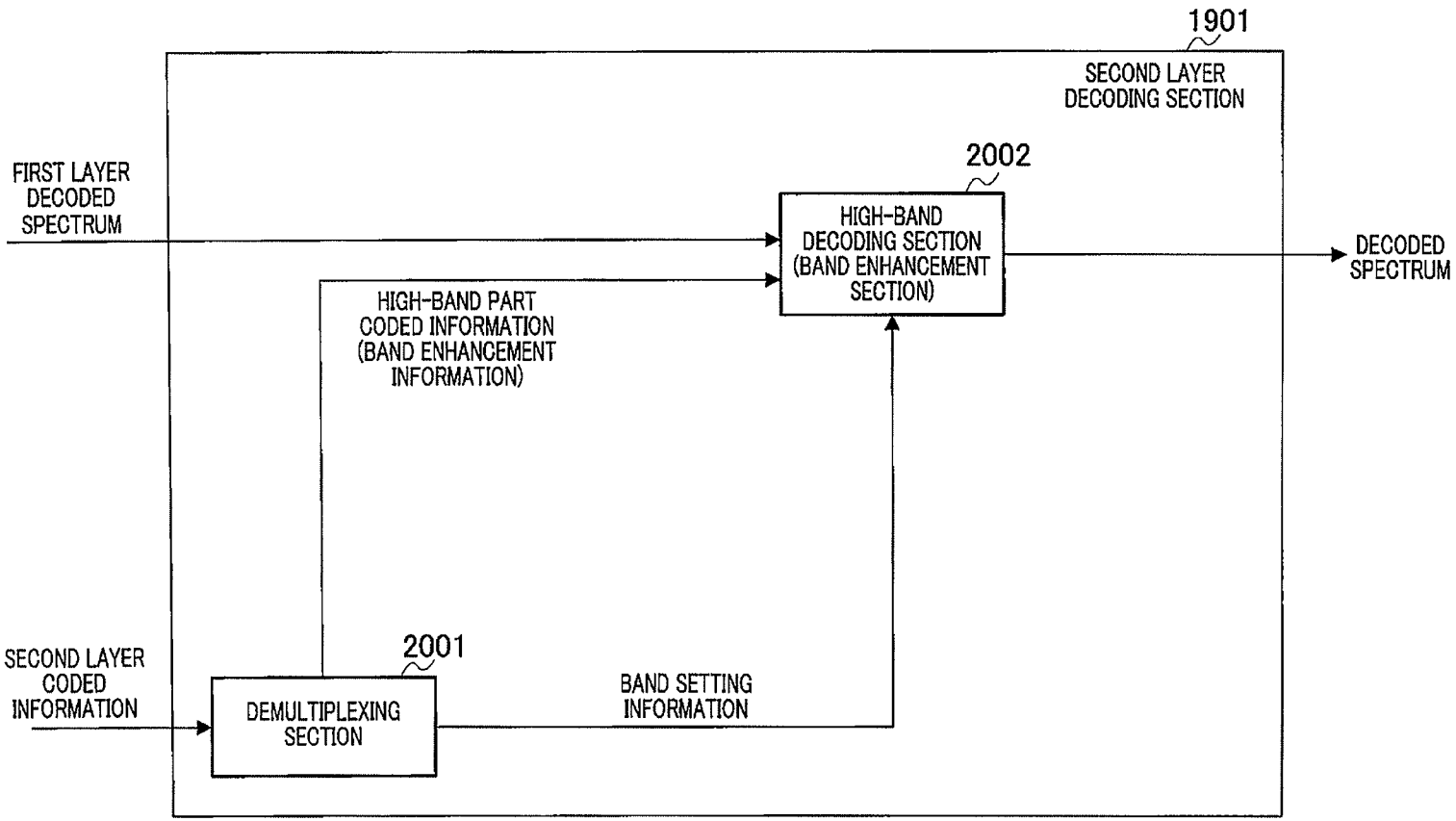
FIG. 23 is a block diagram showing the internal principal-part configuration of the second layer decoding section shown in FIG. 22.

FIG. 23 is a block diagram showing the internal configuration of second layer decoding section 1901 shown in FIG. 22. Second layer decoding section 1901 mainly comprises demultiplexing section 2001 and high-band decoding section (band enhancement section) 2002.

Second layer coded information is input to demultiplexing section 2001 from coded information demultiplexing section 1401. Demultiplexing section 2001 demultiplexes the coded information into high-band part coded information and band setting information, and outputs these to high-band decoding section 2002.

High-band part coded information and band setting information are input to high-band decoding section 2002 from demultiplexing section 2001. High-band decoding section 2002 generates a decoded spectrum from the input high-band part coded information and band setting information, and outputs the generated decoded spectrum to orthogonal transform processing section 1406.

Apart from input information being a first layer decoded spectrum rather than a low-band part decoded spectrum, the processing performed by high-band decoding section 2002 is similar to that of high-band decoding section 903 shown in FIG. 9, and therefore a description thereof is omitted here.

This concludes a description of the internal configuration of decoding apparatus 123.

Thus, according to this embodiment, even in a configuration using a coding/decoding method that performs band enhancement using a low-band part spectrum and generates/estimates a high-band part spectrum, and in which there is a coding layer (core layer) that encodes a low band, an encoding apparatus/decoding apparatus decides band setting to be enhanced—that is, a spectrum of up to which band is generated by means of band enhancement—adaptively according to an input signal characteristic. By this means, high-band part spectral data such as a wideband signal or an ultrawideband signal can be encoded efficiently, and the quality of a decoded signal can be improved.

Specifically, band setting section 1801 compares low-band part energy (first band energy) and high-band part energy (second band energy) of difference data between input signal spectral data and spectral data encoded by the core layer. Then, if the first band energy is significantly greater than the second band energy, band setting section 1801 makes a narrower setting for a high-band part generated by band enhancement. By this means, middle-band part spectral data that greatly influences the quality of a decoded signal when an input signal is speech can be encoded intensively, and the quality of a decoded signal can be increased. Here, a middle-band part denotes a band on the low-band side even within a high-band part when a band is divided into a low-band part and high-band part. Also, if first band energy is not that much greater than second band energy, band setting section 1801 makes a wider setting for a high-band part generated by band enhancement. By this means, bandwidth limitation that greatly influences the quality of a decoded signal when an input signal is audio can be improved by performing band enhancement up to a higher-band part.

In this embodiment, a configuration has been described by way of example in which band setting section 1801 adjusts the upper limit of a band of a spectrum generated by high-band coding section 1802. However, the present invention is not limited to this, and can also be applied in a similar way to a configuration in which high-band coding section 1802 adjusts other than a band upper limit (for example, a band lower limit or the like) of a spectrum generated by high-band coding section 1802.

As described above, according to this embodiment, when generating high-band part spectral data of a signal subject to coding based on low-band part spectral data, an encoding apparatus decides band setting—that is, which bands a low-band part and high-band part are—adaptively according to an input signal characteristic. By this means, high-band part spectral data such as a wideband signal or an ultrawideband signal can be encoded efficiently, and the quality of a decoded signal in a decoding apparatus can be improved.

Embodiment 4

With the band enhancement methods disclosed in Patent Literature 1 and Patent Literature 2, band setting is fixed irrespective of input signal characteristics such as described in Embodiment 1, Embodiment 2, and Embodiment 3. Here, an input signal characteristic is an energy ratio between a low-band spectrum and a high-band spectrum, tonality, or the like. Similarly, with the band enhancement methods disclosed in Patent Literature 1 and Patent Literature 2, band setting is fixed irrespective of conditions at the time of coding.

Band enhancement technology is essentially a technology that generates spectral data of a high-band part of a signal subject to coding in a pseudo fashion with very little information (very few bits) using a low-band part spectral data obtained by decoding high-band part spectral data. Consequently, if the coding bit rate is extremely high, using a spectrum coding method other than a band enhancement method will often enable the quality of a decoded signal to be improved. However, since the band enhancement methods disclosed in Patent Literature 1 and Patent Literature 2 always perform band enhancement using a fixed band setting irrespective of conditions at the time of coding, there is a problem of coding efficiency not being high.

In Embodiment 4 of the present invention, a configuration is described whereby band setting is switched adaptively in a band enhancement method according to conditions at the time of coding. Below, a case in which a coding bit rate is used as an example of conditions at the time of coding is taken by way of example. Here, a case is described by way of example in which three bit rates—BR1, BR2, and BR3—are used as coding bit rates. The relationship of the coding bit rates is assumed to be BR1<BR2<BR3.

A communication system according to Embodiment 4 (not shown) is basically similar to the communication system shown in FIG. 1, and differs from encoding apparatus 101 and decoding apparatus 103 of the communication system in FIG. 1 only in parts of the configuration and operation of the encoding apparatus and decoding apparatus. In the following description, reference codes "131" and "133" are assigned respectively to an encoding apparatus and decoding apparatus of a communication system according to this embodiment.

Figure 24:
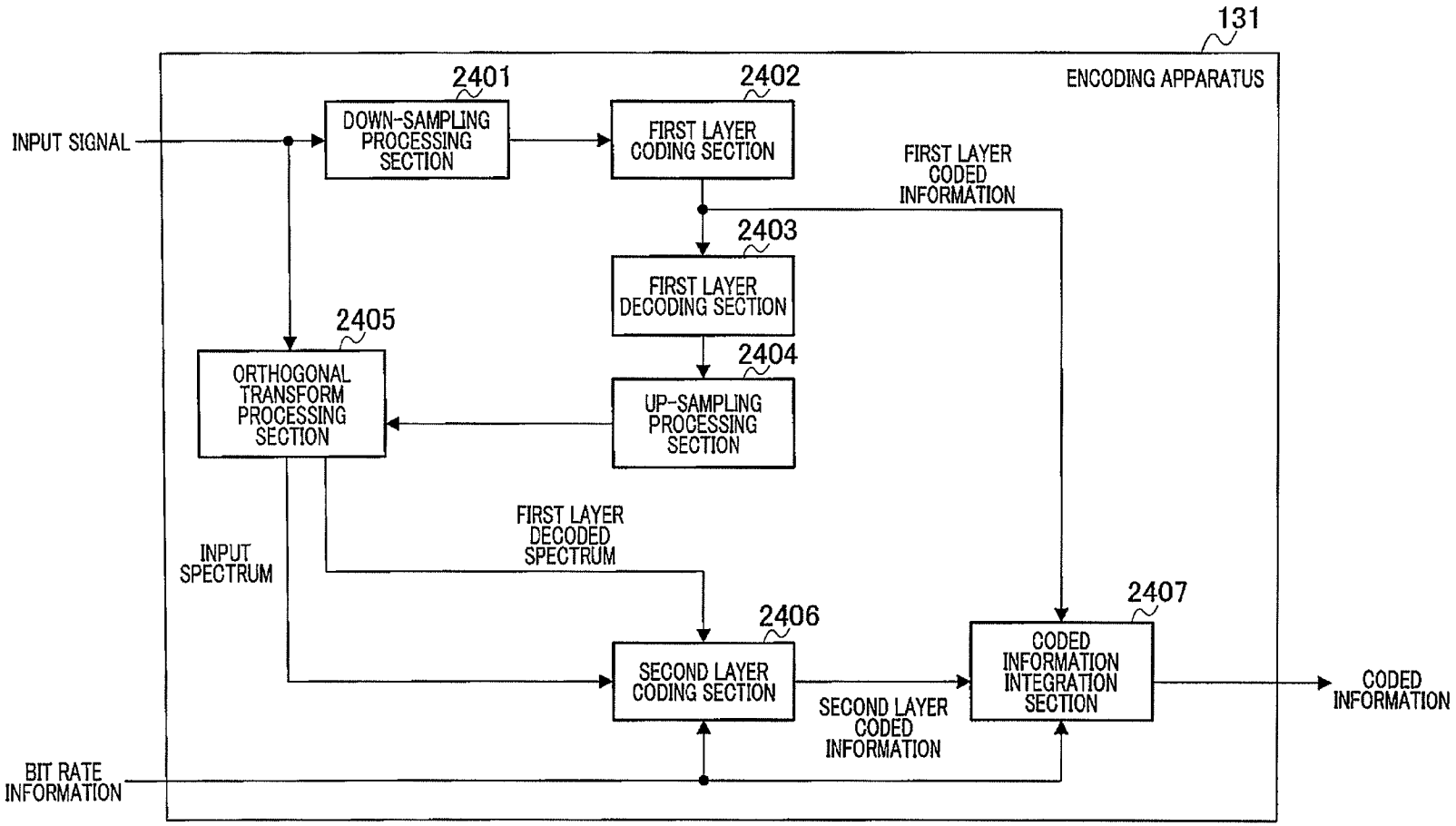
FIG. 24 is a block diagram showing the internal principal-part configuration of an encoding apparatus according to Embodiment 4 of the present invention.

FIG. 24 is a block diagram showing the internal principal-part configuration of encoding apparatus 131 according to this embodiment. Encoding apparatus 131 according to this embodiment mainly comprises down-sampling processing section 2401, first layer coding section 2402, first layer decoding section 2403, up-sampling processing section 2404, orthogonal transform processing section 2405, second layer coding section 2406, and coded information integration section 2407. These sections perform the following operations.

If the sampling frequency of input signal $x_n$ is designated $SR_{input}$, down-sampling processing section 2401 performs input signal sampling frequency down-sampling from $SR_{input}$ to $SR_{base}$ (where $SR_{base}<SR_{input}$), and outputs a down-sampled input signal to first layer coding section 2402 as a post-down-sampling input signal.

First layer coding section 2402 performs coding on a post-down-sampling input signal input from down-sampling processing section 2401 using, for example, a CELP (Code Excited Linear Prediction) type speech coding method, and generates first layer coded information. Then first layer coding section 2402 outputs the generated first layer coded information to first layer decoding section 2403 and coded information integration section 2407.

First layer decoding section 2403 performs decoding on first layer coded information input from first layer coding section 2402 using, for example, a CELP speech decoding method, and generates a first layer decoded signal. Then first layer decoding section 2403 outputs the generated first layer decoded signal to up-sampling processing section 2404.

Up-sampling processing section 2404 performs up-sampling of the sampling frequency of a first layer decoded signal input from first layer decoding section 2403 from $SR_{base}$ to $SR_{input}$. Then up-sampling processing section 2404 outputs an up-sampled first layer decoded signal to orthogonal transform processing section 2405 as post-up-sampling first layer decoded signal $c1_n$.

Orthogonal transform processing section 2405 has internal buffers $buf1_n$ and $buf2_n$ (n=0, . . . , N−1). Orthogonal transform processing section 2405 performs a Modified Discrete Cosine Transform (MDCT) on input signal $x_n$ and post-up-sampling first layer decoded signal $c1_n$ input from up-sampling processing section 2404. Orthogonal transform processing section 2405 performs orthogonal transform processing of input signal $x_n$ and post-up-sampling first layer decoded signal $c1_n$, and calculates input spectrum X(k) and first layer decoded spectrum C1(*k*). The processing performed by orthogonal transform processing section 2405 is similar to the processing described in Embodiment 1, and therefore a description thereof is omitted here. Orthogonal transform processing section 2405 outputs obtained input spectrum X(k) and first layer decoded spectrum C1(*k*) to second layer coding section 2406.

Second layer coding section 2406 generates second layer coded information using input spectrum X(k) and first layer decoded spectrum C1(*k*) input from orthogonal transform processing section 2405 based on coding bit rate information (hereinafter referred to as "bit rate information") input to encoding apparatus 131 from outside, and outputs the generated second layer coded information to coded information integration section 2407. Details of second layer coding section 2406 will be given later herein. In this embodiment, a case will be described by way of example in which encoding apparatus 131 uses three bit rates—BR1, BR2, and BR3—as coding bit rates, and the relationship of the coding bit rates is BR1<BR2<BR3.

Coded information integration section 2407 integrates first layer coded information input from first layer coding section 2402, second layer coded information input from second layer coding section 2406, and bit rate information. Then coded information integration section 2407 adds a transmission error code or the like to the integrated information source code if necessary, and then outputs this to channel 102 as coded information.

Figure 25:
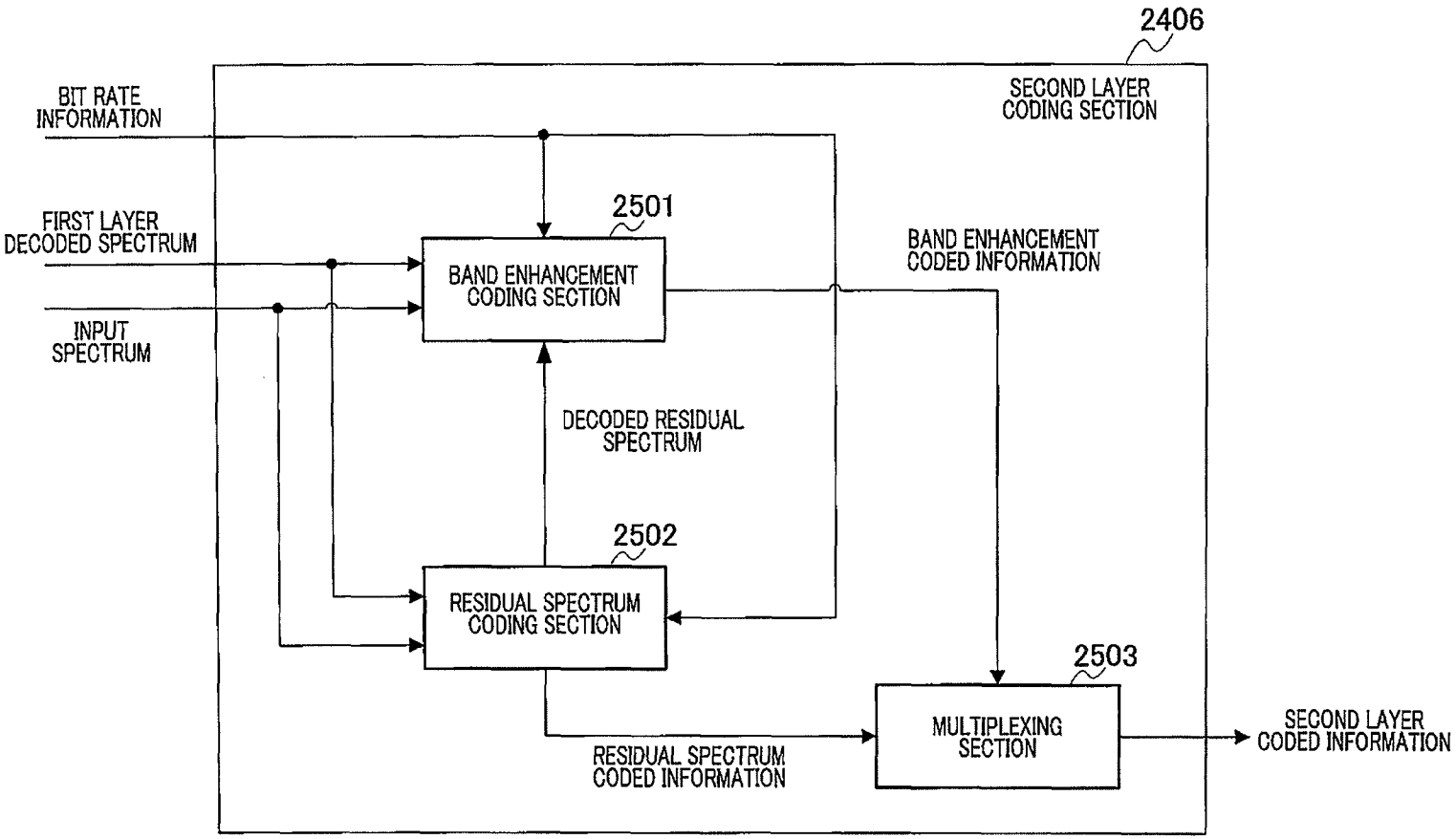
FIG. 25 is a block diagram showing the internal principal-part configuration of the second layer coding section shown in FIG. 24.

The internal principal-part configuration of second layer coding section 2406 shown in FIG. 24 will now be described with reference to FIG. 25.

Second layer coding section 2406 mainly comprises band enhancement coding section 2501, residual spectrum coding section 2502, and multiplexing section 2503. These sections perform the following operations.

First layer decoded spectrum C1(*k*) and input spectrum X(k) are input to band enhancement coding section 2501 from orthogonal transform processing section 2405. Also, bit rate information is input to band enhancement coding section 2501 from outside. Furthermore, decoded residual spectrum D1(*k*) is input to band enhancement coding section 2501 from residual spectrum coding section 2502. Band enhancement coding section 2501 calculates band enhancement coded information from input first layer decoded spectrum C1(*k*), input spectrum X(k), bit rate information, and decoded residual spectrum D1(*k*), and outputs this band enhancement coded information to multiplexing section 2503. Details of the processing performed by band enhancement coding section 2501 will be given later herein.

First layer decoded spectrum C1(*k*) and input spectrum X(k) are input to residual spectrum coding section 2502 from orthogonal transform processing section 2405. Also, bit rate information is input to residual spectrum coding section 2502 from outside. Residual spectrum coding section 2502 calculates residual spectrum coded information from input first layer decoded spectrum C1(*k*), input spectrum X(k), and bit rate information, and outputs this residual spectrum coded information to multiplexing section 2503. Also, residual spectrum coding section 2502 outputs decoded residual spectrum D1(*k*) obtained by decoding the residual spectrum coded information to band enhancement coding section 2501. Details of the processing performed by residual spectrum coding section 2502 and residual spectrum coded information will be given later herein.

Multiplexing section 2503 multiplexes band enhancement coded information and residual spectrum coded information input from band enhancement coding section 2501 and residual spectrum coding section 2502 respectively, and generates second layer coded information. Then multiplexing section 2503 outputs the obtained second layer coded information to coded information integration section 2407. Band enhancement coded information and residual spectrum coded information may also be input directly to coded information integration section 2407, and multiplexed by coded information integration section 2407.

Figure 26:
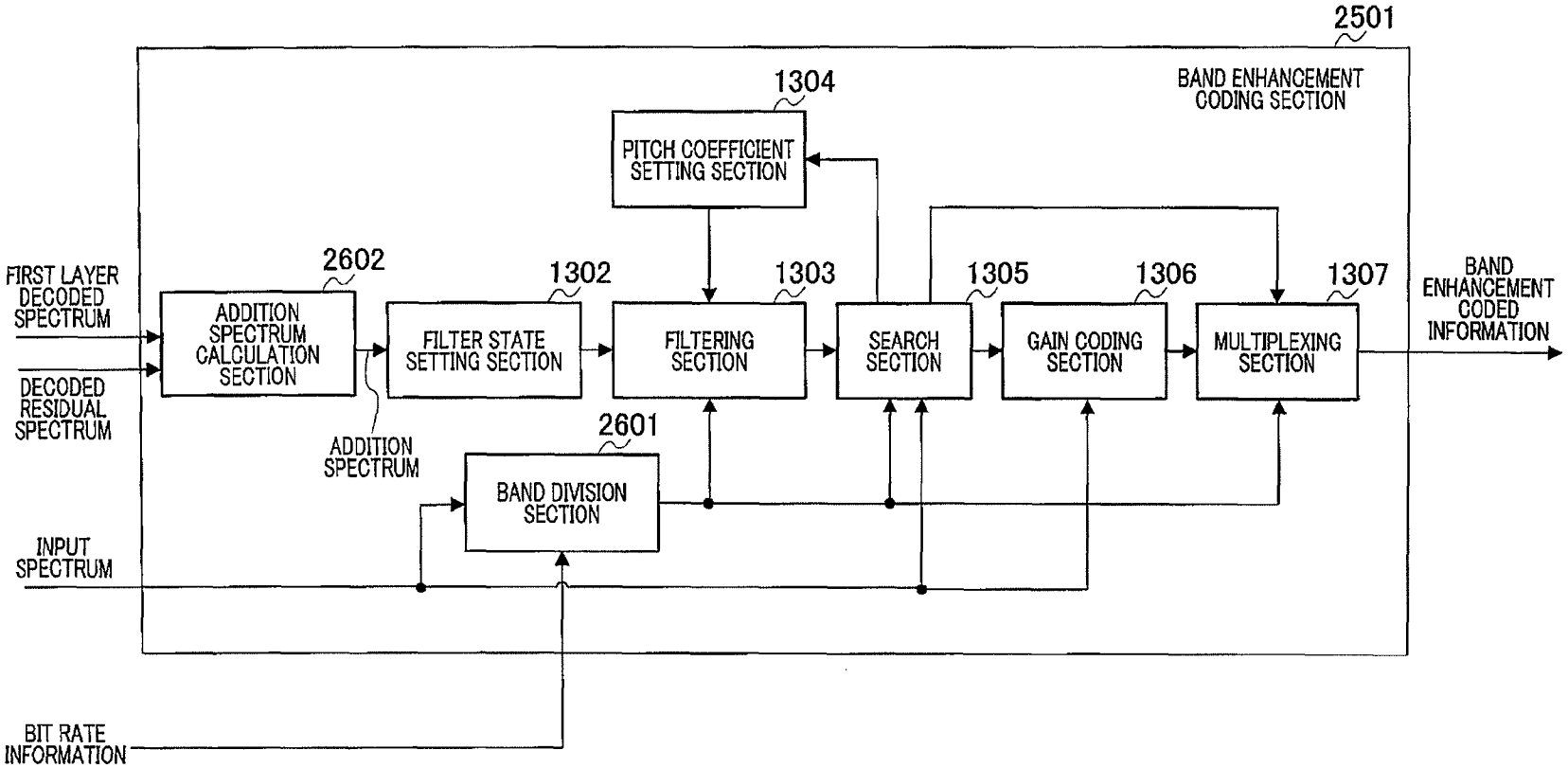
FIG. 26 is a block diagram showing the internal principal-part configuration of the band enhancement coding section shown in FIG. 25.

FIG. 26 is a block diagram showing the internal configuration of band enhancement coding section 2501. Band enhancement coding section 2501 is provided with band division section 2601, addition spectrum calculation section 2602, filter state setting section 1302, filtering section 1303, search section 1305, pitch coefficient setting section 1304, gain coding section 1306, and multiplexing section 1307, which perform the operations described below. With the exception of band division section 2601 and addition spectrum calculation section 2602, the above configuration elements perform similar processing to that of identically named configuration elements shown in FIG. 15, and therefore descriptions thereof are omitted here. However, for filter state setting section 1302 only, processing differs from that of the identically named configuration element shown in FIG. 15 in terms of the name of an input spectrum and the input source configuration element name.

Input spectrum X(k) is input to band division section 2601 from orthogonal transform processing section 2405. Also, bit rate information is input to band division section 2601 from outside. Band division section 2601 divides a high-band part of input spectrum X(k) into P subbands $SB_p$ (p=0, 1, . . . , P−1) according to the bit rate information.

Specifically, if the bit rate information indicates that the coding bit rate is BR1, band division section 2601 divides a part for which the band is greater than or equal to Max1 (Max1≤k<Fmax) within input spectrum X(k) into P subbands $SB_p$ (p=0, 1, . . . , P−1). Also, if the bit rate information indicates that the coding bit rate is BR2, band division section 2601 divides a part for which the band is greater than or equal to Max2 (Max2≤k<Fmax) within input spectrum X(k) into P subbands $SB_p$ (p=0, 1, . . . , P−1). And if the bit rate information indicates that the coding bit rate is BR3, band division section 2601 divides a part for which the band is greater than or equal to Max3 (Max3≤k<Fmax) within input spectrum X(k) into P subbands $SB_p$ (p=0, 1, . . . , P−1).

Here, Fmax is the maximum band value, and the relationship of Max1, Max2, and Max3 is Max1<Max2<Max3.

That is to say, if bit rate information indicates that the coding bit rate is BR1, a wide setting is made for a high-band part of an input spectrum subject to band enhancement coded information calculation by band enhancement coding section 2501. Also, if bit rate information indicates that the coding bit rate is BR3, a narrow setting is made for a high-band part of an input spectrum subject to band enhancement coded information calculation by band enhancement coding section 2501. And if bit rate information indicates that the coding bit rate is BR2, a setting between the above two(wide setting and narrow setting) is made for a high-band part of an input spectrum subject to band enhancement coded information calculation.

Then band division section 2601 outputs bandwidth $BW_p$ (p=0, 1, . . . , P−1) and initial index $BS_p$ (p=0, 1, . . . , P−1) of each subband to filtering section 1303, search section 1305, and multiplexing section 1307 as band division information. Below, a part in subband $SB_p$ within input spectrum X(k) is denoted as subband spectrum $X_p(k)$ ($BS_p \le k < BS_p + BW_p$).

First layer decoded spectrum C1(*k*) is input to addition spectrum calculation section 2602 from orthogonal transform processing section 2405. Also, decoded residual spectrum D1(*k*) is input to addition spectrum calculation section 2602 from residual spectrum coding section 2502. Addition spectrum calculation section 2602 adds these two spectra in the frequency domain as shown in equation 31, and calculates addition spectrum A(k). Then addition spectrum calculation section 2602 outputs addition spectrum A(k) to filter state setting section 1302.

[31]

$$A(k)=C1(k)+D1(k)(k=0,\ldots Fmax) \quad \text{(Equation 31)}$$

Thereafter, in the same way as in Embodiment 2, band enhancement coded information is generated by means of filter state setting section 1302, filtering section 1303, search section 1305, pitch coefficient setting section 1304, gain coding section 1306, and multiplexing section 1307, and the band enhancement coded information is output to multiplexing section 2503.

In Embodiment 2, filter state setting section 1302 set first layer decoded spectrum C(k) input from orthogonal transform processing section 1005 as a filter state used by filtering section 1303. In contrast, in this embodiment, filter state setting section 1302 sets addition spectrum A(k) input from addition spectrum calculation section 2602 as a filter state used by filtering section 1303. Then addition spectrum A(k) is stored as a filter internal state (filter state) in an entire frequency band 0≤k<Fmax spectrum S(k) low-band part ((0≤k<Max1) or (0≤k<Max2)) band in filtering section 1303.

Figure 27:
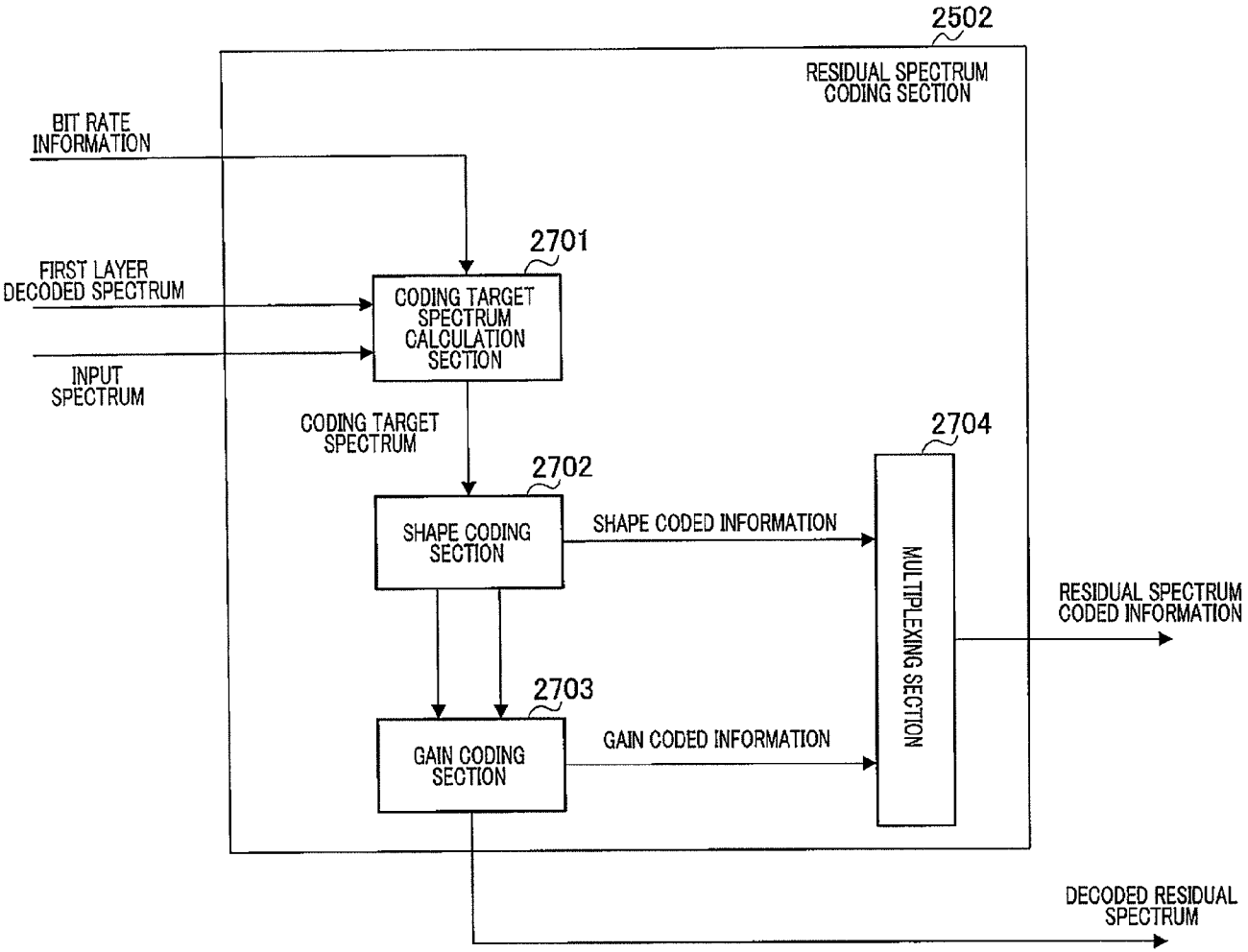
FIG. 27 is a block diagram showing the internal principal-part configuration of the residual spectrum coding section shown in FIG. 25.

FIG. 27 is a block diagram showing the internal configuration of residual spectrum coding section 2502. Residual spectrum coding section 2502 mainly comprises coding target spectrum calculation section 2701, shape coding section 2702, gain coding section 2703, and multiplexing section 2704. These sections perform the following operations.

Input spectrum X(k) and first layer decoded spectrum C1(*k*) are input to coding target spectrum calculation section 2701 from orthogonal transform processing section 2405. Also, bit rate information is input to coding target spectrum calculation section 2701 from outside. Coding target spectrum calculation section 2701 first calculates difference spectrum B(k) between input spectrum X(k) and first layer decoded spectrum C1(*k*). Below, a part in subband $SB_p$ within difference spectrum B(k) is denoted as subband spectrum $B_p(k)$ ($BS_p \le k < BS_p + BW_p$).

[32]

$$B(k)=X(k)-C1(k)(k=0,\ldots,Fmax) \quad \text{(Equation 32)}$$

Then, coding target spectrum calculation section 2701 sets a partial band spectrum within difference spectrum B(k) obtained by means of equation 32 as an coding target spectrum according to the bit rate information.

Specifically, if the bit rate information indicates that the coding bit rate is BR1, coding target spectrum calculation section 2701 sets a part for which the band is less than or equal to Max1 (0≤k<Max1) within difference spectrum B(k) as coding target spectrum D(k). Also, if the bit rate information indicates that the coding bit rate is BR2, band division section 2601 sets a part for which the band is less than or equal to Max2 (0≤k<Max2) within difference spectrum B(k) as coding target spectrum D(k). And if the bit rate information indicates that the coding bit rate is BR3, band division section 2601 sets a part for which the band is less than or equal to Max3 (0≤k<Max3) within difference spectrum B(k) as coding target spectrum D(k).

As stated above, the relationship of Max1, Max2, and Max3 is Max1≤Max2<Max3.

That is to say, if bit rate information indicates that the coding bit rate is BR1, coding target spectrum calculation section 2701 makes a narrow bandwidth setting for spectrum (coding target spectrum) D(k) subject to coding by residual spectrum coding section 2502. Also, if bit rate information indicates that the coding bit rate is BR3, coding target spectrum calculation section 2701 makes a wide coding target spectrum bandwidth setting. And if bit rate information indicates that the coding bit rate is BR2, coding target spectrum calculation section 2701 sets a coding target spectrum bandwidth between the above two (between wide setting and narrow setting).

Then coding target spectrum calculation section 2701 outputs set coding target spectrum D(k) to shape coding section 2702.

Shape coding section 2702 performs quantization on a subband-by-subband basis on coding target spectrum D(k) input from coding target spectrum calculation section 2701. Specifically, shape coding section 2702 first divides coding target spectrum D(k) into L subbands. Then, for each of the L subbands, shape coding section 2702 searches an internal shape codebook comprising SQ shape code vectors, and finds an index of a shape code vector for which evaluation measure Shape_q(i) in equation 33 below is maximal.

(Equation 33)

$$\text{Shape_q}(i) = \frac{\left\{\sum_{k=0}^{BW(j)} (D(k+BS(j)) \cdot SC_k^i)\right\}^2}{\sum_{k=0}^{BW(j)} SC_k^i \cdot SC_k^i} \quad [33]$$

$$(j = 0, \ldots, L-1,\ i = 0, \ldots, SQ-1)$$

In this equation, $SC^i_k$ indicates a shape code vector configuring a shape codebook, i indicates a shape code vector index, and k indicates a shape code vector element index. Also, BW(j) represents the bandwidth of a band for which the band index is j, and BS(j) represents the minimum index of a spectrum configuring a band for which the band index is j.

Shape coding section 2702 outputs shape code vector index S_max for which evaluation measure Shape_q(i) in equation 33 above is maximal to multiplexing section 2704 as shape coded information. Also, shape coding section 2702 calculates ideal gain Gain_i(j) in accordance with equation 34 below, and outputs this to gain coding section 2703.

(Equation 34)

$$\text{Gain_i}(j) = \frac{\left\{\sum_{k=0}^{BW(j)} \left(D(k+BS(j)) \cdot SC_k^{S_max}\right)\right\}}{\sum_{k=0}^{BW(j)} SC_k^{S_max} \cdot SC_k^{S_max}} \quad [34]$$

$$(j = 0, \ldots, L-1)$$

Also, shape coding section 2702 outputs a shape information decoded value obtained by performing inverse quantization (local decoding) of shape coded information to gain coding section 2703. Here, a shape information decoded value found as a shape value is denoted as Shape_q'(k).

Gain coding section 2703 directly quantizes ideal gain Gain_i(j) input from shape coding section 2702 in accordance with equation 9. Here too, gain coding section 2703 treats ideal gain as an L-dimensional vector, searches an internal gain codebook comprising GQ gain code vectors, and performs vector quantization.

Gain coding section 2703 finds gain code vector index G_min that minimizes square error Gain_q(i) in equation 9. Gain coding section 2703 outputs G_min to multiplexing section 2704 as gain coded information.

Also, gain coding section 2703 applies a gain information decoded value obtained by performing inverse quantization (local decoding) on gain coded information to a shape information decoded value input from shape coding section 2702, and calculates a residual spectrum decoded value (hereinafter referred to as decoded residual spectrum D1(*k*)) as shown in equation 35. Here, in equation 35, Shape_q'(k) is a decoded shape value and Gain_q'(k) indicates a decoded gain.

(Equation 35)

$$D1(k) = \text{Gain_q}'(j) \cdot \text{Shape_q}'(k) \begin{pmatrix} k = BL_j, \ldots, BH_j \\ j = 0, \ldots, L-1 \end{pmatrix} \quad [35]$$

Then gain coding section 2703 outputs decoded residual spectrum D1(*k*) to band enhancement coding section 2501.

Multiplexing section 2704 multiplexes shape coded information and gain coded information input from shape coding section 2702 and gain coding section 2703 respectively, and outputs the multiplexed information to multiplexing section 2503 as residual spectrum coded information.

This concludes a description of the configuration of encoding apparatus 131.

Figure 28:
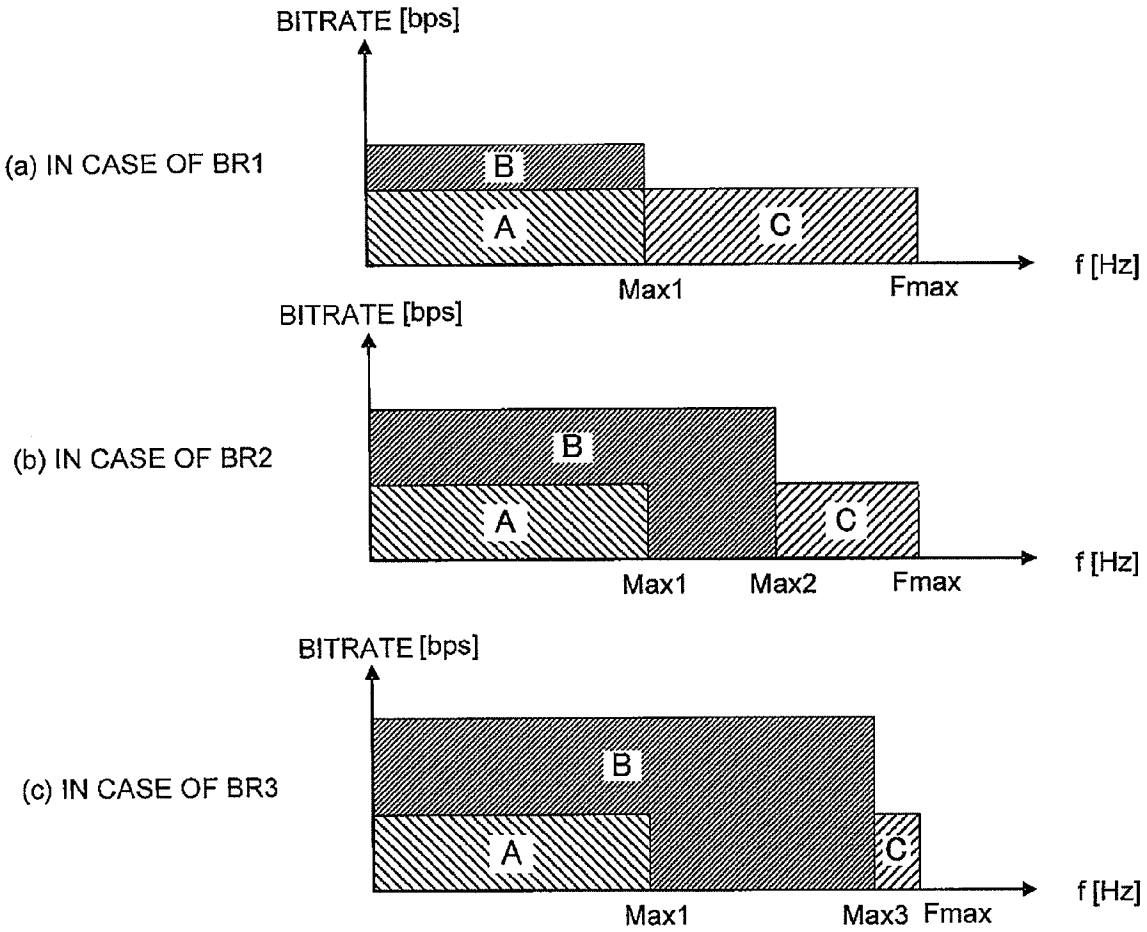
FIG. 28 is a drawing showing conceptually a correspondence relationship between an encoded/decoded spectrum band and amount of information (coding bit rate) in each layer.

A conceptual diagram of coding processing with an above-described configuration and decoding processing with a configuration described later herein is shown in FIG. 28. FIG. 28 is a drawing showing conceptually a correspondence relationship between an encoded/decoded spectrum band and amount of information (coding bit rate) in a coding section/decoding section of each layer.

In FIG. 28, part "A" indicates a band of a spectrum encoded/decoded by first layer coding section 2402 and first layer decoding section 2403. Also, part "B" indicates a band of a spectrum encoded/decoded by residual spectrum coding section 2502 and residual spectrum decoding section 2902 described later herein within a band of a spectrum encoded/decoded by second layer coding section 2406 and second layer decoding section 2805 described later herein. And part "C" indicates a band of a spectrum encoded/decoded by band enhancement coding section 2501 and band enhancement decoding section 2903 described later herein within a band of a spectrum encoded/decoded by second layer coding section 2406 and second layer decoding section 2805 described later herein.

If bit rate information indicates that the coding bit rate is a low bit rate (BR1), band enhancement coding section 2501 and band enhancement decoding section 2903 make corresponding part "C" wide, and residual spectrum coding section 2502 and residual spectrum decoding section 2902 make corresponding part "B" narrow (see FIG. 28(*a*)). On the other hand, if bit rate information indicates that the coding bit rate is a high bit rate (BR3), band enhancement coding section 2501 and band enhancement decoding section 2903 make corresponding part "C" narrow, and residual spectrum coding section 2502 and residual spectrum decoding section 2902 make corresponding part "B" wide (see FIG. 28(*c*)). And if bit rate information indicates that the coding bit rate is BR2, band enhancement coding section 2501 and band enhancement decoding section 2903 make a corresponding part "C" setting approximately midway between that when the coding bit rate is BR1 and that when the coding bit rate is BR3 (see FIG. 28(*b*)).

Thus, in this embodiment, a band of a spectrum that is encoded/decoded by a coding section/decoding section is set adaptively according to a coding bit rate indicated by bit rate information. By this means, an input signal can be encoded/decoded efficiently even if the coding bit rate changes.

Decoding apparatus 133 according to this embodiment will now be described.

Figure 29:
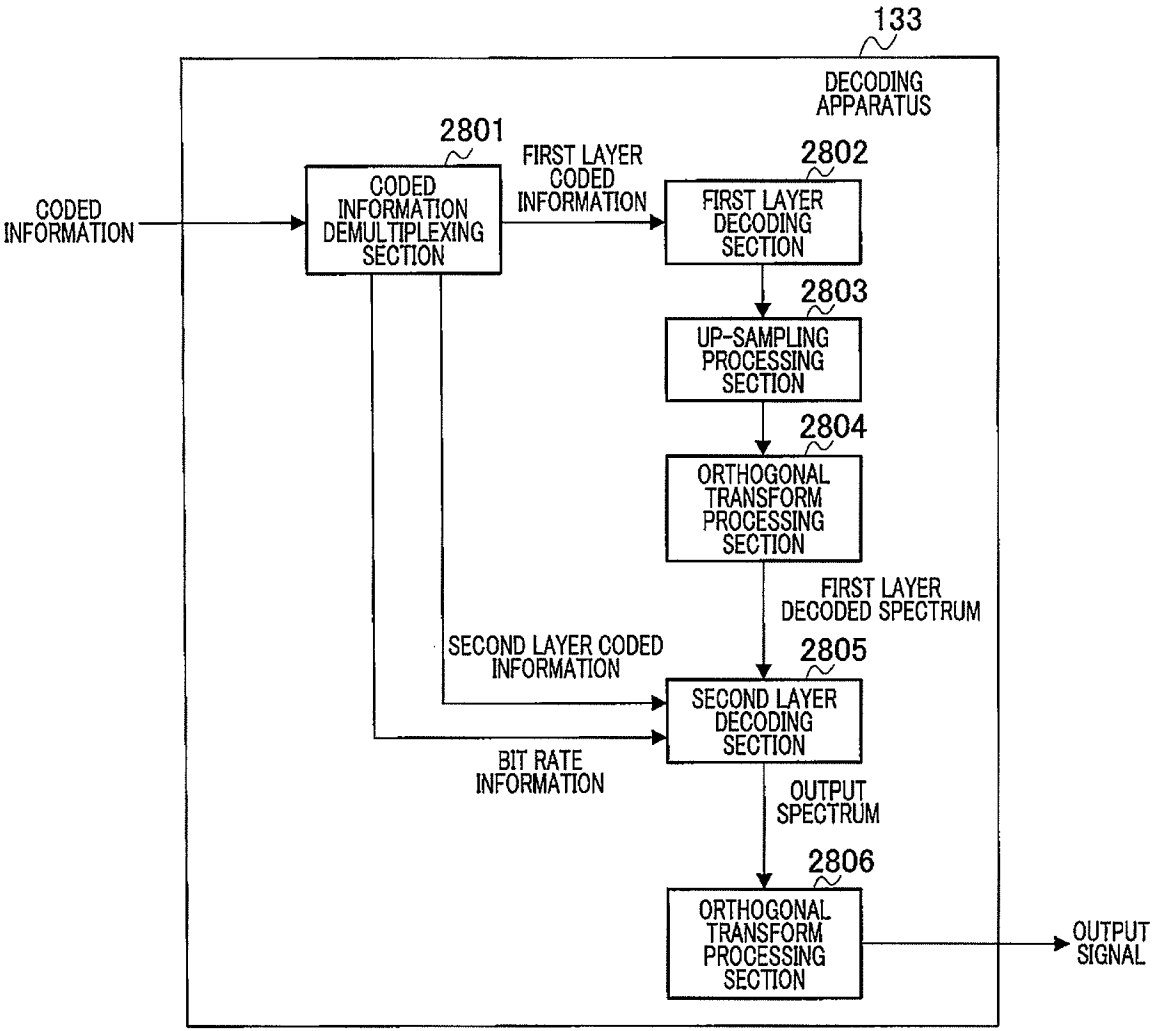
FIG. 29 is a block diagram showing the internal principal-part configuration of a decoding apparatus according to Embodiment 4 of the present invention.

FIG. 29 is a block diagram showing the internal principal-part configuration of decoding apparatus 133. Decoding apparatus 133 mainly comprises coded information demultiplexing section 2801, first layer decoding section 2802, up-sampling processing section 2803, orthogonal transform processing section 2804, second layer decoding section 2805, and orthogonal transform processing section 2806. These sections perform the following operations.

Coded information transmitted from encoding apparatus 131 via channel 102 is input to coded information demultiplexing section 2801. Coded information demultiplexing section 2801 demultiplexes the input coded information into first layer coded information, second layer coded information, and bit rate information, outputs the first layer coded information to first layer decoding section 2802, and outputs the second layer coded information and bit rate information to second layer decoding section 2805.

First layer decoding section 2802 decodes the first layer coded information input from coded information demultiplexing section 2801 and generates a first layer decoded signal, and outputs the generated first layer decoded signal to up-sampling processing section 2803. The operation of first layer decoding section 2802 is similar to that of first layer decoding section 2403 shown in FIG. 24, and therefore a detailed description thereof is omitted here.

Up-sampling processing section 2803 performs up-sampling of the sampling frequency of a first layer decoded signal input from first layer decoding section 2802 from $SR_{base}$ to $SR_{input}$, and outputs an obtained post-up-sampling first layer decoded signal to orthogonal transform processing section 2804.

Orthogonal transform processing section 2804 performs orthogonal transform processing (MDCT) on a post-up-sampling first layer decoded signal input from up-sampling processing section 2803. Then orthogonal transform processing section 2804 outputs obtained post-up-sampling first layer decoded signal MDCT coefficient (hereinafter referred to as first layer decoded spectrum) C1(*k*) to second layer decoding section 2805. The operation of orthogonal transform processing section 2804 is similar to the processing on a post-up-sampling first layer decoded signal by orthogonal transform processing section 2405 shown in FIG. 24, and therefore a detailed description thereof is omitted here.

Second layer decoding section 2805 generates output spectrum C2(*k*) using a high-band component using first layer decoded spectrum C1(*k*) input from orthogonal transform processing section 2804 and second layer coded information and bit rate information input from coded information demultiplexing section 2801. Then second layer decoding section 2805 outputs generated output spectrum C2(*k*) to orthogonal transform processing section 2806. Details of the processing performed by second layer decoding section 2805 will be given later herein.

Orthogonal transform processing section 2806 executes an orthogonal transform on output spectrum C2(*k*) input from second layer decoding section 2805, and converts it to a time-domain signal. Orthogonal transform processing section 2806 outputs the obtained signal as an output signal. The operation of orthogonal transform processing section 2806 is similar to the processing by orthogonal transform processing section 802 shown in FIG. 8, and therefore a detailed description thereof is omitted here.

Figure 30:
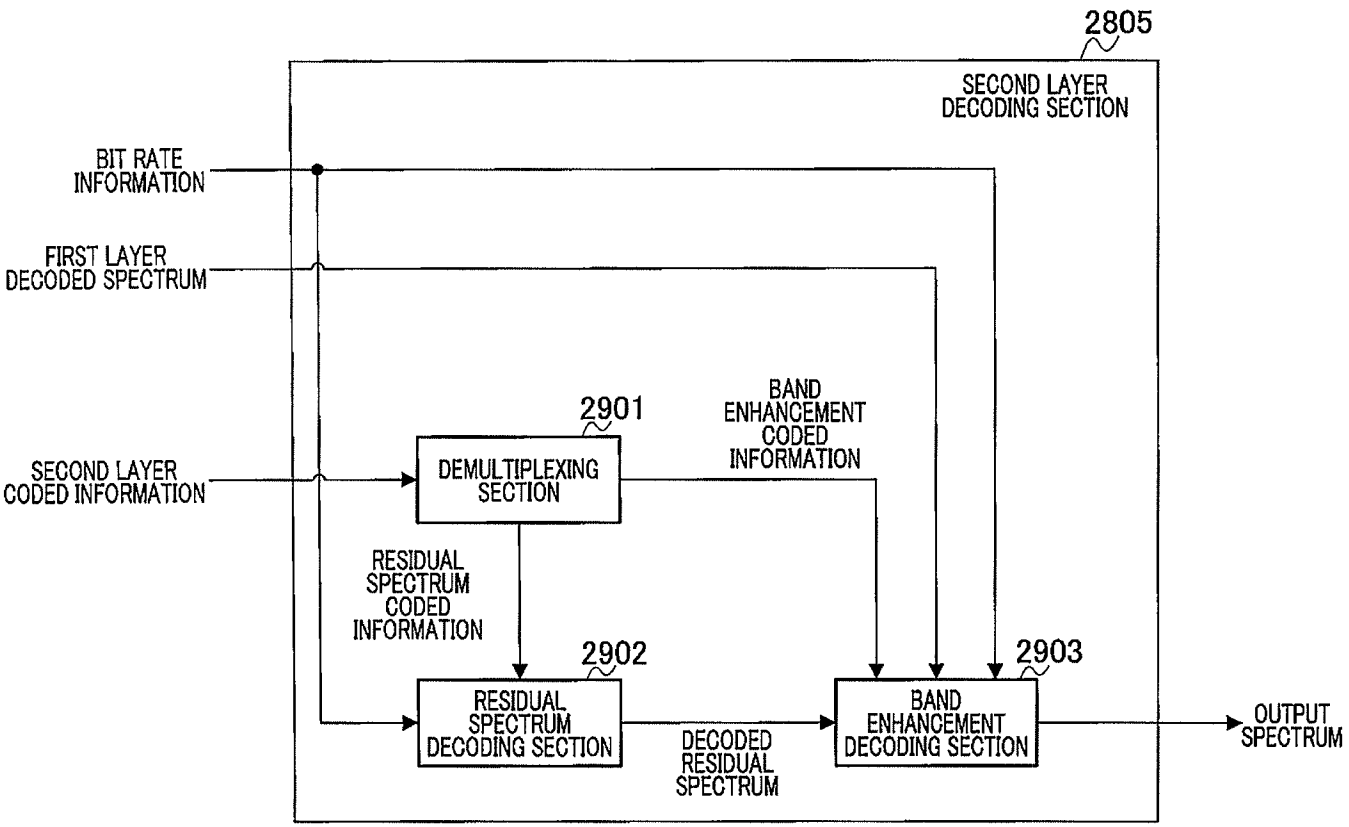
FIG. 30 is a block diagram showing the internal principal-part configuration of the second layer decoding section shown in FIG. 29.

FIG. 30 is a block diagram showing the internal configuration of second layer decoding section 2805 shown in FIG. 29. Second layer decoding section 2805 mainly comprises demultiplexing section 2901, residual spectrum decoding section 2902, and band enhancement decoding section 2903.

Second layer coded information is input to demultiplexing section 2901 from coded information demultiplexing section 2801. Demultiplexing section 2901 demultiplexes the second layer coded information into residual spectrum coded information and band enhancement coded information. Demultiplexing section 2901 outputs the residual spectrum coded information to residual spectrum decoding section 2902, and outputs the band enhancement coded information to band enhancement decoding section 2903. If demultiplexing into residual spectrum coded information and band enhancement coded information has been performed in coded information demultiplexing section 2801, demultiplexing section 2901 need not be provided.

Residual spectrum decoding section 2902 decodes residual spectrum coded information input from demultiplexing section 2901, and calculates decoded residual spectrum D1(*k*). Then residual spectrum decoding section 2902 outputs obtained decoded residual spectrum D1(*k*) to band enhancement decoding section 2903. Details of the processing performed by residual spectrum decoding section 2902 will be given later herein.

Band enhancement coded information is input to band enhancement decoding section 2903 from demultiplexing section 2901. Also, first layer decoded spectrum C1(*k*) is input to band enhancement decoding section 2903 from orthogonal transform processing section 2804. Furthermore, bit rate information is input to band enhancement decoding section 2903 from coded information demultiplexing section 2801. In addition, decoded residual spectrum D1(*k*) is input to band enhancement decoding section 2903 from residual spectrum decoding section 2902. Band enhancement decoding section 2903 calculates output spectrum C2(*k*) from these items of information, and outputs this to orthogonal transform processing section 2806. Details of the processing performed by band enhancement decoding section 2903 will be given later herein.

Figure 31:
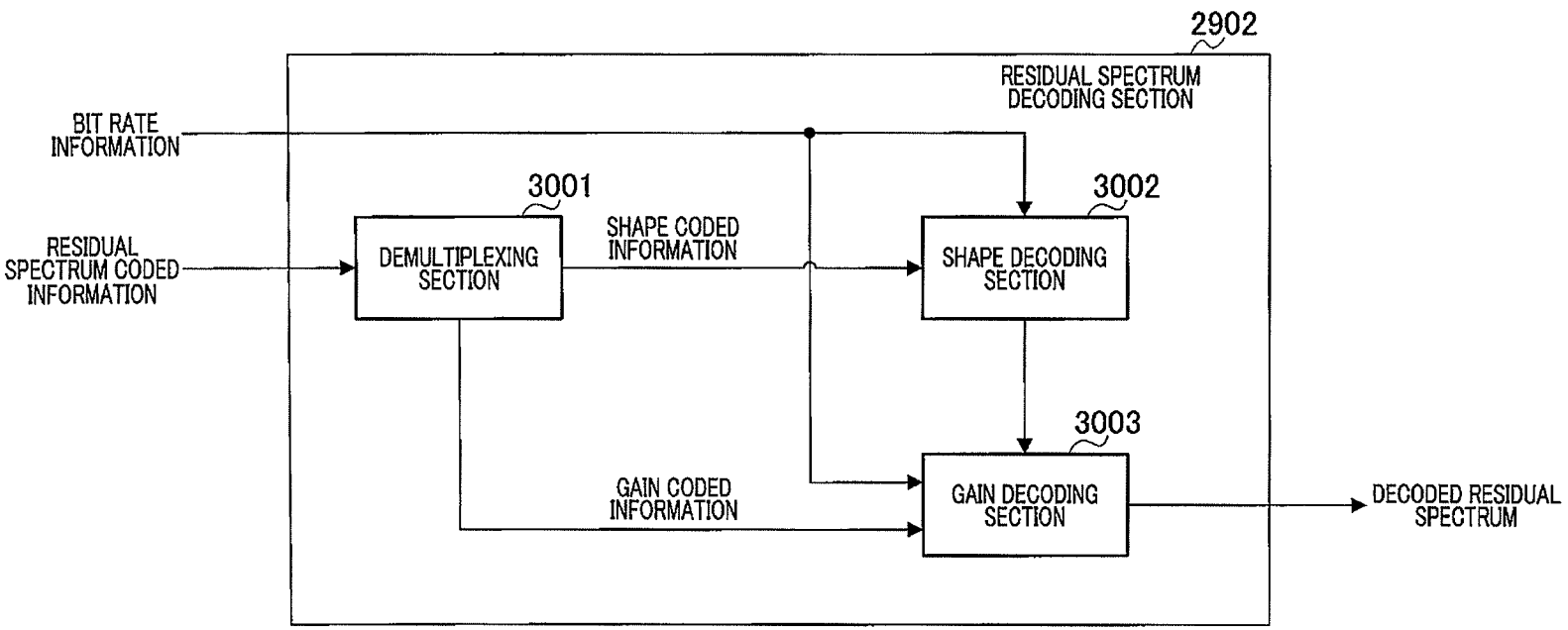
FIG. 31 is a block diagram showing the internal principal-part configuration of the residual spectrum decoding section shown in FIG. 30.

FIG. 31 is a block diagram showing the internal configuration of residual spectrum decoding section 2902. Residual spectrum decoding section 2902 mainly comprises demultiplexing section 3001, shape decoding section 3002, and gain decoding section 3003.

Residual spectrum coded information is input to demultiplexing section 3001 from demultiplexing section 2901. Demultiplexing section 3001 demultiplexer the residual spectrum coded information into shape coded information and gain coded information, outputs the shape coded information to shape decoding section 3002, and outputs the gain coded information to gain decoding section 3003.

Shape coded information is input to shape decoding section 3002 from demultiplexing section 3001. Also, bit rate information is input to shape decoding section 3002 from coded information demultiplexing section 2801. Shape decoding section 3002 incorporates a shape codebook of the same kind as the shape codebook with which shape coding section 2702 is provided, and searches the shape codebook with shape coded information S_max input from demultiplexing section 3001 as an index. Shape decoding section 3002 outputs a found shape code vector to gain decoding section 3003 as a shape value of a band spectrum corresponding to bit rate information input from coded information demultiplexing section 2801. Here, a shape code vector found as a shape value is denoted as Shape_q'(k).

Here, shape decoding section 3002 calculates a band corresponding to bit rate information by means of the same kind of method as described for coding target spectrum calculation section 2701.

Gain decoding section 3003 incorporates a gain codebook of the same kind as the gain codebook with which gain coding section 2703 is provided, and uses this gain codebook to perform inverse quantization of a gain value from gain coded information in accordance with equation 16. Here too, a gain value is treated as an L-dimensional vector, and vector inverse quantization is performed. That is to say, gain code vector $GC_j^{G_min}$ corresponding to gain coded information G_min is taken directly as gain value Gain_q'(j).

Then, using a gain value obtained by inverse quantization and a shape value input from shape decoding section 3002, gain decoding section 3003 calculates decoded residual spectrum D1(*k*) for a band corresponding to bit rate information input from coded information demultiplexing section 2801 in accordance with equation 35, and outputs calculated decoded residual spectrum D1(*k*) to band enhancement decoding section 2903. In spectrum (MDCT coefficient) inverse quantization, if k is present in B(j") through B(j"+1)−1, gain value Gain_q'(j) has the value of Gain_q'(j").

As with shape decoding section 3002, gain decoding section 3003 calculates a band corresponding to bit rate information by means of the same kind of method as described for coding target spectrum calculation section 2701.

Figure 32:
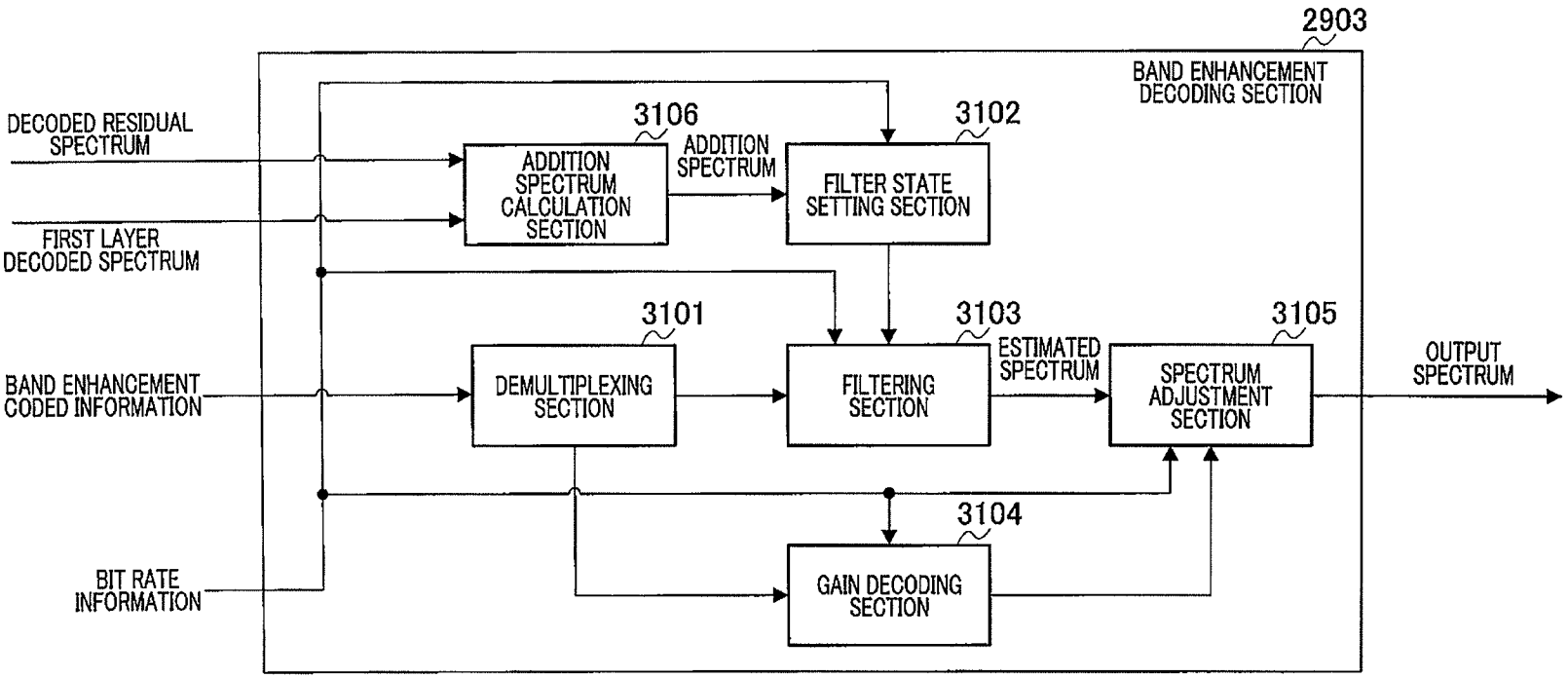
FIG. 32 is a block diagram showing the internal principal-part configuration of the band enhancement decoding section shown in FIG. 30.

FIG. 32 is a block diagram showing the internal configuration of band enhancement decoding section 2903 shown in FIG. 30. Band enhancement decoding section 2903 mainly comprises demultiplexing section 3101, filter state setting section 3102, filtering section 3103, gain decoding section 3104, spectrum adjustment section 3105, and addition spectrum calculation section 3106.

Demultiplexing section 3101 demultiplexes band enhancement coded information input from demultiplexing section 2901 into optimum pitch coefficient T', which is filtering related information, and a post-coding variation $V_q(j)$ index, which is gain related information. Then demultiplexing section 3101 outputs optimum pitch coefficient T' to filtering section 3103, and outputs the post-coding variation $V_q(j)$ index to gain decoding section 3104. If demultiplexing into optimum pitch coefficient T' and a post-coding variation $V_q(j)$ index has been performed in coded information demultiplexing section 2801 or demultiplexing section 2901, demultiplexing section 3101 need not be provided.

First layer decoded spectrum C1(*k*) is input to addition spectrum calculation section 3106 from orthogonal transform processing section 2804. Also, decoded residual spectrum D1(*k*) is input to addition spectrum calculation section 3106 from residual spectrum decoding section 2902. Addition spectrum calculation section 3106 adds these two spectra in the frequency domain as shown in equation 31, and calculates addition spectrum A(k). Then addition spectrum calculation section 3106 outputs addition spectrum A(k) to filter state setting section 3102.

Filter state setting section 3102 sets addition spectrum A(k) input from addition spectrum calculation section 3106 as a filter state used by filtering section 3103. Here, if an entire frequency band 0≤k<Fmax spectrum in filtering section 3103 is called Z(k) for convenience, of spectrum Z(k), addition spectrum A(k) is stored in a band corresponding to bit rate information as a filter internal state (filter state). The configuration and operation of filter state setting section 3102 are similar to those of filter state setting section 502 shown in FIG. 5, and therefore a detailed description thereof is omitted here.

Filtering section 3103 is provided with a multi-tap pitch filter (that is, the number of taps is greater than 1). Filtering section 3103 filters addition spectrum A(k) for a band corresponding to bit rate information input from coded information demultiplexing section 2801 based on a filter state set by filter state setting section 3102, pitch coefficient T' input from demultiplexing section 3101, and a filter coefficient stored internally beforehand. Then filtering section 3103 calculates estimated spectrum X'(k) of input spectrum X(k) as shown in equation 36.

(Equation 36)

$$X'(k) = \sum_{i=-1}^{1} \beta_i \cdot Z(k - T + i)^2 \quad [36]$$

Here, filter state setting section 3102 and filtering section 3103 use a high-band part of a spectrum calculated by means of the same kind of method as described for band division section 2601 as a band corresponding to bit rate information.

The transfer function shown in equation 13 is also used by filtering section 3103. Filtering section 3103 outputs estimated spectrum X'(k) obtained by filtering to spectrum adjustment section 3105.

Gain decoding section 3104 decodes a post-coding variation $V_q(j)$ index input from demultiplexing section 3101 for a band corresponding to bit rate information input from coded information demultiplexing section 2801, and finds post-coding variation $V_q(j)$, which is a variation V(j) quantization value. Here, the gain codebook used for decoding an index of post-coding variation $V_q(j)$ is incorporated in gain decoding section 3104, and is similar to the gain codebook used by gain coding section 506 shown in FIG. 5. Gain decoding section 3104 outputs post-coding variation $V_q(j)$ obtained by decoding to spectrum adjustment section 3105.

Here, gain decoding section 3104 uses a high-band part of a spectrum calculated by means of the same kind of method as described for band division section 2601 as a band corresponding to bit rate information.

Spectrum adjustment section 3105 multiplies estimated spectrum X'(k) input from filtering section 3103 by post-coding variation $V_q(j)$ of each subband input from gain decoding section 3104 for a high-band part specified by bit rate information input from coded information demultiplexing section 2801 in accordance with equation 37.

Here, spectrum adjustment section 3105 uses a high-band part of a spectrum calculated by means of the same kind of method as described for band division section 2601 as a band corresponding to bit rate information. By this means, spectrum adjustment section 3105 adjusts the spectrum shape in an estimated spectrum high-band part ((Max1≤k<Fmax) or (Max2≤k<Fmax) or (Max3≤k<Fmax)), generates output spectrum C2(*k*), and outputs this to orthogonal transform processing section 2806.

(Equation 37)

$$C2(k) = X'(k) \cdot V_q(j) \quad [37]$$

$$\left( \begin{array}{l} \mathrm{Max1} \le k < F\mathrm{max} \ \text{ or } \mathrm{Max2} \le k < F\mathrm{max} \ \text{ or } \mathrm{Max3} \le k < F\mathrm{max} \\ j = 0, \ldots, J-1 \end{array} \right)$$

In equation 37, j indicates a subband index when gain is encoded, and is set according to spectrum index k. That is to say, for spectrum index k included in a subband for which the subband index is j", estimated spectrum X'(k) is multiplied by $V_q(j")$.

Here, a low-band part ((0≤k<Max1) or (0≤k<Max2) or (Max3≤k<Fmax)) of output spectrum C2(*k*) comprises addition spectrum A(k) obtained by adding first layer decoded spectrum C1(*k*) and decoded residual spectrum D1(*k*), and a high-band part ((Max1≤k<Fmax) or (Max2≤k<Fmax) or (Max3≤k<Fmax)) of output spectrum C2(*k*) comprises post-spectrum-shape-adjustment estimated spectrum X'(k).

This concludes a description of the internal configuration of decoding apparatus 113.

Thus, according to this embodiment, an encoding apparatus/decoding apparatus employs a configuration whereby band setting according to a band enhancement method is switched adaptively according to conditions at the time of coding (for example, the coding bit rate). By this means, coding efficiency can be improved in line with conditions at the time of coding.

Specifically, for example, if the bit rate at the time of coding is a low bit rate, band division section 2601 makes a wide setting for a band generated by means of a band enhancement technology that is more effective with a low bit rate, and makes a narrow setting for a band quantized by means of a spectrum coding technology other than a band enhancement technology. Also, if the bit rate at the time of coding is a high bit rate, band division section 2601 makes a narrow setting for a band generated by means of a band enhancement technology, and makes a wide setting for a band quantized by means of a spectrum coding technology (a technology other than a band enhancement technology) that encodes a spectrum shape more precisely.

When performing band enhancement coding/decoding, an encoding apparatus/decoding apparatus can improve the coding efficiency of band enhancement coding by using a high-precision spectrum that can be obtained at the time of coding/decoding (an addition spectrum resulting from addition of a first layer decoded spectrum and decoded residual spectrum) as a low-band part decoded spectrum. In this way, the quality of a decoded signal can be greatly improved by means of the method described in this embodiment.

In this embodiment, a configuration has been described whereby a narrow setting is made for a band of a spectrum that is encoded/decoded by band enhancement coding section 2501 and band enhancement decoding section 2903 when bit rate information indicates that the coding bit rate is the highest bit rate, but the present invention is not limited to this. For example, the present invention can be applied in a similar way to a configuration whereby a band of a spectrum encoded/decoded by band enhancement coding section 2501 and band enhancement decoding section 2903 is eliminated. In this case, band enhancement coding section 2501 and band enhancement decoding section 2903 are unnecessary in second layer coding section 2406 and second layer decoding section 2805 respectively, and a spectrum of all bands becomes subject to quantization in residual spectrum coding section 2502 and residual spectrum decoding section 2902. Also, at this time, the entire amount of information (bits) that can be used by second layer coding section 2406 and second layer decoding section 2805 is assigned to residual spectrum coding section 2502 and residual spectrum decoding section 2902. A configuration such as described above in which a band encoded/decoded by a band enhancement coding section and band enhancement decoding section is eliminated has been confirmed by experimentation to be particularly effective when the coding bit rate is extremely high.

Figure 33:
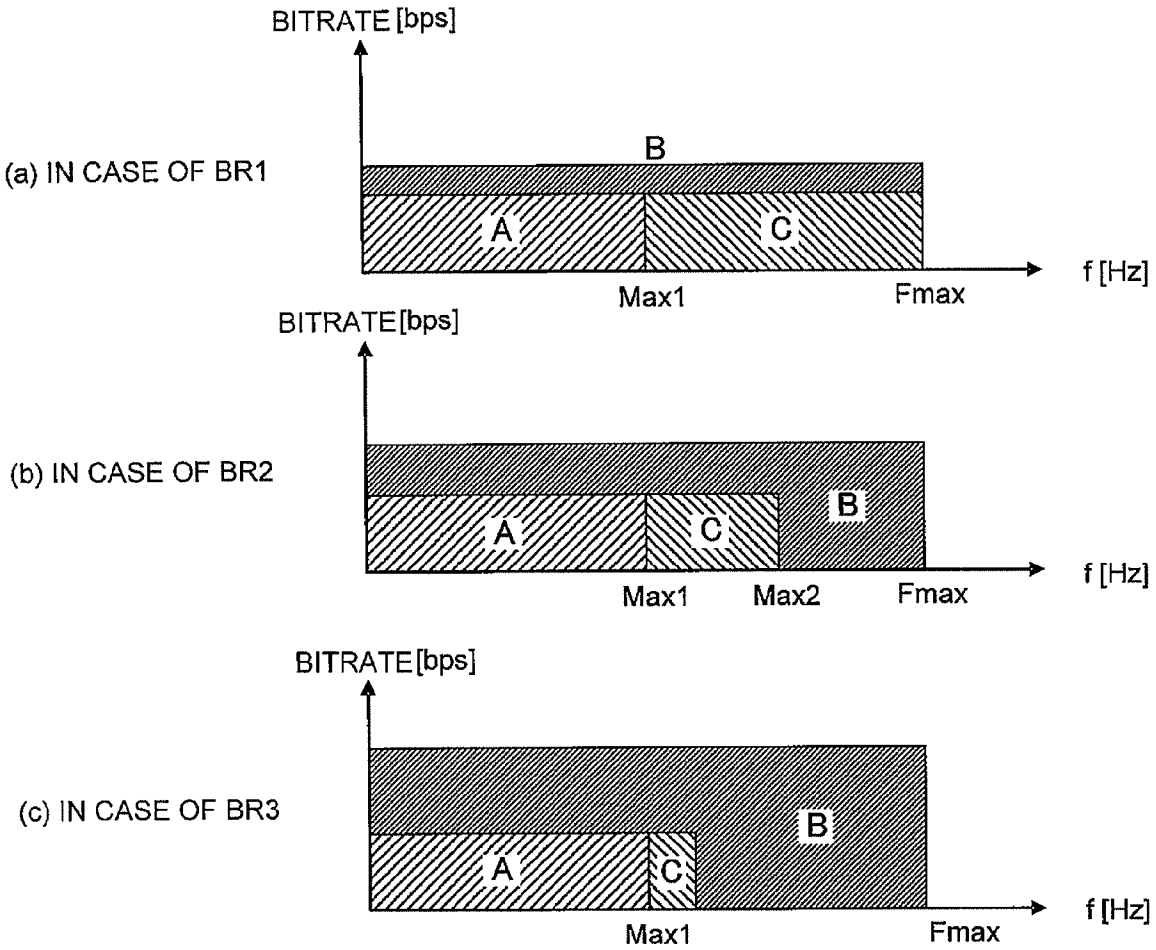
FIG. 33 is a drawing showing conceptually another correspondence relationship between an encoded/decoded spectrum band and amount of information (coding bit rate) in each layer.

In this embodiment, a case such as shown in FIG. 28 in which band "C" subject to coding by band enhancement coding section 2501 and band "B" subject to coding by residual spectrum coding section 2502 do not overlap in the frequency domain has been described as an example. However, the present invention is not limited to this, and can also be applied in a similar way to a configuration other than that shown in FIG. 28. For example, a conceptual diagram of another configuration is shown in FIG. 33. FIG. 33 is a drawing showing conceptually another correspondence relationship between an encoded/decoded spectrum band and amount of information (coding bit rate) in a coding section/decoding section of each layer.

In the case of a configuration such as shown in FIG. 33, processing that is partially different from the kind of coding processing described in this embodiment is performed. Specifically, in second layer coding section 2406, coding is first performed by residual spectrum coding section 2502, and then coding is performed by band enhancement coding section 2501 using a decoded residual spectrum. However, in the case of the configuration shown in FIG. 33, coding is first performed by band enhancement coding section 2501, and an obtained residual spectrum of a high-band spectrum and input spectrum is encoded by residual spectrum coding section 2502.

In this embodiment, a configuration whereby a low-band part is encoded/decoded by first layer coding section 2402 and first layer decoding section 2403 has been described as an example, but the present invention is not limited to this, and can also be applied in a similar way to a configuration in which first layer coding section 2402 and first layer decoding section 2403 are not present. At this time, a configuration is used in which residual spectrum coding section 2502 and residual spectrum decoding section 2902 encode/decode a band set for an input spectrum itself based on bit rate information.

In this embodiment, no particular explanation has been given of what kind of bit assignment is performed for band enhancement coding section 2501 and residual spectrum coding section 2502 according to bit rate information at the time of coding. An example of a possible bit assignment method is the use of a configuration whereby bits assigned to band enhancement coding section 2501 are always fixed, and bits assigned to residual spectrum coding section 2502 are variable. However, the present invention is not limited to a bit assignment method for band enhancement coding section 2501 and residual spectrum coding section 2502, and can also be applied in a similar way to a configuration that employs a bit assignment method other than the above. An example of a method other than the above is the use of a configuration whereby, as a coding bit rate indicated by bit rate information increases for band enhancement coding section 2501 and residual spectrum coding section 2502, the number of bits assigned to them both is increased. Another option is a configuration whereby, as a coding bit rate indicated by bit rate information increases, the number of bits assigned to band enhancement coding section 2501 is reduced, and the number of bits assigned to residual spectrum coding section 2502 is increased.

In the above description, a case in which a coding bit rate is used as an example of conditions at the time of coding has been taken as an example, and a case in which band setting is performed according to the coding bit rate has been described, but provision may also be made for the input signal sampling frequency or a coding parameter such as a quantization gain to be used instead of the coding bit rate. If band setting is performed according to the input signal sampling frequency, a possible configuration example is one whereby processing when the coding bit rate is a low bit rate in this embodiment is used if the sampling frequency is greater than or equal to a predetermined threshold value, and processing when the coding bit rate is a high bit rate in this embodiment is used if the sampling frequency is less than the threshold value. Also, with regard to a coding parameter such as quantization gain, a possible configuration example is one whereby processing when the coding bit rate is a low bit rate in this embodiment is used if, for example, gain sampled by the first layer coding section (adaptive excitation gain, fixed excitation gain, or the like) is greater than or equal to a predetermined threshold value, and processing when the coding bit rate is a high bit rate in this embodiment is used if this gain is less than the threshold value.

This concludes a description of embodiments of the present invention.

In the above embodiments, a band setting section decides band setting information according to an energy ratio of a low-band part and high-band part of an input spectrum or a difference spectrum between an input spectrum and first layer decoded spectrum. However, the present invention is not limited to this, and can also be applied in a similar way to a configuration in which band setting information is decided using other information. One example of such a configuration is one whereby tonality analysis is performed on an input spectrum or a difference spectrum between an input spectrum and first layer decoded spectrum, and the band setting section decides band setting information by the degree of tonality. In this case, it is necessary for a configuration element that calculates tonality to be newly provided. A tonality calculation method (detection method) used in this case is disclosed in detail in Patent Literature 2 and so forth.

Specifically, if input signal tonality is low—that is, if an input signal has a marked tendency toward being speech—the band setting section makes a narrower setting for a low-band part and a wider setting for a high-band part. This corresponds to a case in which the value of band setting information Band_Setting is 0 in these embodiments. By this means, low-band part spectral data that greatly influences the quality of a decoded signal when an input signal is speech can be encoded intensively by means of a shape-gain coding method, and the quality of a decoded signal can be increased.

Also, if input signal tonality is high—that is, if an input signal has a marked tendency toward being audio (music)—the band setting section makes a wider setting for a low-band part and a narrower setting for a high-band part. This corresponds to a case in which the value of band setting information Band_Setting is 1 in these embodiments. By this means, coding distortion can be reduced with a shape-gain coding method up to a higher band part, and bandwidth limitation that greatly influences the quality of a decoded signal when an input signal is audio can be improved.

Also, when tonality is used to decide band setting information, if tonality is calculated by a configuration element other than the band setting section, the amount of computation necessary for tonality calculation can be reduced by using a configuration whereby calculated tonality is input to the band setting section. In this case, it is sufficient to input tonality to the band setting section, and it is not necessary to input an input spectrum or difference spectrum.

In the above embodiments, a case in which the value of band setting information is one of two values, 0 or 1, has been given as an example, but the present invention is not limited to this, and can also be applied in a similar way to a configuration in which band setting information can have two or more values. Although the number of bits (amount of information) necessary for band setting information increases, increasing the possible values of band setting information and increasing the number of band setting patterns enables band setting to be performed that is more appropriate for an input signal. For example, by providing for four possible band setting values—0, 1, 2, and 3—and setting one of these four values according to the energy ratio of a low-band part and high-band part, a band quantized by a coding section of each layer can be set more finely according to the input signal.

In the above embodiments, a configuration in which a band setting section performs band adjustment for each processed frame has been described as an example. However, the present invention is not limited to this, and can also be applied in a similar way to a configuration whereby band adjustment is performed in units of processing of several frames, for example. By means of a configuration of this kind, the amount of processing computation by the band setting section can be reduced, and input signal discontinuity that may occur due to band adjustment for each processed frame can be alleviated.

In the above embodiments, a configuration in which a band setting section performs band adjustment independently for each processed frame has been described as an example. However, the present invention is not limited to this, and can also be applied in a similar way to a configuration whereby a band of a current frame is adjusted (set) based on band setting information for a past processed frame. One possible configuration example is one whereby band setting information for several frames back is used to smooth parameters (first band energy, second band energy, and so forth) at the time of current frame band setting on a time axis, and decide current frame band setting information. Another possible configuration example is one whereby band setting information itself is smoothed after delaying band setting information for several frames so that band setting information itself does not fluctuate rapidly. By means of a configuration of this kind, rapid fluctuation of band setting information for each processed frame can be prevented, and decoded signal discontinuity that may occur due to band adjustment for each processed frame can be alleviated.

In above Embodiment 1 through Embodiment 3, an encoding apparatus has been described as adaptively deciding an extension band setting according to an input signal characteristic, and in above Embodiment 4, an encoding apparatus has been described as adaptively deciding an extension band setting according to a coding parameter indicating conditions at the time of coding. However, it is also possible for an encoding apparatus to input both an input signal and a coding parameter, and decide an extension band setting based on both an input signal characteristic and a coding parameter. For example, one possible actual method is first to set an extension band to some extent by means of a coding parameter (such as a coding bit rate), and then to perform finer extension band setting adjustment using an input signal characteristic (such as a high-band/low-band energy ratio). By this means, more appropriate band setting can be performed, enabling more efficient encoding to be performed, and also enabling the quality of a decoded signal in a decoding apparatus to be improved. Alternatively, it is also possible for an encoding apparatus to input both an input signal and a coding parameter, to select either the input signal characteristic or the coding parameter by determining which of these parameters is suitable for use, and to decide an extension band setting based on the selected parameter.

An encoding apparatus and decoding apparatus according to the present invention are not limited to the above embodiments, and it is possible for such apparatus to be implemented with various modifications. For example, the embodiments may be combined to be implemented as appropriate.

A decoding apparatus according to each of the above embodiments has been assumed to perform processing using coded information transmitted from an encoding apparatus according to each of the above embodiments. However, the present invention is not limited to this, and as long as coded information includes a necessary parameter and data, it is possible for processing to be performed with coded information that is not necessarily from an encoding apparatus according to an above embodiment.

The present invention can also be applied to, and the same kind of operation and effects as in these embodiments can also be obtained in, a case in which recording and writing of a signal processing program is performed in/on/to a machine-readable recording medium such as memory or a disk, tape, CD, or DVD, and operation thereof is performed.

In the above embodiments, a case has been described by way of example in which the present invention is configured as hardware, but it is also possible for the present invention to be implemented by software.

The function blocks used in the above embodiments are implemented as LSIs typically comprising integrated circuitry. These may be implemented individually as single chips, or a single chip may incorporate some or all of them. Here, the term LSI has been used, but the terms IC, system LSI, super LSI, and ultra LSI may also be used according to differences in the degree of integration.

Implementation of integrated circuitry is not limited to an LSI method, and implementation by means of dedicated circuitry or a general-purpose processor may also be used. An FPGA (Field Programmable Gate Array) for which programming is possible after LSI fabrication, or a reconfigurable processor allowing reconfiguration of circuit cell connections and settings within an LSI, may also be used.

Furthermore, in the event of the introduction of an integrated circuit implementation technology whereby LSI technology is replaced by a different technology as an advance in, or derivation from, semiconductor technology, integration of the function blocks may of course be performed using that technology. The application of biotechnology or the like is also a possibility.

The disclosures of Japanese Patent Application No. 2009-244838, filed on Oct. 23, 2009, and Japanese Patent Application No. 2009-272194, filed on Nov. 30, 2009, including the specifications, drawings and abstracts, are incorporated herein by reference in their entirety.

INDUSTRIAL APPLICABILITY

An encoding apparatus, decoding apparatus, and methods thereof according to the present invention enable the quality of a decoded signal to be improved when performing band enhancement using a low-band part spectrum and estimating a high-band part spectrum, and are suitable for use in a packet communication system, mobile communication system, or the like, for example.

REFERENCE SIGNS LIST

101, 111, 121, 131 Encoding apparatus
102 Channel
103, 113, 123, 133 Decoding apparatus
201, 802, 1005, 1404, 1406, 2405, 2804, 2806 Orthogonal transform processing section
202 Coding section
301, 1101, 1801 Band setting section
302, 1102 Low-band coding section
303, 1103, 1802 High-band coding section
902, 1502 Low-band decoding section
903, 1503, 2002 High-band decoding section
304, 404, 507, 1104, 1204, 1307, 1803, 2503, 2704 Multiplexing section
401, 2701 Coding target spectrum calculation section
402, 1202, 2702 Shape coding section
403, 506, 1203, 1306, 2703 Gain coding section
501, 1301, 1311, 2601 Band division section
502, 922, 1302, 1602, 3102 Filter state setting section
503, 923, 1303, 1603, 3103 Filtering section
505, 1305 Search section
504, 1304 Pitch coefficient setting section
801 Decoding section
901, 911, 921, 1501, 1601, 2001, 2901, 3001, 3101 Demultiplexing section
1504 Spectrum synthesis section
912, 3002 Shape decoding section
913, 924, 1604, 3003, 3104 Gain decoding section
925, 1605, 3105 Spectrum adjustment section
1001, 2401 Down-sampling processing section
1002, 2403 First layer coding section
1003, 1402, 2403, 2802 First layer decoding section
1004, 1403, 2404, 2803 Up-sampling processing section
1006, 1701, 2406 Second layer coding section
1007, 2407 Coded information integration section
1201 Difference spectrum calculation section
1401, 2801 Coded information demultiplexing section
1405, 1901, 2805 Second layer decoding section
2501 Band enhancement coding section
2502 Residual spectrum coding section
2602, 3106 Addition spectrum calculation section
2902 Residual spectrum decoding section
2903 Band enhancement decoding section

The invention claimed is:

1. An encoding apparatus that performs band enhancement using a low-band side spectrum and generates a high-band side spectrum, the encoding apparatus comprising:

a band setter that inputs an input signal of a frequency domain and uses a characteristic of the input signal of the frequency domain as a basis, or inputs the input signal of the frequency domain and a coding parameter and uses at least one of the coding parameter and a characteristic of the input signal of the frequency domain as a basis, for generating band setting information that decides a first band of a high-band side set by the band enhancement; and a high-band encoder that encodes the input signal of the first band decided based on the band setting information and generates high-band part coded information, wherein the band setter generates the band setting information that decides the first band and a low-band side second band by dividing the frequency domain into the first band and the second band, the encoding apparatus further comprising:

a fixed-band encoder that encodes the input signal of a band fixed beforehand in a low-band part of the second band and generates fixed-band coded information; and a low-band encoder that encodes a difference between the input signal of the second band and the input signal of the fixed band and generates low-band part coded information.

2. An encoding apparatus that performs band enhancement using a low-band side spectrum and generates a high-band side spectrum, the encoding apparatus comprising:

a band setter that inputs an input signal of a frequency domain and uses a characteristic of the input signal of the frequency domain as a basis, or inputs the input signal of the frequency domain and a coding parameter and uses at least one of the coding parameter and a characteristic of the input signal of the frequency domain as a basis, for generating band setting information that decides a first band of a high-band side set by the band enhancement; and a high-band encoder that encodes the input signal of the first band decided based on the band setting information and generates high-band part coded information, wherein the band setter compares energy of the input signal of a low-band side arbitrary third band within the frequency domain of the input signal and energy of the input signal of a fourth band of a higher-band side than the third band, and generates the band setting information that decides the first band based on a comparison result.

3. The encoding apparatus according to claim 2, wherein the band setter makes a narrow setting for the first band if energy of the third band is relatively greater than energy of the fourth band, and makes a wide setting for the first band if energy of the third band is not relatively greater than energy of the fourth band.

4. An encoding apparatus that performs band enhancement using a low-band side spectrum and generates a high-band side spectrum, the encoding apparatus comprising:

a band setter that inputs an input signal of a frequency domain and uses a characteristic of the input signal of the frequency domain as a basis, or inputs the input signal of the frequency domain and a coding parameter and uses at least one of the coding parameter and a characteristic of the input signal of the frequency domain as a basis, for generating band setting information that decides a first band of a high-band side set by the band enhancement; and a high-band encoder that encodes the input signal of the first band decided based on the band setting information and generates high-band part coded information, wherein the band setter generates the band setting information that decides the first band and a low-band side second band by dividing the frequency domain into the first band and the second band, wherein the band setter compares energy of the input signal of a low-band side third band within the frequency domain of the input signal and energy of the input signal of a fourth band of a higher-band side than the third band, and generates the band setting information that decides the first band and the second band based on a comparison result.

5. The encoding apparatus according to claim 4, wherein the band setter makes a wide setting for the second band and makes a narrow setting for the first band if energy of the third band is relatively greater than energy of the fourth band, and makes a narrow setting for the second band and makes a wide setting for the first band if energy of the third band is not relatively greater than energy of the fourth band.

* * * * *